US006458726B1

(12) United States Patent
Harrington et al.

(10) Patent No.: US 6,458,726 B1
(45) Date of Patent: Oct. 1, 2002

(54) POLYPROPYLENE FIBERS AND ITEMS MADE THEREFROM

(75) Inventors: James H. Harrington, Stone Mountain; Randall E. Kozulla, Social Circle; John F. L. Newport, Stone Mountain; Edward J. Engle; Elizabeth L. Fahey, both of Conyers, all of GA (US); Walter J. Freeman, Landenberg, PA (US); Rakesh K. Gupta; Carl J. Wust, both of Conyers, GA (US)

(73) Assignee: Fiberco, Inc., Wilmington, DE (US)

( * ) Notice: Subject to any disclaimer, the term of this patent is extended or adjusted under 35 U.S.C. 154(b) by 0 days.

(21) Appl. No.: 09/353,651

(22) Filed: Jul. 15, 1999

Related U.S. Application Data

(60) Division of application No. 08/728,491, filed on Oct. 9, 1996, now Pat. No. 5,985,193, which is a continuation-in-part of application No. 08/625,073, filed on Mar. 29, 1996, now abandoned.

(51) Int. Cl.[7] ..... D02G 1/00

(52) U.S. Cl. ..... 442/364; 428/373; 428/375; 428/394; 442/361; 442/414; 604/358

(58) Field of Search ..... 428/373, 375, 428/394; 442/361, 364, 414; 604/358

(56) References Cited

U.S. PATENT DOCUMENTS

| | | | |
|---|---|---|---|
| 2,904,828 | A | 9/1959 | Smith |
| 3,433,573 | A | 3/1969 | Holladay et al. |
| 3,436,298 | A | 4/1969 | Oppenlander et al. |
| 3,533,904 | A | 10/1970 | Jurkiewitsch |
| 3,849,241 | A | 11/1974 | Butin et al. |
| 4,100,324 | A | 7/1978 | Anderson et al. |
| 4,173,504 | A | 11/1979 | Tomioka et al. |
| 4,181,762 | A | 1/1980 | Benedyk |
| 4,189,338 | A | 2/1980 | Ejima et al. |
| 4,211,816 | A | 7/1980 | Booker et al. |
| 4,220,611 | A | 9/1980 | Wolf |
| 4,234,655 | A | 11/1980 | Kunimune et al. |
| 4,269,888 | A | 5/1981 | Ejima et al. |
| 4,285,748 | A | 8/1981 | Booker et al. |
| 4,305,990 | A | 12/1981 | Kelly |
| 4,323,534 | A | 4/1982 | DesMarais |
| 4,323,626 | A | 4/1982 | Kunimune et al. |
| 4,355,425 | A | 10/1982 | Jones et al. |
| 4,375,446 | A | 3/1983 | Fujii et al. |
| 4,413,623 | A | 11/1983 | Pieniak |
| 4,434,205 | A | 2/1984 | Fujii et al. |
| 4,450,026 | A | 5/1984 | Pieniak et al. |
| 4,469,540 | A | 9/1984 | Furukawa et al. |
| 4,476,180 | A | 10/1984 | Wnuk |
| 4,500,384 | A | 2/1985 | Tomioka et al. |
| 4,508,113 | A | 4/1985 | Malaney |
| 4,518,744 | A | 5/1985 | Brody |
| 4,552,603 | A | 11/1985 | Harris, Jr et al. |
| 4,555,811 | A | 12/1985 | Shimalla |
| 4,578,414 | A | 3/1986 | Sawyer et al. |
| 4,588,630 | A | 5/1986 | Shimalla |
| 4,626,467 | A | 12/1986 | Hostetter |
| 4,651,725 | A | 3/1987 | Kifune et al. |
| 4,722,857 | A | 2/1988 | Tomioka et al. |
| 4,738,895 | A | 4/1988 | Tomioka et al. |
| 4,741,944 | A | 5/1988 | Jackson et al. |
| 4,769,279 | A | 9/1988 | Graham |
| 4,798,757 | A | 1/1989 | Modrak et al. |
| 4,803,117 | A | 2/1989 | Daponte et al. |
| 4,814,032 | A | 3/1989 | Taniguchi et al. |
| 4,818,587 | A | 4/1989 | Ejima et al. |

(List continued on next page.)

FOREIGN PATENT DOCUMENTS

| | | |
|---|---|---|
| EP | 552013 | 7/1923 |
| EP | 154197 | 9/1985 |
| EP | 199531 | 10/1986 |
| EP | 239080 | 9/1987 |
| EP | 445536 | 11/1991 |
| EP | 547834 | 6/1993 |
| EP | 630996 | 12/1994 |
| EP | 719879 | 7/1996 |
| GB | 1034337 | 6/1966 |
| JP | 49066968 | 6/1974 |
| JP | 63243324 | 10/1988 |
| WO | 94/17226 | 8/1994 |
| WO | 94/25647 | 11/1994 |
| WO | 94/25648 | 11/1994 |
| WO | 9601916 | 1/1996 |
| WO | 9627041 | 9/1996 |
| WO | 9706945 | 2/1997 |
| WO | 9707274 | 2/1997 |
| WO | 98/16672 | 4/1998 |

OTHER PUBLICATIONS

C.R. Davey–Exxon Chemical Co., INDA. Technical Symposium 15th, May 18–21, 1987, Hilton Head, S.C., "EVA and E–MA Melt Blown Webs as Elastic and Adhesive Structural Components", pp. 232–237.

Nakajima, "Advanced Fiber Spinning Technology", Woodhead Publishing Limited, 1994, pp. 108–109.

English Language abstract of JP–63–243324.

3M Dynamar Polymer Processing Additive FX–5920A Technical Information, 3m Specialty Fluoropolymers Department, St. Paul Minn., Sep. 1993.

Product Specifications, Dynamar Brand Polymer Processing Addtive, FX–5920A, 3M Specialty Fluoropolymers Department, St. Paul, Minn., Sep. 1993.

(List continued on next page.)

*Primary Examiner*—Terrel Morris
*Assistant Examiner*—John J. Guarriello
(74) *Attorney, Agent, or Firm*—Greenblum & Bernstein, P.L.C.

(57) ABSTRACT

Process of producing skin-core fibers and the resulting fibers and nonwoven materials and articles wherein the fibers are composed of a polymer blend of a polyolefin and polymeric bond curve enhancing agents, such as ethylene vinyl acetate polymers.

103 Claims, 11 Drawing Sheets

U.S. PATENT DOCUMENTS

| | | | | |
|---|---|---|---|---|
| 4,840,846 | A | 6/1989 | Ejima et al. | |
| 4,863,779 | A | 9/1989 | Daponte | |
| 4,938,832 | A | 7/1990 | Schmalz | |
| 5,033,172 | A | 7/1991 | Harrington | |
| 5,079,080 | A | 1/1992 | Schwarz | |
| 5,108,827 | A | 4/1992 | Gessner | |
| 5,116,662 | A | 5/1992 | Morman | |
| 5,124,194 | A | 6/1992 | Kawano | |
| 5,227,224 | A | 7/1993 | Ishikawa et al | |
| 5,281,378 | A | 1/1994 | Kozulla | |
| 5,294,482 | A | 3/1994 | Gessner | |
| 5,318,735 | A | 6/1994 | Kozulla | |
| 5,324,580 | A | 6/1994 | Allan et al. | |
| 5,424,115 | A | 6/1995 | Stokes | |
| 5,431,994 | A | 7/1995 | Kozulla | |
| 5,456,982 | A | 10/1995 | Hansen et al. | |
| 5,507,997 | A | 4/1996 | Evain | |
| 5,554,435 | A | 9/1996 | Gupta et al. | |
| 5,629,080 | A | 5/1997 | Gupta et al. | |
| 5,654,088 | A | 8/1997 | Gupta et al. | |
| 5,705,119 | A | 1/1998 | Takeuchi et al. | 264/83 X |

OTHER PUBLICATIONS

3M Material Safety Data Sheet for FX–5920A Dynamar Brand Polymer Processing Additive, 3M Specialty Fluoropolymers Department, Apr. 1996.

3M Dynamar Polymer Processing Additive FX 9613 Technical Information, 3M Specialty Fluoropolymers Department, St. Paul. Minn, Jun. 1995.

Product Specification, Dynamar (TM) Brand Polymer Processing Addtive, FX–9613, 3M Specialty Fluoro–polymers Department, St. Paul. Minn., Jul. 1995.

3M Material Safety Data Sheet for FX–9613 Dynamar Brand Polymer Processing Additive, 3M Specialty Fluoropolymers Department, Feb. 1996.

Dupont Dow Elastomers Technical Infornmation, Viton Free Flow GB, Dupont Elastomers, Viton Business Center, Elkton, MD.

Dupont Dow Elastomers L.L.C. Material Safety Data Sheet, "Viton" Fluoroelastomer all in synonym list vit066, Dupont Dow Elastomers L.L.C., Wilmington, DE revised Aug. 1994, printed Apr. 1996.

SigmaPlot Scientific Graphing Software, Jandel Scientific, Corte Madera, CA 94925, Use's Manual for IBM PC and compatibles, Version 4.0, Dec. 1989 and Supplement to the User's Manual Version 4.1, Jan. 1991, pp. 4–164 to 4–166.

Hicks, "Fundamental Concepts in the Design of Experiments", CBS College Publishing, New York, 1982, pp. 130–139.

Danaklon A/S Brochure, Danaklon HY–Speed Fibers: Your Main Source of Competitiveness.

ASTM D1117, pp. 186–187.

ASTM D1682–64 (Reaaproved 1975), pp. 255–260.

ELVAX Resigns Grade Selection Guide, Dupont Company, Polymer Products, Wilmington, DE, Oct. 1989.

ELVAX Ethylene–Vinyl Acetate Copolmer Resins—Packing Grade Selection Guide, Dupont Polymers, Packaging and Industrial Polymers, Wilmington, DE, Aug. 1992.

ELVAX Resins for Molding, Compounding and Extrusion–Injection Molding Guide, Dupont Company, Polymer Products Department, Wilmington DE.

ELVAX Resigns Price List effective Jan. 1, 1996—Elvax Ethylene–Vinyl Acetate Copolymer Resigns for Molding, Compounding and Extrusion, Nov. 1995.

ELVAX Resigns Price List effective Jan. 1, 1996—Elvax Ethylene–Vinyl Acetate Copolymer Resigns for Packaging, Nov. 1995.

Trent et al., "Ruthenium Tetrixide Staining of Polymers for Electron Microscopy", Macromolecules, vol. 16, No. 4, 1983, pp. 590–597.

Zeichner and Patel, Proceedings of Second World Congress of Chemical Engineering, Montreal, vol. 6 (1981) pp. 333–337.

Legare, 1986 TAPPI Synthetic Fibers for Wet System and Thermal Bonding Applications, Boston Park Plaza Hotel and Towers, Boston, Mass., Oct. 9–10, 1986, "Thermal Bonding of Polypropylene Fibers in Nonwovens" pp. 1–13 and attached Tables and Figures.

Malkan et al. "Parametric Studies of the Reicofil Spunbonding Process", International Nonwovens Journal Spring 1994, vol. 6, No. 2, pp. 42–57.

Kirk–Othmer Encyclopedia of Chemical Technology, 3rd Edition, vol. 23, 1983, pp. 817–847.

Malkan et al., "A Review on Spunbond Technology—Part I", INB Nonwovens, Mar. 1992, pp. 4, 6, 8, 10, 12 and 14.

S. Kawalata, Kyoto University, Japan, Chapter IV. Measurement of the Mechanical Properties of Fabric, pp. 28–50.

Barker et al., Department of Textile Engineering and Science, School of Textiles, North Carolina State University, Raleigh, NC, Applications of the KES System for Nonwovens, Part I: Evaluation of Wet–Laid Systems, pp. 1–18.

Anjaria et al., Department of Textiles Engineering and Science, School of Textiles, North Carolina State University, Raleigh, NC, Applications of the KES System for Nonwovens, Part II: Evaluation of Melt Bown Systems, pp. 1–16.

Vohs et al., Department of Textile Engineering and Science, School of Textiles, North Carolina State University, Raleigh, NC, and the Dexter Corporation, Windsor Locks, CT, Applications of the KES System for Nonwovens, Part III: Evaluating the Processability of Nonwovens in Tea Bag Manufacturing, pp. 1–9.

Malkan et al., "Parametric Studies of the 'Reicofil' Spunbonding Process", International Nonwovens Journal, Spring 1994, vol. 6, No. 2, pp. 57–60.

Derwent Abstract No. 97–083970/08 of JP 08325907–A published Dec. 10, 1996.

An International Search Report with Application No. PCT/US97/04470 and Annex.

Database WPI, Section Ch, Week 7505, Derwent Publications Ltd., London, GB; XP002036455.

Copy of an abstract of the International Publication having the No. 98–251310/22.

POLYPROPYLENE FIBERS AND ITEMS MADE THEREFROM

CONTINUING APPLICATION DATA

This application is a divisional of application Ser. No. 08/728,491, filed Oct. 9, 1996 now U.S. Pat. No. 5,985,193, the entire disclosure of which is incorporated by reference in its entirety, which is a continuation-in-part of application Ser. No. 08/625,073, filed Mar. 29, 1996, now abandoned.

BACKGROUND OF THE INVENTION

1. Field of the Invention

The present invention relates to synthetic fibers especially useful in the manufacture of nonwoven fabrics. In particular, the present invention relates to fibers intended for such use, including processes of their production, and compositions for producing the fibers, as well as nonwoven fabrics and articles containing these fibers. More specifically, the fibers of the present invention are capable of providing soft feeling nonwoven materials that have high tensile strength. Further, the nonwoven materials are thermally bondable at lower temperatures while having superior strength properties, including cross-directional strength. The fibers of the present invention can be incorporated into lower basis weight nonwoven materials which have strength properties that are equal to or greater than nonwoven materials of higher basis weight. Still further, the fibers of the present invention are capable of being run on high speed machines, such as high speed carding and bonding machines.

2. Background Information

The requirements of nonwoven fabrics used in applications concerned with hygiene, medical fabrics, wipes and the like continue to grow. Moreover, utility and economy, and aesthetic qualities often must be met simultaneously. The market continues to expand for polyolefin fibers and items made therefrom having enhanced properties and improved softness.

The production of polymer fibers for nonwoven materials usually involves the use of a mix of at least one polymer with nominal amounts of additives, such as stabilizers, pigments, antacids and the like. The mix is melt extruded and processed into fibers and fibrous products using conventional commercial processes. Nonwoven fabrics are typically made by making a web, and then thermally bonding the fibers together. For example, staple fibers are converted into nonwoven fabrics using, for example, a carding machine, and the carded fabric is thermally bonded. The thermal bonding can be achieved using various heating techniques, including heating with heated rollers, hot air and heating through the use of ultrasonic welding.

Fibers can also be produced and consolidated into nonwovens in various other manners. For example, the fibers and nonwovens can be made by spunbonded processes. Also, consolidation processes can include needlepunching, through-air thermal bonding, ultrasonic welding and hydroentangling.

Conventional thermally bonded nonwoven fabrics exhibit good loft and softness properties, but less than optimal cross-directional strength, and less than optimal cross-directional strength in combination with high elongation. The strength of the thermally bonded nonwoven fabrics depends upon the orientation of the fibers and the inherent strength of the bond points.

Over the years, improvements have been made in fibers which provide stronger bond strengths. However, further improvements are needed to provide even higher fabric strengths at lower bonding temperatures and lower fabric basis weight to permit use of these fabrics in today's high speed converting processes for hygiene products, such as diapers and other types of incontinence products. In particular, there is a need for thermally bondable fibers, and the resulting nonwoven fabrics that possess high cross-directional strength, high elongation and excellent softness, with the high cross-directional strength (and softness) being obtainable at low bonding temperatures.

Further, there is a need to produce thermally bondable fibers that can achieve superior cross-directional strength, elongation and toughness properties in combination with fabric uniformity, loftiness and softness. In particular, there is a need to obtain fibers that can produce nonwoven materials, especially, carded, calendered fabrics with cross-directional properties on the order of at least about 200 to 400 g/in., more preferably 300 to 400 g/in, preferably greater than about 400 g/in, and more preferably as high as about 650 g/in or more, at speeds as high as about 500 ft/min, preferably as high as about 700 to 800 ft/min, and even more preferably as high as about 980 ft/min (300 m/min). Further, the fabrics can have an elongation of about 50–200%, and a toughness of about 200 to 700 g/in, preferably about 480–700 g/in for nonwoven fabrics having a basis weight of from about 10 g/yd$^2$ to 20 g/yd$^2$. Thus, it is preferred to have these strength properties at a basis weight of about 20 g/yd$^2$, more preferably less than about 20 g/yd$^2$, even more preferably less than about 17 to 18 g/yd$^2$, even more preferably less than about 15 g/yd$^2$, and even more preferably less than about 14 g/yd$^2$ and most preferably as low as 10 g/yd$^2$, or lower. Commercial fabrics produced today, depending upon use, have a basis weight of, for example, about 11–25 g/yd$^2$, preferably 15–24 g/yd$^2$.

Softness of the nonwoven material is particularly important to the ultimate consumer. Thus, products containing softer nonwovens would be more appealing, and thereby produce greater sales of the products, such as diapers including softer layers.

Various techniques are known for producing fibers that are able to be formed into nonwoven materials having superior properties, including high cross-directional strength and softness. For example, U.S. Pat. Nos. 5,281,378, 5,318,735 and 5,431,994 to Kozulla are directed to processes for preparing polypropylene containing fibers by extruding polypropylene containing material having a molecular weight distribution of at least about 5.5 to form a hot extrudate having a surface, with quenching of the hot extrudate in an oxygen-containing atmosphere being controlled so as to effect oxidative chain scission degradation of the surface. In one aspect of the process disclosed in the Kozulla patents, the quenching of the hot extrudate in an oxygen-containing atmosphere can be controlled so as to maintain the temperature of the hot extrudate above about 250° C. for a period of time to obtain oxidative chain scission degradation of the surface.

As disclosed in these patents, by quenching to obtain oxidative chain scission degradation of the surface, such as by delaying cooling or blocking the flow of quench gas, the resulting fiber essentially contains a plurality of zones, defined by different characteristics including differences in melt flow rate, molecular weight, melting point, birefringence, orientation and crystallinity. In particular, as disclosed in these patents, a fiber produced therein includes an inner zone identified by a substantial lack of oxidative polymeric degradation, an outer zone of a high concentration of oxidative chain scission degraded polymeric material, and an intermediate zone identified by an inside-to-outside increase in the amount of oxidative chain scission polymeric degradation. In other words, the quenching of the hot extrudate in an oxygen containing atmosphere can be controlled so as to obtain a fiber having a decreasing weight average molecular weight towards the surface of the fiber, and an increasing melt flow rate towards the surface of the fiber. For example, a preferred fiber comprises an inner zone having a weight average molecular weight of about 100,000 to 450,000 grams/mole, an outer zone, including the surface of the fiber, having a weight average molecular weight of less than about 10,000 grams/mole, and an intermediate zone positioned between the inner zone and the outer zone having a weight average molecular weight and melt flow rate intermediate the inner zone and the outer zone. Moreover, the inner, core zone has a melting point and orientation that is higher than the outer surface zone.

Further, U.S. patent application Ser. Nos. 08/080,849, 08/378,267, 08/378,271 and 08/378,667 (and its continuation application Ser. No. 08/598,168, which issued as U.S. Pat. No. 5,705,119) to Takeuchi et al., and European Patent Application No. 0 630 996 to Takeuchi et al., which are incorporated by reference herein in their entirety, are directed to obtain fibers having a skin-core morphology, including obtaining fibers having a skin-core morphology in a short spin process. In these applications, a sufficient environment is provided to the polymeric material in the vicinity of its extrusion from a spinnerette to enable the obtaining of a skin-core structure. For example, because this environment is not achievable in a short spin process solely by using a controlled quench, such as a delayed quench utilizable in the long spin process, the environment for obtaining a skin-core fiber is obtained by using apparatus and procedures which promote at least partial surface degradation of the molten filaments when extruded through the spinnerette. In particular, various elements can be associated with the spinnerette, such as to heat the spinnerette or a plate associated with the spinnerette, so as to provide a sufficient temperature environment, at least at the surface of the extruded polymeric material, to achieve a skin-core fiber structure.

Still further, Kozulla, U.S. patent application Ser. No. 08/358,884, filed Dec. 19, 1994, its continuation application Ser. No.08/998,592 and European Patent Application No. 0 719 879, which are incorporated by reference in their entirety, are directed to the production of skin-core fibers that can be produced under various conditions while ensuring the production of thermally bondable fibers that can provide nonwoven fabrics having superior cross-directional strength, elongation and toughness.

Still further, it is known that blends of materials can be extruded to obtain fibers. For example, U.S. Pat. No. 3,433,573 to Holladay et al. is directed to compositions comprising blends of 5 to 95% by weight of a propylene polymer containing a major amount of propylene, and 95 to 5% by weight of a copolymer of ethylene with a polar monomer, such as vinyl acetate, methyl methacrylate, vinylene carbonate, alkyl acrylates, vinyl halides and vinylidene halides. Compositions within the broad scope of Holladay et al. include blends containing 5 to 95% polypropylene and correspondingly, from about 5 to 95% ethylene/vinyl acetate copolymer, expressed as weight percent of the ultimate blend. The compositions of Holladay et al. may be formed into fibers, films and molded articles of improved dyeability and low temperature characteristics.

Moreover, U.S. Pat. No. 4,803,117 and European Patent Application No. 0 239 080 to Daponte are directed to melt-blowing of certain copolymers of ethylene into elastomeric fibers or microfibers. The useful copolymers are disclosed to be those of ethylene with at least one vinyl monomer selected from the group including vinyl ester monomers, unsaturated aliphatic monocarboxylic acids and alkyl esters of these monocarboxylic acids, where the amount of vinyl monomer is sufficient to impart elasticity to the melt-blown fibers. Exemplary copolymers disclosed by Daponte are those of ethylene with vinyl acetate (EVA) having a melt index in the range from 32 to 500 grams per ten minutes, when measured in accordance with ASTM D-1238-86 at condition E, and including from about 10% by weight to about 50% by weight of vinyl acetate monomer, more specifically from about 18% to about 36% by weight of vinyl acetate monomer, and most specifically from about 26% to about 30% by weight of vinyl acetate monomer, with an even more specific value being about 28% by weight.

The copolymer of Daponte can be mixed with a modifying polymer, which may be an olefin selected from the group including at least one polymer selected from the group including polyethylene, polypropylene, polybutene, ethylene copolymers (generally other than those with vinyl acetate), propylene copolymers, butene copolymers or blends of two or more of these materials. The extrudable blend of Daponte usually includes from at least 10% by weight of the ethylene/vinyl copolymer and from greater than 0% by weight to about 90% by weight of the modifying polymer.

WO 94/17226 to Gessner et al. is directed to a process for producing fibers and nonwoven fabrics from immiscible polymer blends wherein the polymer blend can include polyolefins, such as polyethylene and polypropylene. Additionally, the blend may include up to about 20% by weight of one or more additional dispersed or continuous phases comprising compatible or immiscible polymers, for example, up to about 20% by weight of an adhesive promoting additive, which amongst other materials can be poly(ethylene vinyl acetate) polymers.

Still further, it is known that composite fibers, e.g., having a sheath-core or side-by-side structure, can be produced with different polymers in the different components making up the composite fibers. For example, U.S. Pat. Nos. 4,173,504, 4,234,655, 4,323,626, 4,500,384, 4,738,895, 4,818,587 and 4,840,846 disclose heat-adhesive composite fibers such as sheath-core and side-by-side structured fibers which, amongst other features, include a core that can be composed of polypropylene and a sheath that can be composed of ethylene vinyl acetate copolymer.

Further, U.S. Pat. No. 5,456,982 discloses a bicomponent fiber wherein the sheath may additionally comprise a hydrophilic polymer or copolymer, such as (ethyl vinyl acetate) copolymer.

SUMMARY OF THE INVENTION

It is an object of the present invention to provide thermal bonding fibers for making fabrics with high cross-directional strength, elongation and toughness.

It is another object of the invention to provide fibers for making nonwoven materials that are softer than those made with polypropylene fibers.

It is another object of the invention to provide polypropylene fibers which thermally bond well at lower temperatures.

It is yet still a further object of this invention to provide polypropylene fibers with a relatively flat bonding curve.

It is an object of the present invention to obtain thermal bonding of fibers at lower bonding temperatures while maintaining high cross-directional strength, elongation and toughness of the resulting nonwoven material.

It is a further object of the present invention to provide a greater bonding window by obtaining a flatter curve of cross-directional strength vs. bonding temperature to permit thermal bonding of fibers at lower bonding temperatures while maintaining high cross-directional strength of the resulting nonwoven material, whereby lower bonding temperatures can be utilized to enable the obtaining of softer nonwoven materials.

It is still a further object of the present invention to provide lower basis weight nonwoven materials that have strength properties, such as cross-directional strength, elongation and toughness that are equal to or greater than these strength properties obtained with other polypropylene fibers at higher basis weights.

It is still a further object of the present invention to provide fibers and nonwovens that can be handled on high speed machines, including high speed carding and bonding machines, that run at speeds as great as about 980 ft/min (300 m/min).

It is still a further object of the present invention to provide biconstituent or multiconstituent fibers having a skin-core structure produced from blends of polypropylene and polymeric bond curve enhancing agent.

In one aspect of the present invention, it is an object to provide a process for preparing a fiber having a skin-core structure, comprising extruding a polymer blend comprising polypropylene and polymeric bond curve enhancing agent as a hot extrudate; and providing conditions so that the hot extrudate forms a fiber having a skin-core structure. The hot extrudate can be extruded in an oxidative atmosphere under conditions to form a skin-core structure.

The process for preparing a fiber having a skin-core structure can also comprise extruding a polymer blend comprising polypropylene and polymeric bond curve enhancing agent as a hot extrudate; and controlling conditions so that the hot extrudate forms a fiber having a skin-core structure.

In one aspect of the present invention, the polymeric bond curve enhancing agent can provide flattening of a bond curve of cross-directional strength vs. temperature as compared to a nonwoven material produced under same conditions from fibers produced under same conditions except for absence of the polymeric bond curve enhancing agent.

In another aspect of the present invention, the polymeric bond curve enhancing agent can provide raising of at least some points of cross-directional strength of a bond curve of cross-directional strength vs. temperature as compared to a nonwoven material produced under same conditions from fibers produced under same conditions except for absence of the polymeric bond curve enhancing agent, with the raising of at least some points of cross-directional strength preferably including raising of peak cross-directional strength or raising at least some points at temperatures lower than peak cross-directional strength.

In still another aspect of the present invention, the polymeric bond curve enhancing agent can provide raising of at least some points of cross-directional strength and shifting to lower temperatures of a bond curve of cross-directional strength vs. temperature as compared to a nonwoven material produced under same conditions from fibers produced under same conditions except for absence of the polymeric bond curve enhancing agent, with the raising of at least some points of cross-directional strength preferably including raising of peak cross-directional strength or raising at least some points at temperatures lower than peak cross-directional strength.

In still another aspect of the present invention, the polymeric bond curve enhancing agent provides flattening, raising of at least some points of cross-directional strength, and shifting to lower temperatures of a bond curve of cross-directional strength vs. temperature as compared to a nonwoven material produced under same conditions from fibers produced under same conditions except for absence of the polymeric bond curve enhancing agent, with the raising of at least some points of cross-directional strength preferably including raising of peak cross-directional strength or raising at least some points at temperatures lower than peak cross-directional strength.

In still another aspect of the present invention, the polymeric bond curve enhancing agent provides an increase in area over a defined temperature range under a bond curve of cross-directional strength vs. temperature as compared to a nonwoven material produced under same conditions from fibers produced under same conditions except for absence of the polymeric bond curve enhancing agent. The increase in area can be provided by the bond curve being flatter and having the same, substantially the same or a lower peak cross-directional strength as compared to a nonwoven material produced under same conditions from fibers produced under same conditions except for absence of the polymeric bond curve enhancing agent. The increase in area can also be provided by the bond curve being of the same or substantially the same shape and having higher cross-directional strengths over at least some points on the bond curve over the defined temperature range as compared to a nonwoven material produced under same conditions from fibers produced under same conditions except for absence of the polymeric bond curve enhancing agent, with the at least some points preferably including a higher peak cross-directional strength. The increase in area can also be provided by the bond curve being shifted to lower temperatures with the area under the bond curve in the defined temperature range being increased as compared to a nonwoven material produced under same conditions from fibers produced under same conditions except for absence of the polymeric bond curve enhancing agent. The increase in area can also be provided by the bond curve being flatter and having cross-directional strength points at temperatures lower than peak cross-directional strength raised as compared to a nonwoven material produced under same conditions from fibers produced under same conditions except for absence of the polymeric bond curve enhancing agent. The increase in area can also be provided by the bond curve being flatter and being shifted to lower temperatures as compared to a nonwoven material produced under same conditions from fibers produced under same conditions except for absence of the polymeric bond curve enhancing agent. The increase in area can also be provided by the bond curve being flatter, being shifted to lower temperatures and having cross-directional strength points at temperatures lower than peak cross-directional strength raised as compared to a nonwoven material produced under same conditions from fibers produced under same conditions except for absence of the polymeric bond curve enhancing agent.

In the embodiments of the present invention, the polymeric bond curve enhancing agent preferably has (a) a DSC melting point of below about 230° C., preferably below about 200° C., more preferably a DSC melting point below that of the polypropylene in the polymer blend, and more preferably a DSC melting point of about 15 to 100° C. below that of the polypropylene in the polymer blend, and (b) at least one of an elastic modulus and a complex viscosity below that of the polypropylene in the polymer blend. Preferably, both of the elastic modulus and the complex viscosity are below that of the polypropylene in the polymer blend, with the elastic modulus of the polymeric bond curve enhancing agent preferably being about 5 to 100%. below that of the polypropylene in the polymer blend, and the complex viscosity of the polymeric bond curve enhancing agent preferably being about 10 to 80% below that of the polypropylene in the polymer blend.

The polypropylene can comprise at least about 80 percent by weight of the polymer blend, more preferably at least about 90 percent of the polymer blend, with the polymer blend preferably comprising up to about 20 percent by weight polymeric bond curve enhancing agent, preferably up to about 10 percent by weight of the polymeric bond curve enhancing agent, more preferably less than 10 percent by weight, more preferably about 0.5 to 7 percent by weight, even more preferably about 1 to 5 percent by weight, even more preferably about 1.5 to 4 percent by weight, and a preferred amount being about 3 percent by weight.

The polymeric bond curve enhancing agent preferably comprises at least one polymer selected from the group consisting of alkene vinyl carboxylate polymers, polyethylenes, alkene acrylic acids or esters, alkene co-acrylates, acid modified alkene acrylates, alkene acrylate acrylic acid polymers, and polyamides. More preferably, the polymeric bond curve enhancing agent comprises at least one polymer selected from the group consisting of ethylene vinyl acetate polymers, polyethylenes, ethylene methacrylic acids, ethylene N-butyl acrylate glycidyl methacrylate, alkene co-acrylate co-carbon monoxide polymers, acid modified ethylene acrylates, ethylene acrylate methacrylic acid terpolymers, and nylon 6. Even more preferably, the ethylene vinyl acetate polymers comprise at least one of ethylene vinyl acetate copolymer and ethylene vinyl acetate terpolymer; the alkene co-acrylate co-carbon monoxide polymers comprise ethylene N-butyl acrylate carbon oxides; and the acid modified ethylene acrylates comprise at least one of ethylene isobutyl acrylate-methyl acrylic acid and ethylene N-butyl acrylic methylacrylic acid.

In the case of the polymeric bond curve enhancing agent comprising ethylene vinyl acetate polymer, it is preferably present in about less than 10 percent by weight. Additionally, the ethylene vinyl acetate polymer can contain about 0.5 to 50 weight percent vinyl acetate units, more preferably about 5 to 50 weight percent vinyl acetate units, even more preferably about 5 to 40 weight percent vinyl acetate units, even more preferably about 5 to 30 weight percent vinyl acetate units, with preferred more specific amounts being about 9 weight percent vinyl acetate units and about 28 weight percent vinyl acetate units.

The polymer blend can include additional polymers to polymers that are polymeric bond curve enhancing agents, such as polyethylenes, polyamides and polyesters. The polyethylene can have a density of at least about 0.85 g/cc, with one preferred range being about 0.85 to 0.96 g/cc, and an even more preferred range being about 0.86 to 0.92 g/cc.

Mixtures of polymeric bond curve enhancing agents can be preblended and/or additional polymers can be preblended with at least one polymeric bond curve enhancing agent to form a preblend, and the preblend can be mixed with the polypropylene. However, any other order of mixing can be used. The additional polymer can comprise various polymers, such as polyethylene, in amounts up to about 20 weight percent of the polymer blend.

The polymer blend can be prepared by various techniques, such as by tumble mixing.

The skin-core structure can comprise a skin showing an enrichment of ruthenium staining of at least about 0.2 $\mu$m, more preferably at least about 0.5 $\mu$m, more preferably at least about 0.7 $\mu$m, even more preferably at least about 1 $\mu$m, and even more preferably at least about 1.5 $\mu$m.

With fibers having a denier less than 2, another manner of stating the ruthenium enrichment is with respect to the equivalent diameter of the fiber, wherein the equivalent diameter is equal to the diameter of a circle with equivalent cross-section area of the fiber averaged over five samples. More particularly, for fibers having a denier less than 2, the skin thickness can also be stated in terms of enrichment in staining of the equivalent diameter of the fiber. In such an instance, the enrichment in ruthenium staining can comprise at least about 1% and up to about 25% of the equivalent diameter of the fiber, preferably about 2% to 10% of the equivalent diameter of the fiber. Still further, the skin-core structure of the instant invention can be determined using a hot stage test, and a skin-core structure is present when a residue trail is present.

The polymer blend can include various additives, such as stabilizers, antioxidants, pigments, antacids and process aids. Various finishes can be applied to the fibers to maintain or render them hydrophilic or hydrophobic. Also, a component can be included in the polymer blend for modifying the surface properties of the fiber, such as to provide the fiber with repeat wettability.

The process can include feeding the polymer blend comprising the polypropylene and the polymeric bond curve enhancing agent, preferably ethylene vinyl acetate polymer to at least one spinnerette; and the extruding can comprise extruding the polymer blend through the at least one spinnerette.

The present invention is also directed to a process for preparing a fiber having a skin-core structure, comprising extruding a polymer blend comprising polypropylene and a softening polymeric additive as a hot extrudate; and providing conditions so that the hot extrudate forms a fiber having a skin-core structure.

The present invention is also directed to fibers, such as any fibers that are produced using any of the processes of the invention as well as fibers that have the structure and/or compositions that are described herein.

Thus, in one aspect, the present invention is directed to a fiber comprising a polymer blend of polypropylene and polymeric bond curve enhancing agent, preferably ethylene vinyl acetate polymers, with the fiber comprising a skin-core structure, and the polypropylene and the polymeric bond curve enhancing agent being present in both the skin and the core of the skin-core structure.

The fiber can have can various cross-sectional configurations, such as circular, diamond, delta, concave delta, trilobal, oval, or "X"-shaped, and is preferably of circular or concave delta cross-section configuration.

The fiber in accordance with the present invention can be continuous and/or staple fiber of a monocomponent or bicomponent type, and preferably falls within a denier per filament (dpf) range of about 0.5–30, or higher, more preferably is no greater than about 5, and preferably is about 0.5 and 3, more preferably about 1 to 2.5, with preferred dpf being about 1.5, 1.6, 1.7 and 1.9. The fiber can include at least one hollow portion.

In the fiber, the polypropylene can comprise a dominant phase of the skin-core structure, and the polymeric bond curve enhancing agent can comprise fibrils dispersed throughout the skin-core structure, and therefore present in both the skin and the core.

In one aspect of the fiber, the skin-core structure can comprise a surface zone, an inner zone and a gradient therebetween, with the surface zone comprising a high concentration of oxidative chain scission degraded polypropylene as compared to the inner zone, and the gradient comprising a decreasing weight average molecular weight towards the external surface.

In another aspect of the fiber, the skin-core structure can comprise an inner core of the polymer blend, and a surface zone of the polymer blend surrounding the inner core, with the surface zone comprising the polymer blend as oxidative chain scission degraded polypropylene, so that the inner core and the surface zone define a skin-core structure of the polymer blend. Further, the oxidative chain scission degraded polypropylene can be substantially limited to the surface zone, wherein the inner core and the surface zone comprise adjacent discrete portions of the skin-core structure.

The fiber can comprise a skin-core structure including an inner core and a surface zone having a thickness of at least about 0.2 $\mu$m, more. specifically at least about 0.5 $\mu$m, more specifically at least about 0.7 $\mu$m, even more specifically at least about 1 $\mu$m, and even more specifically at least about 1.5 $\mu$m surrounding the inner core, with the inner core comprising the polymer blend and the surface zone comprising the polymer blend as oxidative chain scission degraded polymeric material. Further, the oxidative chain scission degraded polymeric material can be substantially limited to the surface zone, wherein the inner core and the surface zone can comprise adjacent discrete portions of the skin-core structure. Alternatively, there can be a gradient of oxidative chain scission degraded polymeric material between the inner core and the surface zone.

Still further, as discussed above, for fibers having a denier less than 2, another manner of stating the ruthenium enrichment is with respect to the equivalent diameter of the fiber. More particularly, for fibers having a denier less than 2, the skin thickness can also be stated in terms of enrichment in staining of the equivalent diameter of the fiber. In such an instance, the enrichment in ruthenium staining can comprise at least about 1% and up to about 25% of the equivalent diameter of the fiber, preferably about 2% to 10% of the equivalent diameter of the fiber.

In another aspect of the fiber according to the present invention, the skin-core structure can comprise an inner core of the polymer blend, and a surface zone surrounding the inner core, with the surface zone comprising the polymer blend as oxidative chain scission degraded polymeric material, so that the inner core and the surface zone define a skin-core structure, and the inner core can have a melt flow rate substantially equal to an average melt flow rate of the fiber.

In still another aspect of the fiber according to the present invention, the skin-core structure can comprise an inner core of polymer blend having a melt flow rate, and the fiber can have an average melt flow rate about 20 to 300% higher than the melt flow rate of the inner core.

The fiber according to the present invention is also preferably characterized by various parameters utilizing terminology that will be defined in the detailed description, and is briefly indicated in this section.

Thus, in another aspect of the present invention, the fiber preferably has a $\%\Delta A_1$ which is greater than that of a nonwoven material produced under same conditions from fibers produced under same conditions except for absence of the polymeric bond curve enhancing agent. Preferably, the $\%\Delta A_1$ is increased by a member selected from the group consisting of at least about 3%, at least about 15%, at least about 20%, at least about 30%, at least about 40%, at least about 50% and at least about 60%.

Still more preferably, the fiber has a $\%\Delta A_1$ and a $\%\Delta A_m$ which is greater than that of a nonwoven material produced under same conditions from fibers produced under same conditions except for absence of the polymeric bond curve enhancing agent. Even still more preferably, the fiber has a $\%\Delta A_1$, a $\%\Delta A_m$ and a $\%\Delta A_p$ which is greater than that of a nonwoven material produced under same conditions from fibers produced under same conditions except for absence of the polymeric bond curve enhancing agent.

The polymeric bond curve enhancing agent can comprise a plurality of polymeric bond curve enhancing agents. For example, the plurality of bond curve enhancing agents can comprising at least one ethylene vinyl acetate polymer and at least one polyamide, or at least one ethylene vinyl acetate polymer and at least one polyethylene.

The present invention is also directed to skin-core fiber containing polypropylene and polymeric bond curve enhancing agent which when processed into a nonwoven material by thermal bonding obtains for the nonwoven material at least one of a $C_m$ of at least about 60%, more preferably at least about 75%, and even more preferably at least about 90%; a $C_p$ of at least about 75%, and preferably at least about 90%; a $C_1$ of at least about 50%, more preferably at least about 70%, and even more preferably at least about 90%; a $R_1$ of at least about 55%, preferably at least about 70%, more preferably at least about 80%, still more preferably at least about 85%, still more preferably at least about 90%, and even more preferably at least about 95%; and a $R_m$ of at least about 90%.

The present invention is also directed to a skin-core fiber containing polypropylene and polymeric bond curve enhancing agent which when processed as a fiber into a nonwoven material by thermal bonding obtains for the nonwoven material at least one of an $A_m$ of at least about 3000, preferably at least about 5000, even more preferably at least about 6000 and even more preferably at least about 7000; an $A_p$ of at least about 2500, preferably at least about 3500, even more preferably at least about 6000, and even more preferably at least about 6500; and an $A_1$ of at least about 2500, preferably about 6000, even more preferably at least about 7500, even more preferably at least about 9000, and even more preferably at least about 10000.

The invention is also directed to a skin-core fiber comprising polypropylene and a polymeric bond curve enhancing agent, preferably ethylene vinyl acetate polymers, the polypropylene and the polymeric bond curve enhancing agent being formed into the skin-core fiber under fiber processing conditions, and the skin-core fiber when processed into a thermally bonded nonwoven material under nonwoven processing conditions obtains, with respect to a nonwoven material produced under the same nonwoven processing conditions from fiber produced under the same fiber processing conditions but not containing the polymeric bond curve enhancing agent, at least one of a $\Delta C_m$ of at least about 3%, preferably at least about 10%, more preferably at least about 20%, still more preferably at least about 30%, still more preferably at least about 40%, still more preferably at least about 50%, and even more preferably at least about 60%; a $\Delta C_1$ of at least about 3%, preferably at least about 10%, more preferably at least about 20%, still more preferably at least about 30%, still more preferably at least about 40%, still more preferably at least about 50%, and even more preferably at least about 60%; a $\%\Delta_m$ of at least about 3%, preferably at least about 10%, more preferably at least about 20%, still more preferably at least about 30%, and even more preferably at least about 40%; a $\%\Delta A_1$ as discussed above; a $\Delta R_m$ of at least about 3%, preferably at least about 10%, more preferably at least about 20%, still more preferably at least about 25%, and even more preferably at least about 30%; and a $\Delta R_1$ of at least about 3%, preferably at least about 10%, more preferably at least about 20%, still more preferably at least about 30%, still more preferably at least about 35%, and even more preferably at least about 40%.

The present invention is also directed to nonwoven materials comprising fibers as described herein which are bonded together, preferably thermally bonded together; and to hygienic products including these nonwoven materials and at least one absorbent layer. One such hygienic article is a diaper comprising an outer layer, an inner nonwoven material, and an intermediate absorbent layer. The nonwoven material of the invention can be used as the outer layer, which can be an outer impermeable layer but can also be permeable, and/or the inner nonwoven material. Also, the present invention is directed to fibers produced by the processes described herein.

The nonwoven material preferably has a basis weight of less than about 20 g/yd$^2$ (gsy), more preferably less than about 18 g/yd$^2$, more preferably less than about 17 g/yd$^2$, even more preferably less than about 15 g/yd$^2$, more preferably less than about 14 g/yd$^2$, and even as low as 10 g/yd$^2$, with a preferred range being about 14 to 20 g/yd$^2$.

The fibers of the present invention provide superior bond strength compared with conventional polypropylene fiber. The nonwoven materials of the invention exhibit superior cross-directional tensile properties, elongation and toughness. Further, nonwoven materials produced with the fibers of the present invention have uniformity, loftiness, opacity and softness. Most-notably, the fibers produce nonwoven material having (a) a flattened bonding curve, (b) raising of the bonding curve, i.e., increase in cross-directional strength and/or (c) shifting to the left of the bonding curve, i.e., to lower temperatures, of cross-directional strength vs. bonding temperature of a nonwoven material, so that the strength properties of the nonwoven material, especially the cross-directional strength, are maintained or increased with a skin-core fiber.

BRIEF DESCRIPTION OF THE DRAWINGS

The invention will be better understood and characteristics thereof are illustrated in the annexed drawings showing non-limiting embodiments of the invention, in which.

DETAILED DESCRIPTION OF THE PREFERRED EMBODIMENTS

The present invention is directed to various forms of fibers, including filaments and staple fibers. These terms are used in their ordinary commercial meanings. Typically, herein, filament is used to refer to the continuous fiber on the spinning machine; however, as a matter of convenience, the terms fiber and filament are also used interchangeably herein. "Staple fiber" is used to refer to cut fibers or filaments. Preferably, for instance, staple fibers for nonwoven fabrics useful in diapers have lengths of about 1 to 3 inches (about 2.5 to 7.6 cm), more preferably about 1.25 to 2 inches (3.1 to 5 cm).

Figure 8:
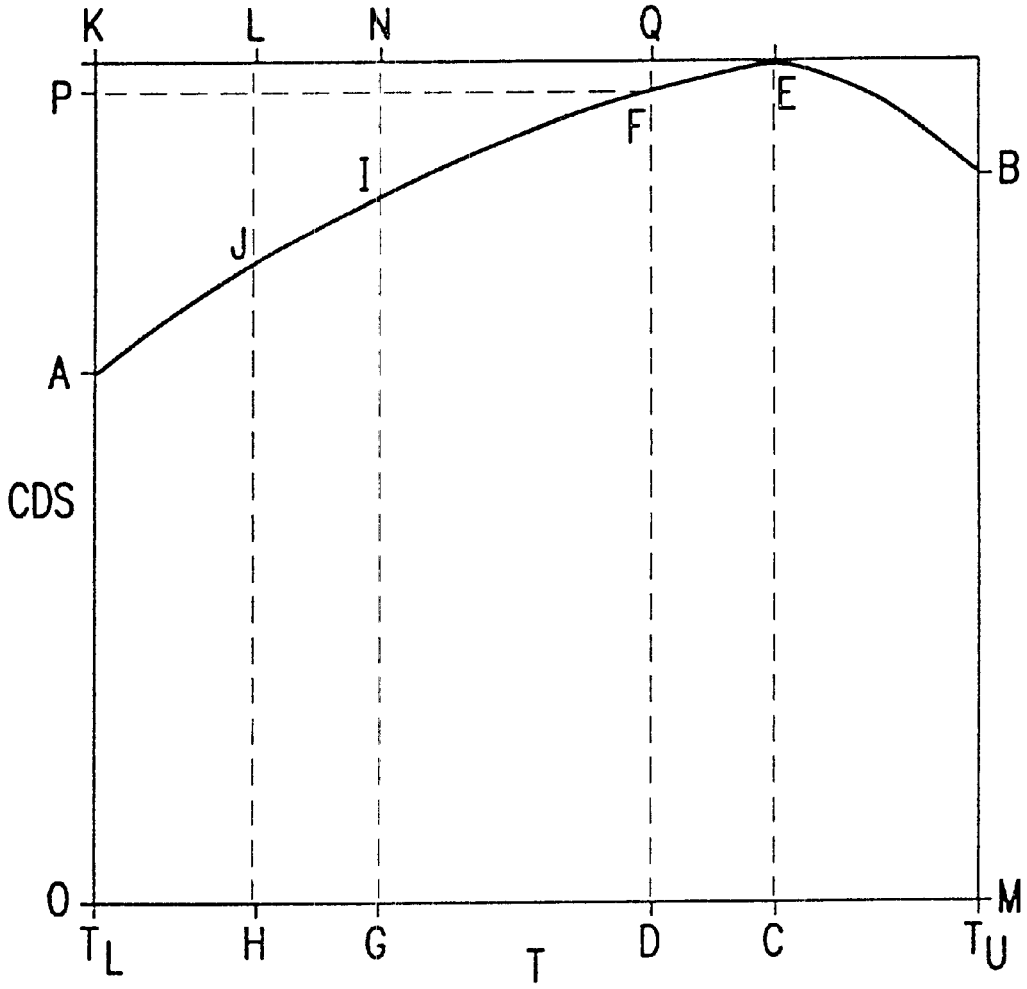
FIG. 8 schematically illustrates a curve of cross-directional strength (CDS) of nonwoven material vs. bonding temperature.

All references to bond or bonding curves, and bonding curves of cross-directional strength vs. temperature are to a curve plotted with temperature on the X-axis and cross-directional strength on the Y-axis, with temperatures increasing from left to right along the X-axis and cross-directional strength increasing upwardly along the Y-axis, such as illustrated in FIG. 8.

It is noted that when the terminology cross-directional strength is utilized herein, it refers to the cross-directional strength of the nonwoven material.

The polymer blends of the instant invention can be spun into fibers by various processes including long spin and short spin processes, or spunbonding. The preferred fibers are staple fibers, and are produced using spin equipment which permits controlled quenching.

More specifically, with regard to known processes for making staple fiber, these processes include the older two-step "long spin" process and the newer one-step "short spin" process. The long spin process involves first melt-extruding fibers at typical spinning speeds of 500 to 3000 meters per minute, and more usually depending on the polymer to be spun from 500 to 1500 meters per minute. Additionally, in a second step usually run at 100 to 250 meters per minute, these fibers are drawn, crimped, and cut into staple fiber. The one-step short spin process involves conversion from polymer to staple fibers in a single step where typical spinning speeds are in the range of 50 to 200 meters per minute or higher. The productivity of the one-step process is increased with the use of about 5 to 20 times the number of capillaries in the spinnerette compared to that typically used in the long spin process. For example, spinnerettes for a typical commercial "long spin" process would include approximately 50–4,000, preferably approximately 3,000–3,500 capillaries, and spinnerettes for a typical commercial "short spin" process would include approximately 500 to 100,000 capillaries preferably, about 30,000–70,000 capillaries. Typical temperatures for extrusion of the spin melt in these processes are about 250–325° C. Moreover, for processes wherein bicomponent fibers are being produced, the numbers of capillaries refers to the number of filaments being extruded, and usually not the number of capillaries in the spinnerette.

The short spin process for manufacture of polypropylene fiber is significantly different from the conventional long spin process in terms of the quenching conditions needed for spin continuity. In the short spin process, with high hole density spinnerettes spinning around 100 meters/minute, quench air velocity is required in the range of about 3,000–8,000 ft/minute to complete fiber quenching within one inch below the spinnerette face. To the contrary, in the long spin process, with spinning speeds of about 1000–1500 meters/minute or higher, a lower quench air velocity in the range of about 50 to 500 ft./minute, preferably about 300 to 500 ft./minute, is used.

Still further, fibers can be spun by other processes, including those processes wherein the fibers produced from the polymer are directly made into a nonwoven material, such as being spunbond.

In a spunbond process, the polymer is melted and mixed in an extruder, and the melted polymer is forced by a spin pump through spinnerettes that have a large number of holes. Air ducts located below the spinnerettes continuously cool the filaments with conditioned air. Draw down occurs as the filaments are sucked over the working width of the filaments through a high-velocity low-pressure zone to a distributing chamber where the filaments are entangled. The entangled filaments are randomly laid down on a moving sieve belt which carries the unbonded web through a thermal calender for bonding. The bonded web is then wound into a roll.

The polymer materials that can be used in the present invention include any blend of polypropylene and polymeric bond curve enhancing agent, such as ethylene vinyl acetate polymer, that can be extruded under suitable conditions to form a fiber having a skin-core structure, such as by long spin, short spin, or spunbond processes. Further, it is noted that the composition, i.e., the polymer blend, that is to be extruded, such as through a spinnerette, to produce filaments is generally referred to as either the polymer blend or the extrudable composition. Further, while fiber, filament and staple fiber, as discussed above, have different meanings, as a matter of convenience, these various terms are also collectively referred to as fiber throughout this disclosure.

When referring to polymers, the terminology copolymer is understood to include polymers of two monomers, or two or more monomers, including terpolymers.

The polypropylene can comprise any polypropylene that is spinnable. The polypropylene can be atactic, heterotactic, syndiotactic, isotactic and stereoblock polypropylene—including partially and fully isotactic, or at least substantially fully isotactic—polypropylenes. The polypropylenes can be produced by any process. For example, the polypropylene can be prepared using Zeigler-Natta catalyst systems, or using homogeneous or heterogeneous metallocene catalyst systems.

Further, as used herein, the terms polymers, polyolefins, polypropylene, polyethylene, etc., include homopolymers, various polymers, such as copolymers and terpolymers, and mixtures (including blends and alloys produced by mixing separate batches or forming a blend in situ). For example, the polymer can comprise copolymers of olefins, such as propylene, and these copolymers can contain various components. Preferably, in the case of polypropylene, such copolymers can include up to about 20 weight %, and, even more preferably, from about 0 to 10 weight % of at least one of ethylene and butene. However, varying amounts of these components can be contained in the copolymer depending upon the desired fiber.

Further, the polypropylene can comprise dry polymer pellet, flake or grain polymers having a narrow molecular weight distribution or a broad molecular weight distribution, with a broad molecular weight distribution being preferred. The term "broad molecular weight distribution" is here defined as dry polymer pellet, flake or grain preferably having an MWD value (i.e., Wt.Av.Mol.Wt./No.Av.Mol.Wt. measured by SEC as discussed herein) of at least about 5.0, preferably at least about 5.5, more preferably at least about 6.

Still further, the polypropylene can be linear or branched, such as disclosed by U.S. Pat. No. 4,626,467 to Hostetter, which is incorporated by reference herein in its entirety, and is preferably linear. Additionally, in making the fiber of the present invention, the polypropylene to be made into fibers can include polypropylene compositions as taught in Gupta et al. application Ser. No. 08/003,696, filed Jan. 13, 1993, now U.S. Pat. No. 5,629,080, Ser. No. 07/943,190, filed Sep. 11, 1992 and Ser. No. 07/818,772, filed Jan. 13, 1992, and European Patent Application No. 0 552 013 to Gupta and divisional application Ser. Nos. 08/466,617 and 08/466,619, which issued as U.S. Pat. Nos. 5,654,088 and 5,733,646, respectively, et al., which are incorporated by reference herein in their entirety. Still further, polymer blends such as disclosed in Kozulla, U.S. patent application Ser. No. 08/358,884, filed Dec. 19, 1994, its continuation application Ser. No. 08/998,592 and European Patent Application No. 0 719 879, which are incorporated by reference in their entirety, can also be utilized.

The melt flow rate (MFR) of the polypropylene polymer as described herein is determined according to ASTM D-1238-86 (condition L;230/2.16), which is incorporated by reference herein in its entirety.

The polymeric bond curve enhancing agent that can be used in the present invention can comprise any polymeric additive, or mixture of polymeric additives, i.e., which is additional to the polypropylene, that provides (a) a flattening of the bond curve, (b) raising of the bond curve, i.e., increase in cross-directional strength and/or (c) shifting to the left of the bond curve, i.e., to lower temperatures, of cross-directional strength vs. bonding temperature of a nonwoven material, so that the strength properties of the nonwoven material, especially the cross-directional strength, are maintained or increased with a skin-core fiber. Preferably, the comparison of the flattening, raising and/or shifting of the bond curve is relative to the bond curve for nonwoven material produced under the same conditions from fibers produced under the same conditions except for the absence of the polymeric bond curve enhancing agent.

The raising of the cross-directional strength includes herein the raising of at least some points of the cross-directional strength of the bond curve, and preferably includes either raising of the peak cross-directional strength of the bond curve or raising of strength points at temperatures lower than the temperature at which the peak cross-directional strength occurs.

To obtain the maintaining or increasing of the cross-directional strength, the bond curve preferably has an increased area over a defined temperature range with respect to the differential scanning calorimetry melting point as will be discussed later herein. This increased area can be obtained in a number of manners. For example, (a) the cross-directional strength, such as the peak cross-directional strength, can be the same, substantially the same or lower and the bond curve can be flattened to achieve an increased area, (b) the cross-directional strength, such as the peak cross-directional strength or cross-directional strength at points at temperatures lower than the peak cross-directional strength, can be increased and the bond curve can be flattened to achieve an increased area, (c) the bond curve can have the same or substantially the same shape, and have higher cross-directional strength points, such as the peak cross-directional strength, along the curve, or (d) the bond curve can be shifted to lower temperatures with the area of the bond curve in the predetermined temperature range being maintained or increased, such as by a flattening of the bond curve. Preferably, the bond curve is flattened and raised, or flattened and shifted, or raised and shifted, and most preferably, the bond curve is flattened, raised and shifted.

Thus, in one aspect of the invention, it is noted that the polymeric bond curve enhancing agent can provide a flattening of the bonding curve, preferably with the maximum cross-directional strength being raised, and preferably with the area under the curve being increased as compared to the area under the bonding curve for nonwoven material produced under the same conditions from fibers also produced under the same conditions except for the absence of the polymeric bond curve enhancing agent. It is also noted that the polymeric bond curve enhancing agent can provide a raising of the maximum cross-directional strength as compared to processing of the fiber and nonwoven material under the same conditions except for the absence of the polymeric bond curve enhancing agent. Also, the polymeric bond curve enhancing agent can provide a shifting of the bond curve maximum cross-directional strength to the left as compared to processing of the fiber and nonwoven material under the same conditions except for the absence of the polymeric bond curve enhancing agent, so that the bond curve achieves higher cross-directional strength at lower bond temperatures. Preferably, the bond curve is flattened and has an increased area, so that bonding can be achieved over a wide temperature range to provide a broadening of the bonding window.

While the comparisons, above are preferably being made with respect to skin-core fibers, which have high strength properties, it is noted that the polymeric bond curve enhancing agents also provide flatter bond curves, raising of the bond curve and/or shifting of the bond curve with respect to equivalently processed nonwovens that are made from fibers that do not have a skin-core structure (or from bicomponents that do not have a sheath with a skin-core structure) produced from the same or substantially the same polymer blend, preferably the same polymer blend.

The polymeric bond curve enhancing agents preferably have (a) a differential scanning calorimetry melting point (DSC melting point) below about 230° C., preferably below about 200° C., and even more preferably below that of polypropylene, i.e., the polypropylene that is included in the polymer blend, and most preferably about 15 to 100° C. below that of the polypropylene that is included in the polymer blend, (b) and at least one of an elastic modulus (measured at 200° C. and 100 radians/second) less than polypropylene that is included in the polymer blend (e.g., about 5 to 100% below) and a complex viscosity (measured at 200° C. and 100 radians/second) less than polypropylene that is included in the polymer blend (e.g., about 10 to 80% below). Even more preferably, both the elastic modulus and the complex viscosity of the polymeric bond curve enhancing agent are less than that of the polypropylene that is included in the polymer blend. Thus, preferred polymeric bond curve enhancing agents will include materials that have the above-noted DSC melting points and the above-noted elastic modulus and/or complex viscosity, such as the polymeric materials listed in Table 15. However, materials that do not include such DSC melting points and elastic modulus and/or complex viscosity, such as KRATON®G1750, are also utilizable in the present invention as polymeric bond curve enhancing agents in that they provide (a) a flattening of the bond curve, (b) raising of the bond curve and/or (c) shifting to the left of the bond curve of a nonwoven material produced with a skin-core fiber.

While specific examples of preferred concentrations of certain polymeric bond curve enhancing agents are included in this description, including the examples, it is emphasized that one possessing ordinary skill in this art following the instant disclosure would be able to ascertain concentrations of various polymeric bond curve enhancing agents useable in the polymer blend that would enable the spinning of filaments to obtain skin-core fibers while achieving a flattening, raising and/or shifting of the bonding curve.

Examples of polymers that are includable as polymeric bond curve enhancing agents according to the present invention are alkene vinyl carboxylate polymers, such as alkene vinyl acetate copolymers, such as ethylene vinyl acetate polymers which will be more fully described below; polyethylenes including copolymers, e.g., those prepared by copolymerizing ethylene with at least one $C_3$–$C_{12}$ alpha-olefin, with examples of polyethylenes being ASPUN™6835A, INSITE™XU58200.02, INSITE™XU58200.03 (now apparently 8803) and INSITE™XU58200.04 available from Dow Chemical Company, Midland, Mich.; alkene acrylic acids or esters, such as ethylene methacrylic acids including NUCREL®925 available from Dupont, Wilmington, Del.; alkene co-acrylates, such as ethylene N-butyl acrylate glycidyl methacrylate (ENBAGMA) such as ELVALOY®AM available from Dupont, Wilmington, Del., and alkene co-acrylate co-carbon monoxide polymers, such as ethylene N-butyl acrylate carbon oxides (ENBACO) such as ELVALOY®HP661, and ELVALOY®HP662 available from Dupont, Wilmington, Del.; and acid modified alkene acrylates, such as acid modified ethylene acrylates including ethylene isobutyl acrylate-methyl acrylic acid (IBA-MAA) such as BYNEL® 2002 available from Dupont, Wilmington, Del., and ethylene N-butyl acrylic methylacrylic acid such as BYNEL® 2022 available from Dupont, Wilmington, Del.; alkene acrylate acrylic acid polymers, such as ethylene acrylate methacrylic acid terpolymers, such as SURLYN® RX9-1 available from Dupont, Wilmington, Del.; and polyamides, such as nylon 6 available from North Sea Oil, Greenwood, S.C. Preferably, the polymeric bond curve enhancing agents are ethylene vinyl acetate polymers, such as ethylene vinyl acetate copolymers and terpolymers, or mixtures of polymeric bond curve enhancing agents, with the preferred polymeric bond curve enhancing agent in the mixture being ethylene vinyl acetate polymers.

The above noted polymeric bond curve enhancing agents preferably have molecular weights of about $10^3$ to $10^7$, more preferably about $10^4$ to $10^6$. Still further, the number of alkene carbon atoms in the polymeric bond curve enhancing agents preferably ranges from about $C_2$–$C_{12}$, more preferably about $C_2$–$C_6$, with a preferred number of alkene carbon atoms being $C_2$.

As noted above, the polymeric bond curve enhancing agents also provide nonwoven materials of high softness.

Preferred polymeric bond curve enhancing agents for providing nonwoven materials of particularly high softness include ELVAX®3124, KRATON®G1750, ELVALOY®AM, combinations of ethylene vinyl acetate polymers with at least one of INSITE™XU58200.02 and INSITE™XU58200.03, BYNEL® 2002, and NUCREL®925.

The polypropylene is the predominant material in the polymer blend, and is present in the polymer blend up to about 95.5% by weight, and can be present from about 99.5 to 80% by weight, more preferably about 99.5 to 90% by weight, even more preferably about 99.5 to 93% by weight, even more preferably 99 to 95% by weight, and most preferably about 97 to 95.5% by weight.

The polymeric bond curve enhancing agent or mixture of polymeric bond curve enhancing agents can be present in the polymer blend up to about 20% by weight of the polymer blend, more preferably less than about 10% by weight of the polymer blend, with a preferred range being about 0.5 to 7% by weight, a more preferred ranged being about 1 to 5% by weight, and a most preferred ranged being from about 1.5 to 4% by weight, with a more preferred value being about 3% by weight.

For example, with respect to ethylene vinyl acetate polymers, the ethylene vinyl acetate polymer that can be used in the polymer blend is readily commercially available, and includes various forms of ethylene vinyl acetate polymer, including ethylene vinyl acetate copolymer and terpolymer. The ethylene vinyl acetate polymer is preferably present in the polymer blend to about 10% by weight of the polymer blend, more preferably less than 10% by weight of the polymer blend, with a preferred range being about 0.5 to 7% by weight, a more preferred range being about 1 to 5% by weight, and a most preferred range being from about 1.5 to 4% by weight, with a more preferred value being about 3% by weight.

In the case of ethylene vinyl acetate polymers, the percentage of vinyl acetate in the ethylene vinyl acetate polymers can vary within any concentration which permits the polymer blend to form a skin-core fiber. For most purposes, a useful percentage of vinyl acetate units in the ethylene vinyl acetate polymer would be about 0.5 to 50% by weight, more preferably about 5 to 50% by weight, even more preferably about 5 to 40% by weight, even more preferably about 5 to 30% by weight, and most preferably about 9 to 28% by weight.

It is noted that increasing the concentration of vinyl acetate in the ethylene vinyl acetate polymers enables the obtaining of fibers that are capable of producing nonwoven materials that have a softer feel; whereas, lower concentrations of vinyl acetate in the ethylene vinyl acetate polymers, while still soft, enable increased processability. A preferred percentage of the vinyl acetate units being about 28% by weight where increased softness is desired, and about 9% by weight where increased processability is desired.

In other words, the ethylene can comprise about 50 to 95.5% by weight of the ethylene vinyl acetate polymer, more preferably about 50 to 95% by weight, even more preferably about 60 to 95% by weight, even more preferably 70 to 95% by weight, and most preferably about 72 to 91% by weight, with a preferred value being about 72% by weight. Again, where increased processability is desired higher amounts of ethylene in the ethylene vinyl acetate polymer is preferred, with a preferred amount being about 91% by weight.

Still further, ethylene vinyl acetate polymer can comprise a melt index (MI) in the range of from about 0.1 to 500 grams per ten minutes, when measured in accordance with ASTM D-1238-86 at condition E, which is incorporated by reference herein in its entirety. The manner of determining the melt index, and the relationship to melt flow are disclosed in U.S. Pat. No. 4,803,117 to Daponte, which disclosure is incorporated by reference herein in its entirety.

Exemplary ethylene vinyl acetate polymers that are utilizable in the present invention are those sold under the Trademark ELVAX by Dupont, such as set forth in the ELVAX Resins—Grade Selection Guide by Du Pont Company, October 1989, which is incorporated by reference herein in its entirety. Ethylene/vinyl acetate copolymers include the High Vinyl Acetate Resins; the 200-, 300-, 400-, 500-, 600-, and 700-Series Resins and the corresponding packaging-grade 3100 Series Resins; and terpolymers include the ethylene/vinyl acetate/acid terpolymers indicated as Acid Terpolymers. Preferred, copolymers are ELVAX®150, ELVAX®250, ELVAX®750, ELVAX®3124 and ELVAX®3180 and a preferred acid terpolymer is ELVAX®4260. However, as stated above, the ethylene vinyl acetate polymer can comprise any ethylene vinyl acetate polymer, e.g., copolymer or terpolymer, that can be extruded under conditions to directly form a filament having a skin-core structure, such as by long spin, short spin or spunbond processes.

Additional polymers can be contained in the polymer blend in addition to the polypropylene and the polymeric bond curve enhancing agent or mixture of polymeric bond curve enhancing agents, as long as the polymer blend remains spinnable and the resulting fibers can be formed into nonwoven materials. Polymers can be added to the blend depending upon desired properties of the fibers, such as desired properties in the production of nonwoven materials and in the nonwoven. In fact, the additional polymers may enhance the properties of the polymeric bond curve enhancing agent. For example, the polymer blend can include various polymers, in addition to polypropylene, whether or not the polymers are within the definition of polymeric bond curve enhancing agent, such as, polyamides, polyesters, polyethylenes and polybutenes. Thus, additional polymers can be added to the polymer blend, even though they are not polymeric bond curve enhancing agents.

In other words, and with exemplary reference to the situation wherein mixtures of polyolefins are contemplated in the polymer blend, the polymer blend can comprise 100% polypropylene by weight of the polyolefin added to the polymer blend. However, varying amounts of other polyolefins can be added to the polypropylene. For example, various polyethylenes, even when these polyethylenes are not polymeric bond curve flattening agents, can be included with the polypropylene and polymeric bond curve enhancing agent in the polymer blend in amounts up to about 20% by weight of the polymer blend, more preferably up to about 10% by weight of the polymer blend, still more preferably up to about 5% by weight of the polymer blend, and even more preferably up to about 3% by weight of the polymer blend? with a preferred range being about 0.5 to 1%. Thus, for example, in embodiments of the present invention, various polymers can be added to the polymer blend in addition to polypropylene and polymeric bond curve enhancing agent, such as, polyethylenes that are or are not polymeric bond curve enhancing agents, or mixtures thereof.

Thus, continuing with respect to polyethylenes, any polyethylene can be added to the polymer blend that enables the polymer blend to be spun into a skin-core structure. In particular, the polyethylenes can comprise low density polyethylenes, preferably those having a density in the range of about 0.86–0.935 g/cc; the high density polyethylenes, preferably those having a density in the range of about 0.94–0.98 g/cc; the linear polyethylenes, preferably those having a density in the range of about 0.85–0.96 g/cc, such as linear low density polyethylenes having a density of about 0.85 to 0.93 g/cc, and even more specifically about 0.86 to 0.93 g/cc, and including those prepared by copolymerizing ethylene with at least one $C_3$–$C_{12}$ alpha-olefin, and higher density polyethylene copolymers with $C_3$–$C_{12}$ alpha-olefins having densities of 0.94 g/cc or higher.

Thus, the polymer blend can comprise only two polymers, such as polypropylene and a single polymeric bond curve enhancing agent. Alternatively, the polymer blend can include three or more polymers, such as (a) polypropylene and a mixture of polymeric bond curve enhancing agents, or (b) polypropylene and one or more polymeric bond curve enhancing agents and an additional polymer which is not a polymeric bond curve enhancing agent.

Still further, the polymer blend can include various additives that are added to fibers, such as antioxidants, stabilizers, pigments, antacids and process aids.

The polymer blend of the instant invention can be made using any manner of mixing the at least two polymers. For example, the polymer blend can be obtained by tumble mixing the solid polymers, and then melting the mixture for extrusion into filaments.

Moreover, components of the polymer blend can be preblended prior to ultimate mixing to form the polymer blend. For example, when at least one additional polymeric bond curve enhancing agent and/or additional polymer, such as polyethylene, is to be added to the polymer blend containing polypropylene and the preferred polymeric bond curved flattening agent ethylene vinyl acetate copolymer, the at least one additional polymer can be preblended with the ethylene vinyl acetate copolymer.

Thus, for example, a preblend of ethylene vinyl acetate copolymer and polyethylene can be prepared by mixing, as solid polymers, one part by weight of ethylene vinyl acetate copolymer with two parts by weight of polyethylene. This mixture can then be melt extruded at a temperature such as 180° C., passed through a water bath, and cut into pellets. The pellets can then be mixed, such as by tumble mixing, with polypropylene to form the polymer blend.

By practicing the process of the present invention, and by spinning polymer compositions using melt spin processes, such as a long spin or short spin process according to the present invention, fibers can be obtained which have excellent thermal bonding characteristics over a greater bonding window in combination with excellent softness, tenacity, tensile strength and toughness. Moreover, the fibers of the present invention are capable of providing nonwoven materials of exceptional cross-directional strength, toughness, elongation, uniformity, loftiness and softness even at lower basis weights than ordinarily practiced and using a variety of spinning processes.

For example, the fibers of the present invention can be processed on high speed machines for the making of various materials, in particular, nonwoven fabrics that can have diverse uses, including cover sheets, acquisition layers and back sheets in diapers. The fibers of the present invention enable the production of nonwoven materials at speeds as high as about 500 ft/min, more preferably as high as about 700 to 800 ft/min, and even as more preferably as high as about 980 ft/min (about 300 meters/min), at basis weights as low as about 17 g/yd$^2$ (gsy), as low as about 15 gsy, as low as about 14 gsy, and even as low as about 10 gsy, or lower and having cross-directional strengths on the order of at least about 200 to 400 g/in., more preferably 300 to 400 g/in, preferably greater than about 400 g/in, and more preferably as high as about 650 g/in, or higher. Further, the fabrics can have an elongation of about 50–200%, and a toughness of about 200 to 700 g/in, preferably about 480–700 g/in for nonwoven fabrics at a basis weight of about 20 g/yd$^2$, more preferably less than about 20 g/yd$^2$, even more preferably less than about 17 to 18 g/yd$^2$, even more preferably less than about 15 g/yd$^2$, and even more preferably less than about 14 g/yd$^2$ and most preferably as low as 10 g/yd$^2$, or lower.

A number of procedures are used to analyze and define the composition and fiber of the present invention, and various terms are used in defining characteristics of the composition and fiber. These will be described below.

As is disclosed in the above-noted U.S. and European applications to Takeuchi. et al., which are incorporated by reference herein in their entirety, the substantially non-uniform morphological structure of the skin-core fibers according to the present invention can be characterized by transmission electron-microscopy (TEM) of ruthenium tetroxide ($RuO_4$)-stained fiber thin sections. In this regard, as taught by Trent et al., in *Macromolecules,* Vol. 16, No. 4, 1983, "Ruthenium Tetroxide Staining of Polymers for Electron Microscopy", which is hereby incorporated by reference in its entirety, it is well known that the structure of polymeric materials is dependent on their heat treatment, composition, and processing, and that, in turn, mechanical properties of these materials such as toughness, impact strength, resilience, fatigue, and fracture strength can be highly sensitive to morphology. Further, this article teaches that transmission electron microscopy is an established technique for the characterization of the structure of heterogeneous polymer systems at a high level of resolution; however, it is often necessary to enhance image contrast for polymers by use of a staining agent. Useful staining agents for polymers are taught to include osmium tetroxide and ruthenium tetroxide. For the staining of the fibers of the present invention, ruthenium tetroxide is the preferred staining agent.

In the morphological characterization of the present invention, samples of fibers are stained with aqueous $RuO_4$, such as a 0.5% (by weight) aqueous solution of ruthenium tetroxide obtainable from Polysciences, Inc., overnight at room temperature. (While a liquid stain is utilized in this procedure, staining of the samples with a gaseous stain is also possible.) Stained fibers are embedded in Spurr epoxy resin and cured overnight at 60° C. The embedded stained fibers are then thin sectioned on an ultramicrotome using a diamond knife at room temperature to obtain microtomed sections approximately 80 nm thick, which can be examined on conventional apparatus, such as a Zeiss EM-10 TEM, at 100 kV. Energy dispersive x-ray analysis (EDX) was utilized to confirm that the $RuO_4$ had penetrated completely to the center of the fiber.

Skin-core fibers according to the present invention show an enrichment of the ruthenium (Ru residue) at the outer surface region of the fiber cross-section to a depth of at least about 0.2 $\mu$m, preferably to a depth of at least about 0.5 $\mu$m, more preferably to a depth of at least about 0.7 $\mu$m, more preferably to a depth of at least about 1 $\mu$m, with the cores of the fibers showing a much lower ruthenium content. Still further, the enrichment of ruthenium (Ru residue) at the outer surface region of the fiber cross-section can be greater than about 1.5 $\mu$m thick.

Also, as previously noted, with fibers having a denier less than 2, another manner of stating the ruthenium enrichment is with respect to the equivalent diameter of the fiber, wherein the equivalent diameter is equal to the diameter of a circle with equivalent cross-section area of the fiber averaged over five samples. More particularly, for fibers having a denier less than 2, the skin thickness can also be stated in terms of enrichment in staining of the equivalent diameter of the fiber. In such an instance, the enrichment in ruthenium staining can comprise at least about 1% and up to about 25% of the equivalent diameter of the fiber, preferably about 2% to 10% of the equivalent diameter of the fiber.

Another test procedure to illustrate the skin-core structure of the fibers of the present invention, and especially useful in evaluating the ability of a fiber to thermally bond, consists of the microfusion analysis of residue using a hot stage test. This procedure is used to examine for the presence of a residue following axial shrinkage of a fiber during heating, with the presence of a higher amount of residue directly correlating with the ability of a fiber to provide good thermal bonding. In this hot stage procedure, a suitable hot stage, such as a Mettler FP82 HT low mass hot stage controlled via a Mettler FP90 control processor, is set to 145° C. A drop of silicone oil is placed on a clean microscope slide. Approximately 10 to 100 fibers are cut into ½ mm lengths from three random areas of filamentary sample, and stirred into the silicone oil with a probe. The randomly dispersed sample is covered with a cover glass and placed on the hot stage, so that both ends of the cut fibers will, for the most part, be in the field of view. The temperature of the hot stage is then raised at a rate of 3° C./minute. At some temperature, the fibers shrink axially, and the presence or absence of trailing residues is observed. As the shrinkage is completed, the heating is stopped, and the temperature is reduced rapidly to 145° C. The sample is then examined through a suitable microscope, such as a Nikon SK-E trinocular polarizing microscope, and a photograph of a representative area is taken to obtain a still photo reproduction using, for example, a MTI-NC70 video camera equipped with a Pasecon videotube and a Sony Up-850 B/W videographic printer. A rating of "good" is used when the majority of fibers leaves residues. A rating of "poor" is used when only a few percent of the fibers leave residues. Other comparative ratings are also available, and include a rating of "fair" which falls between "good" and "poor", and a rating of "none" which, of course, falls below "poor". A rating of "none" indicates that a skin is not present, whereas ratings of "poor" to "good" indicate that a skin is present.

Size exclusion chromatography (SEC) is used to determine the molecular weight distribution. In particular, high performance size exclusion chromatography is performed at a temperature of 145° C. using a Waters 150-C ALC/GPC high temperature liquid chromatograph with differential refractive index (Waters) detection. To control temperature, the column compartment, detector, and injection system are thermostatted at 145° C., and the pump is thermostatted at 55° C. The mobile phase employed is 1,2,4-trichlorobenzene (TCB) stabilized with butylated hydroxytoluene (BHT) at 4 mg/L, with a flow rate of 0.5 ml/min. The column set includes two Polymer Laboratories (Amherst, Mass.) PL Gel mixed-B bed columns, 10 micron particle size, part no. 1110-6100, and a Polymer Laboratories PL-Gel 500 angstrom column, 10 micron particle size, part no. 1110-6125. To perform the chromatographic analysis, the samples are dissolved in stabilized TCB by heating to 175° C. for two hours followed by two additional hours of dissolution at 145° C. Moreover, the samples are not filtered prior to the analysis. All molecular weight data is based on a polypropylene calibration curve obtained from a universal transform of an experimental polystyrene calibration curve. The universal transform employs empirically optimized Mark-Houwink coefficients of K and $\alpha$ of 0.0175 and 0.67 for polystyrene, and 0.0152 and 0.72 for polypropylene, respectively.

The dynamic shear properties of the polymeric materials of the present invention are determined by subjecting a small polymeric sample to small amplitude oscillatory motion in the manner described by Zeichner and Patel, *Proceedings of Second World Congress of Chemical Engineering, Montreal, Vol.* 6, pp. 333–337 (1981), incorporated herein by reference. Specifically, the sample is held between two parallel plates of 25 millimeters in diameter at a gap of two millimeters. The top plate is attached to a dynamic motor of the Rheometrics System IV rheometer (Piscataway, N.J.) while the bottom plate is attached to a 2000 gm-cm torque transducer. The test temperature is held at 200° C. wherein the sample is in a molten state, and the temperature is maintained steady throughout the test. While keeping the bottom plate stationary, a small amplitude oscillatory motion is imposed on the top plate sweeping the frequency range from 0.1 to 400 radians/second. At each frequency, after the transients have died out, the dynamic stress response is separable into in-phase and out-of-phase components of the shearing strain. The dynamic modulus, G', characterizes the in-phase component while the loss modulus, G", characterizes the out-of-phase component of the dynamic stress. For high molecular weight polyolefins, such as polypropylenes, it is observed that these moduli crossover or coincide at a point (a certain modulus) when measured as a function of frequency. This crossover modulus is characterized as Gc, and the crossover frequency is characterized by Wc.

The polydispersity index (PI) is defined by $10^6$/crossover modulus, and is found to correlate with the molecular weight distribution, Mw/Mn. At a constant polydispersity index, the crossover frequency correlates inversely with the weight average molecular weight, Mw, for polypropylenes.

Elaborating on the above for determining complex viscosity and dynamic modulus, the sample is subjected to small amplitude oscillation of a frequency from 0.1 to 400 radians/second, and after the initial transients have died down, the transducer records an oscillatory stress output having a similar frequency as the strain input but showing a phase lag. This output stress function can be analyzed into an in-phase stress with a coefficient known as the storage (dynamic) modulus, G', and an out-of-phase stress with a coefficient called the loss modulus, G", which are only functions of the frequency.

The storage modulus, G', is the measure of energy stored by the material during a small amplitude cyclic strain deformation, and is also known as the elastic modulus of the sample. The loss modulus, G", is the measure of energy lost after a small amplitude cyclic strain deformation.

The complex viscosity, which is a measure of the dynamic viscosity of the sample is obtainable from both of these modulii. More specifically, the complex viscosity is the geometric average of the elastic modulus, G', and the loss modulus, G", divided by the frequency. In the instant situation the frequency is taken at 100 radians/second. More specifically, the formula for the complex viscosity $\eta$ is as follows:

$$\eta = \frac{\sqrt{(G')^2 + (G'')^2}}{100}$$

The ability of the fibers to hold together by measuring the force required to slide fibers in a direction parallel to their length is a measure of the cohesion of the fibers. The test utilized herein to measure the cohesion of the fibers is ASTM D-4120-90, which is incorporated by reference herein in its entirety. In this test, specific lengths of roving, sliver or top are drafted between two pairs of rollers, with each pair moving at a different peripheral speed. The draft forces are recorded, test specimens are then weighed, and the linear density is calculated. Drafting tenacity, calculated as the draft resisting force per unit linear density, is considered to be a measure of the dynamic fiber cohesion.

More specifically, a sample of thirty (30) pounds of processed staple fiber is fed into a prefeeder where the fiber is opened to enable carding through a Hollingsworth cotton card ((Model CMC (EF38-5)). The fiber moves to an even-feed system through the flats where the actual carding takes place. The fiber then passes through a doffmaster onto an apron moving at about 20 m/min. The fiber is then passed through a trumpet guide, then between two calender rolls. At this point, the carded fiber is converted from a web to a sliver. The sliver is then passed through another trumpet guide into a rotating coiler can. The sliver is made to 85 grains/yard.

From the coiler can, the sliver is fed into a Rothchild Dynamic Sliver Cohesion Tester (Model #R-2020, Rothchild Corp., Zurich, Switzerland). An electronic tensiometer (Model #R-1191, Rothchild Corp.) is used to measure the draft forces. The input speed is 5 m/min, the draft ratio is 1.25, and the sliver is measured over a 2 minute period. The overall force average divided by the average grain weight equals the sliver cohesion. Thus, the sliver cohesion is a measure of the resistance of the sliver to draft.

The term "crimps per inch" (CPI), as used herein , is the number of "kinks" per inch of a given sample of bulked fiber under zero stress. It is determined by mounting thirty 1.5 inch fiber samples to a calibrated glass plate, in a zero stress state, the extremities of the fibers being held to the plate by double coated cellophane tape. The sample plate is then covered with an uncalibrated glass plate and the kinks present in a 0.625 inch length of each fiber are counted. The total number of kinks in each 0.625 inch length is then multiplied by 1.6 to obtain the crimps per inch for each fiber. Then, the average of 30 measurements is taken as CPI.

The skin-core structure of the instant fibers can be produced by any procedure that achieves an oxidation, degradation and/or lowering of molecular weight of the polymer blend at the surface of the fiber as compared to the polymer blend in an inner core of the fiber. Thus, the skin-core structure comprises modification of a blend of polymers to obtain the skin-core structure, and does not comprise separate components being joined along an axially extending interface, such as in sheath-core and side-by-side bicomponent fibers. Of course, the skin-core structure can be utilized in a composite fiber, such as the skin-core structure being present in the sheath of a sheath-core fiber in the manner disclosed in U.S. Pat. Nos. 5,281,378, 5,318,735 and 5,431,994.

Thus, for example, the skin-core fibers of the present invention can be prepared by providing conditions in any manner so that during extrusion of the polymer blend a skin-core structure is formed. For example, the temperature of a hot extrudate, such as an extrudate exiting a spinnerette, can be provided that is sufficiently elevated and for a sufficient amount of time within an oxidative atmosphere in order to obtain the skin-core structure. This elevated temperature can be achieved using a number of techniques, such as disclosed in the above discussed patents to Kozulla, and U.S. and foreign applications to Takeuchi et al.

More specifically, and as an example of the present invention, the temperature of the hot extrudate can be provided above at least about 250° C. in an oxidative atmosphere for a period of time sufficient to obtain the oxidative chain scission degradation of its surface. This providing of the temperature can be obtained by delaying cooling of the hot extrudate as it exits the spinnerette, such as by blocking the flow of a quench gas reaching the hot extrudate. Such blocking can be achieved by the use of a shroud or a recessed spinnerette that is constructed and arranged to provide the maintaining of temperature.

In another aspect, the skin-core structure can be obtained by heating the polymer blend in the vicinity of the spinnerette, either by directly heating the spinnerette or an area adjacent to the spinnerette. In other words, the polymer blend can be heated at a location at or adjacent to the at least one spinnerette, by directly heating the spinnerette or an element such as a heated plate positioned approximately 1 to 4 mm above the spinnerette, so as to heat the polymer composition to a sufficient temperature to obtain a skin-core fiber structure upon cooling, such as being immediately quenched, in an oxidative atmosphere.

For example, for a typical short spin process for the extrusion of the polymer blend, the extrusion temperature of the polymer is about 230° C. to 250° C., and the spinnerette has a temperature at its lower surface of about 200° C. This temperature of about 200° C. does not permit oxidative chain scission degradation at the exit of the spinnerette. In this regard, a temperature of most preferably at least about 250° C. is desired across the exit of the spinnerette in order to obtain oxidative chain scission degradation of the molten filaments to thereby obtain filaments having a skin-core structure. Accordingly, even though the polymer blend is heated to a sufficient temperature for melt spinning in known melt spin systems, such as in the extruder or at another location prior to being extruded through the spinnerette, the polymer blend cannot maintain a high enough temperature in a short spin process upon extrusion from the spinnerette, under oxidative quench conditions, without the heating supplied at or at a location adjacent to the spinnerette.

While the above techniques for forming the skin-core structure have been described, the present invention is not limited to skin-core structure obtained by the above-described techniques, but any technique that provides a skin-core structure to the fiber is included in the scope of this invention. Thus, any fiber that includes a surface zone of lower molecular weight polymer, higher melt flow rate polymer, oxidized polymers and/or degraded polymer would be a skin-core fiber according to the present invention.

In order to determine whether a skin-core fiber is present, the above-referred to ruthenium staining test is utilized. According to the present invention, and in its preferred embodiment, the ruthenium staining test would be performed to determine whether a skin-core structure is present in a fiber. More specifically, a fiber can be subjected to ruthenium staining, and the enrichment of ruthenium (Ru residue) at the outer surface region of the fiber cross-section would be determined. If the fiber shows an enrichment in the ruthenium staining for a thickness of at least about 0.2 μm or at least about 1% of the equivalent diameter for fibers having a denier of less than 2, the fiber has a skin-core structure.

While the ruthenium staining test is an excellent test for determining skin-core structure, there may be certain instances wherein enrichment in ruthenium staining may not occur. For example, there may be certain components within the fiber that would interfere with or prevent the ruthenium from showing an enrichment at the skin of the fiber, when, in fact, the fiber comprises a skin-core structure. The description of the ruthenium staining test herein is in the absence of any materials and/or components that would prevent, interfere with, or reduce the staining, whether these materials are in the fiber as a normal component of the fiber, such as being included therein as a component of the processed fiber, or whether these materials are in the fiber to prevent, interfere with or reduce ruthenium staining.

Skin-core fibers according to the present invention can have, but do not necessarily have, an average melt flow rate which is about 20 to 300% higher than the melt flow rate of the non-degraded inner core of the fiber. For example, to determine the melt flow rate of the non-degraded inner core of the fiber, the polymer blend can be extruded into an inert environment (such as an inert atmosphere) and/or be rapidly quenched, so as to obtain a non-degraded or substantially non-degraded fiber. The average melt flow rate of this fiber not having a skin-core structure could then be determined. The percent increase in melt flow rate of the skin-core fiber can then be determined by subtracting the average melt flow rate of the non-degraded fiber (representing the melt flow rate of the core) from the average melt flow rate of the skin-core fiber, dividing this difference by the average melt flow rate of the non-degraded fiber, and multiplying by 100. In other words, $$\text{Percent Increase in Melt Flow) Rate of Skin-Core Fiber to) Melt Flow Rate of Core)} = (MFR_{S\text{-}C} - MFR_C)/MFR_C \times 100$$

wherein:

$MFR_{S\text{-}C}$=average melt flow rate of the skin-core fiber, and $MFR_C$=melt flow rate of the core Of course, the percent increase in the average melt flow rate of the skin-core fiber as compared to the melt flow rate of the core would depend upon the characteristics of the skin-core structure. Thus, the skin-core structure can comprise an a gradient zone between the outer surface zone and the inner core, as obtainable in the processes disclosed in the above-noted Kozulla patents, and in the above-noted Takeuchi et al. U.S. and European applications. In the skin-core structure, the skin comprises the outer surface zone and the gradient zone. Additionally, there can be distinct core and outer surface zone regions without a gradient, such as disclosed in the above-noted Takeuchi et al. U.S. and foreign applications, which have been incorporated by reference in their entirety. In other words, there can be a distinct step between the core and outer surface zone of the skin-core structure forming two adjacent discrete portions of the fiber, or. there can be a gradient between the inner core and the outer surface zone.

Thus, the skin-core fibers of the present invention can have different physical characteristics. For example, the average melt flow rate of the skin-core fibers having a discrete step between the outer surface zone and the core is only slightly greater than the melt flow rate of the polymer blend; whereas, the average melt flow rate of the skin-core fiber having a gradient between the outer surface zone and the inner core is significantly greater than the melt flow rate of the polymer composition. More specifically, for a melt flow rate of the polymer blend of about 10 dg/min, the average melt flow rate of the skin-core fiber without a gradient can be controlled to about 11 to 12 dg/min, which indicates that chain scission degradation has been limited to substantially the outer surface zone of the skin-core fiber. In contrast, the average melt flow rate for a skin-core fiber having a gradient is about 20 to 50 dg/min.

Still further, while not being wished to be bound to the relationship of the dominant phase of polypropylene to the polymeric bond curve enhancing agent, such as ethylene vinyl acetate copolymer, it is pointed out that the polymeric bond curve enhancing agent may be dispersed throughout the cross-section of the fiber in the form of fibrils. The dispersion can be in any manner, such as homogeneously or non-homogeneously, throughout the skin and core of the fiber, with the fibrils appearing to at least some degree in both the skin and core of the fiber.

More specifically, the polymeric bond curve enhancing agent, such as ethylene vinyl acetate copolymer, can be in the form of microdomains in the dominant phase, with these microdomains having an elongated appearance in the form of fibrils. These fibrils appear to have dimensions, which include a width of about 0.005 to 0.02 μm, and a length of about 0.1 μm or longer. However, while fibrils can be present, such as when the polymeric bond curve enhancing agent comprises ethylene vinyl acetate copolymer, fibrils need not be present. Accordingly, fibers according to the present invention may or may not have fibrils present therein.

The spun fiber obtained in accordance with the present invention can be continuous and/or staple fiber of a monocomponent or bicomponent type, and preferably falls within a denier per filament (dpf) range of about 0.5–30, or higher, more preferably is no greater than about 5, and preferably is about 0.5 and 3, more preferably about 1 to 2.5, with preferred dpf being about 1.5, 1.6, 1.7 and 1.9.

In the multi-component fiber, e.g., the bicomponent type, such as a sheath-core structure, the sheath element would have a skin-core structure, while the core element would be of a conventional core element such as disclosed in the above-identified U.S. Pat. Nos. 4,173,504, 4,234,655, 4323,626, 4,500,384, 4,738,895, 4,818,587 and 4,840,846. Thus, the core element of the bicomponent fiber need not be degraded or even consist of the same polymeric material as the sheath component, although it should be generally compatible with, or wettable or adherent to the inner zone of the sheath component. Accordingly, the core can comprise the same polymeric materials as the sheath, such as including the same mixture of polypropylene and one or more polymeric bond curve enhancing agents, and possibly one or more additional polymers as included in the sheath, or can comprise other polymers or polymer mixtures. For example, both the core and the sheath can contain polypropylene or a mixture of polypropylenes, either alone or in combination with any other components including the polymeric bond curve enhancing agents, e.g., ethylene vinyl acetate polymer and/or additional polymers.

Further, the fibers of the present invention can have any cross-sectional configuration, such as illustrated in FIGS. 1(*a*)–1(*g*), such as oval (FIG. 1(*a*)), circular (FIG. 1(*b*)), diamond (FIG. 1(*c*)), delta (FIG. 1(*d*)), trilobal—"Y"-shaped (FIG. 1(*e*)), "X"-shaped (FIG. 1(*f*)) and concave delta (FIG. 1(*g*)) wherein the sides of the delta are slightly concave. Preferably, the fibers comprise a circular or a concave delta cross-section configuration. The cross-sectional shapes are not limited to these examples, and can comprise other cross-sectional shapes. Additionally, the cross-sectional shapes can be different than those illustrated for the same cross-directional shapes. Also, the fibers can include hollow portions, such as a hollow fiber, which can be produced, for example, with a "C"cross-section spinnerette.

Figure 1A:
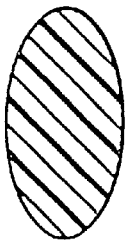
FIGS. 1(*a*)–1(*g*) illustrate cross-sectional configurations of fibers according to the present invention without showing the skin-core structure of the fibers.
Figure 1B:
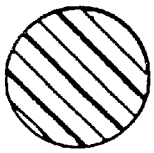
Figure 1C:
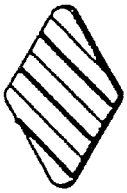
Figure 1D:
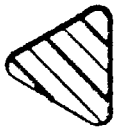
Figure 1E:
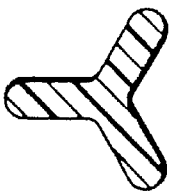
Figure 1F:
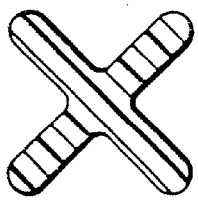
Figure 1G:
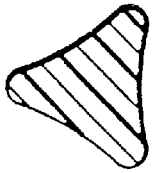
Figure 2:
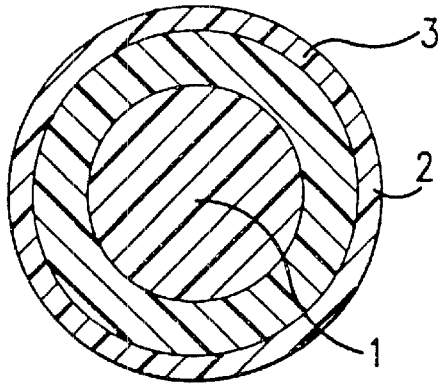
FIG. 2 schematically illustrates a skin-core fiber composed of a polymer blend according to the present invention having a gradient between the outer surface zone and the core.
Figure 3:
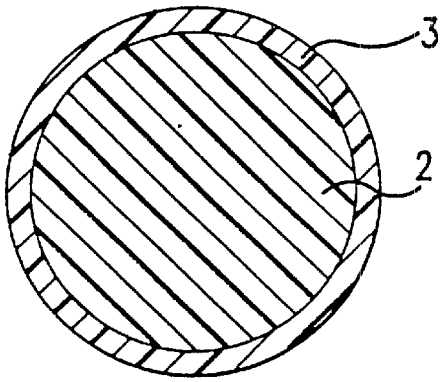
FIG. 3 schematically illustrates a skin-core fiber composed of a polymer blend according to the present invention having a discrete step between the outer surface zone and the core.
Figure 4:
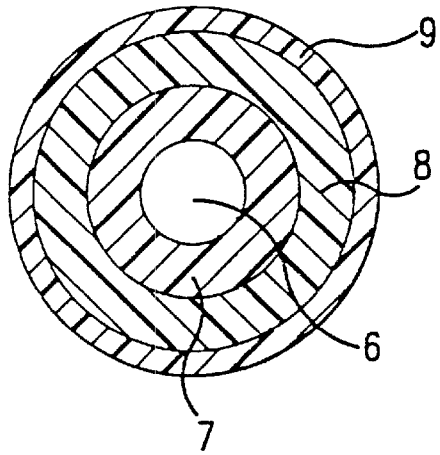
FIG. 4 schematically illustrates a bicomponent sheath-core fiber comprising a sheath of a polymer blend according to the present invention having a skin-core structure.

Still further, and so as to assist in visualization of the fibers of the present invention, FIGS. 2–4 provide schematic illustrations thereof. Thus, FIG. 2 schematically illustrates a skin-core fiber composed of a polymer blend according to the present invention having a skin comprising outer zone 3 and an intermediate gradient zone 2, and a core 1. FIG. 3 schematically illustrates a skin-core fiber composed of a polymer blend according to the present invention having a discrete step between the skin 4 and core 5. FIG. 4 schematically illustrates a bicomponent sheath-core fiber comprising a sheath of a polymer blend according to the present invention having a skin-core structure. As illustrated the bicomponent fiber includes an inner bicomponent core component 6, which is different from the polymer blend of the sheath, and reference numerals 7, 8 and 9 are similar to reference numerals 1, 2 and 3 in FIG. 2.

According to the present invention, the starting composition preferably has a MFR of about 2 to 35 dg/minute, so that it is spinnable at temperatures within the range of about 250° C. to 325° C., preferably 275° C. to 320° C.

The oxidizing environment can comprise air, ozone, oxygen, or other conventional oxidizing environment, at a heated or ambient temperature, downstream of the spinnerette. The temperature and oxidizing conditions at this location must be maintained to ensure that sufficient oxygen diffusion is achieved within the fiber so as to effect oxidative chain scission within at least a surface zone of the fiber to obtain an average melt flow rate of the fiber of at least about 15, 25, 30, 35 or 40 up to a maximum of about 70.

In making the fiber in accordance with the present invention, at least one melt stabilizer and/or antioxidant can be included with the extrudable composition. The melt stabilizer and/or antioxidant is preferably mixed in a total amount with the polymer blend to be made into a fiber in an amount ranging from about 0.005–2.0 weight % of the extrudable composition, preferably about 0.005–1.0 weight %, and more preferably about 0.0051 to 0.1 weight %. Such stabilizers and antioxidants are well known in fiber manufacture and include phenylphosphites, such as IRGAFOS® 168 (available from Ciba Geigy Corp.), ULTRANOX® 626 or ULTRANOX® 641 (available from General Electric Co.), and SANDOSTAB® P-EPQ (available from Sandoz Chemical Co.); and hindered phenolics, such as IRGANOX® 1076 (available from Ciba Geigy Corp.).

The stabilizer and/or antioxidant can be added to the extrudable composition in any manner to provide the desired concentration. In particular, it is noted that the materials may contain additives from the supplier. For example, the polypropylene, as supplied, can contain about 75 ppm of IRGANOX®1076, and the ELVAX® resins, as supplied, can contain 0 to 1000 ppm of butylated hydroxytoluene (BHT) or other stabilizers.

Optionally, pigments, such as titanium dioxide, in amounts up to about 2 weight %, antacids such as calcium stearate, in amounts ranging from about 0.01–0.2 weight %, colorants, in amounts ranging from 0.01–2.0 weight %, and other well known additives can be included in the fiber of the present invention.

Additionally, the use of polymeric bond curve enhancing agents, such as ethylene vinyl acetate copolymers, in high temperature extrusion processes (greater than 220° C.) can result in pressure build-up situations on primary extruder filters and/or downstream spinnerette filters. To this end, processing aids designed to prevent "stick-slip" behavior of polyethylene in extrusion dies, mostly in film systems, can be used to prevent or reduce pressure build-up, such as with ethylene vinyl acetate copolymers ranging from 9 to 28% in vinyl acetate content. Such process aids are of the type that preferentially thinly coat the metal parts of the extrusion equipment, e.g., extruder, piping, filters and spinnerette capillaries, so that the polymeric bond curve enhancing agent (e.g., ethylene vinyl acetate copolymer) does not build up on the filters and/or capillaries, causing pressure build-ups. For example, the process aids can comprise Viton® Free Flow™GB (available from DuPont Dow Elastomers, Elkton, Md.), Dynamar™ FX9613 and Dynamar™ FXS920A (available from 3M, Specialty Fluoropolymers Dept., St. Paul, Minn.). Preferably, the process aid comprises Dynamar™ FX5920A used in combination with ethylene vinyl acetate copolymer as the polymeric bond curve enhancing agent.

Various types of finishes including spin finishes and over finishes can be applied to the fibers or incorporated into the polymer blend to affect the wettability and static properties of the fibers. For example, wetting agents, such as disclosed in U.S. Pat. No. 4,578,414, incorporated by reference herein in its entirety, can be utilized with the fibers of the present invention. Still further, hydrophobic finishes, such as disclosed in U.S. Pat. No. 4,938,832, incorporated by reference herein in its entirety, can also be utilized with the fibers of the present invention. Also, the hydrophobic finishes can preferably comprise hydrophobic pentaerythritol esters, as disclosed in U.S. Pat. application Ser. No. 08/728,490, filed Oct. 9, 1996. Mixtures of these esters are available from Hercules Incorporated, Wilmington, Del., as HERCOLUBE® and HERCOFLEX® synthetic esters, including HERCOLUBE® J, HERCOLUBE® F, HERCOLUBE® 202, and HERCOFLEX® 707A; and from George A. Goulston Co., Monroe, N.C. as LUROL® PP6766, LUROL® PP6767, LUROL® PP6768 and LUROL® PP6769.

Additional components can be included in the polymer blend to effect properties of the fiber. For example, components can be included in the polymer blend which provide a repeat wettability to the fibers, such as an alkoxylated fatty amine optionally in combination with primary fatty acid amide, as disclosed by Harrington, U.S. Pat. No. 5,033,172, which is hereby incorporated by reference in its entirety.

It is also preferred that the fiber of the present invention have a tenacity less than about 4 g/denier, and a fiber elongation of at least about 50%, and more preferably a tenacity less than about 2.5 g/denier, and a fiber elongation of at least about 200%, and even more preferably a tenacity of less than about 2 g/denier, and an elongation of at least about 250%, as measured on individual fibers using a Fafegraph Instrument, Model T or Model M, from Textechno, Inc., which is designed to measure fiber tenacity and elongation, with a fiber gauge length of about 1.25 cm and an extension rate of about 200%/min (average of 10 fibers tested). Fiber tenacity is defined as the breaking force divided by the denier of the fiber, while fiber elongation is defined as the elongation to break.

The fibers of the present invention can be drawn under various draw conditions, and preferably are drawn at ratios of about 1 to 4×, with preferred draw ratios comprising about 1 to 2.5×, more preferred draw ratios comprising about 1 to 2×, more preferred draw ratios comprising from about 1 to 1.6×, and still more preferred draw ratios comprising from about 1 to 1.4×, with specifically preferred draw ratios comprising about 1.15× to about 1.35×. The draw ratio is determined by measuring the speed of a first roller as compared to the speed of a second roller over which the filament is passing, and dividing the speed of the second roller by the speed of the first roller.

As discussed above, the present invention provides nonwoven materials including the fibers according to the present invention thermally bonded together. In particular, by incorporating the fibers of the present invention into nonwoven materials, the resulting nonwoven materials possess exceptional cross-directional strength and softness. These nonwoven materials can be used as at least one layer in various products, including hygienic products, such as sanitary napkins, incontinence products and diapers, comprising at least one liquid absorbent layer and at least one nonwoven material layer of the present invention and/or incorporating fibers of the present invention thermally bonded together. Further, as previously indicated, the articles according to the present invention can include at least one liquid permeable or impermeable layer. For example, a diaper incorporating a nonwoven fabric of the present invention would include, as one embodiment, an outermost impermeable or permeable layer, an inner layer of the nonwoven material, and at least one intermediate absorbent layer. Of course, a plurality of nonwoven material layers and absorbent layers can be incorporated in the diaper (or other hygienic product) in various orientations, and a plurality of outer permeable and/or impermeable layers can be included for strength considerations.

Further, the nonwovens of the present invention can include a plurality of layers, with the layers being of the same fibers or different. Further, not all of the layers need include skin-core fibers of the polymer blend of the present invention. For example, the nonwovens of the present invention can used by themselves or in combination with other nonwovens, or in combination with other nonwovens or films.

Nonwovens according to the present invention can comprise 100% by weight of the skin-core fibers of the polymer blend of the present invention, or can comprise a combination of these fibers with other types of fibers. For example, the fibers in the nonwoven material can include fibers made from other polymers, such as polyolefins, polyesters, polyamides, polyvinyl acetates, polyvinyl alcohol and ethylene acrylic acid copolymers. These other fibers can be made by the same process or a different process, and can comprise the same or different size and/or cross-sectional shape. For example, the nonwovens can comprise a mixture of at least two different types of fibers, with one of the fibers comprising skin-core fibers formed from a polymeric bond curve enhancing agent, preferably, an ethylene vinyl acetate copolymer/polypropylene blend and the other fibers comprising skin-core polypropylene fibers and/or polymeric fibers not having a skin-core structure, such as polypropylene fibers or sheath-core fibers having different polymer materials in the sheath and core. Thus, nonwovens of the present invention can comprise any combination of the fibers of the present invention, either alone or in combination with other fibers. As discussed above, the nonwovens of the present invention can be prepared at lighter basis weights while achieving structural properties that are at least equivalent to nonwovens having a heavier basis weight. Further, the bonding curve of cross-directional strength vs. temperature of the nonwovens is flatter whereby lower bonding temperatures can be used to achieve thermal bonding while achieving cross-directional strengths that usually require higher bonding temperatures. These lower bonding temperatures further contribute to the softness associated with the nonwovens using the polymer blend of the present invention.

The flattening of the bonding curve, raising of the bonding curve and/or the shifting of the bonding curve to the left can be evaluated for nonwovens produced from polymers containing a blend of polypropylene and polymeric bond curve enhancing agent, preferably ethylene vinyl acetate polymer, by determining bonding curve characteristics at set reference points along the bonding curve and/or by determining the area or reduced area under the bonding curve within the set reference points.

Figure 5:
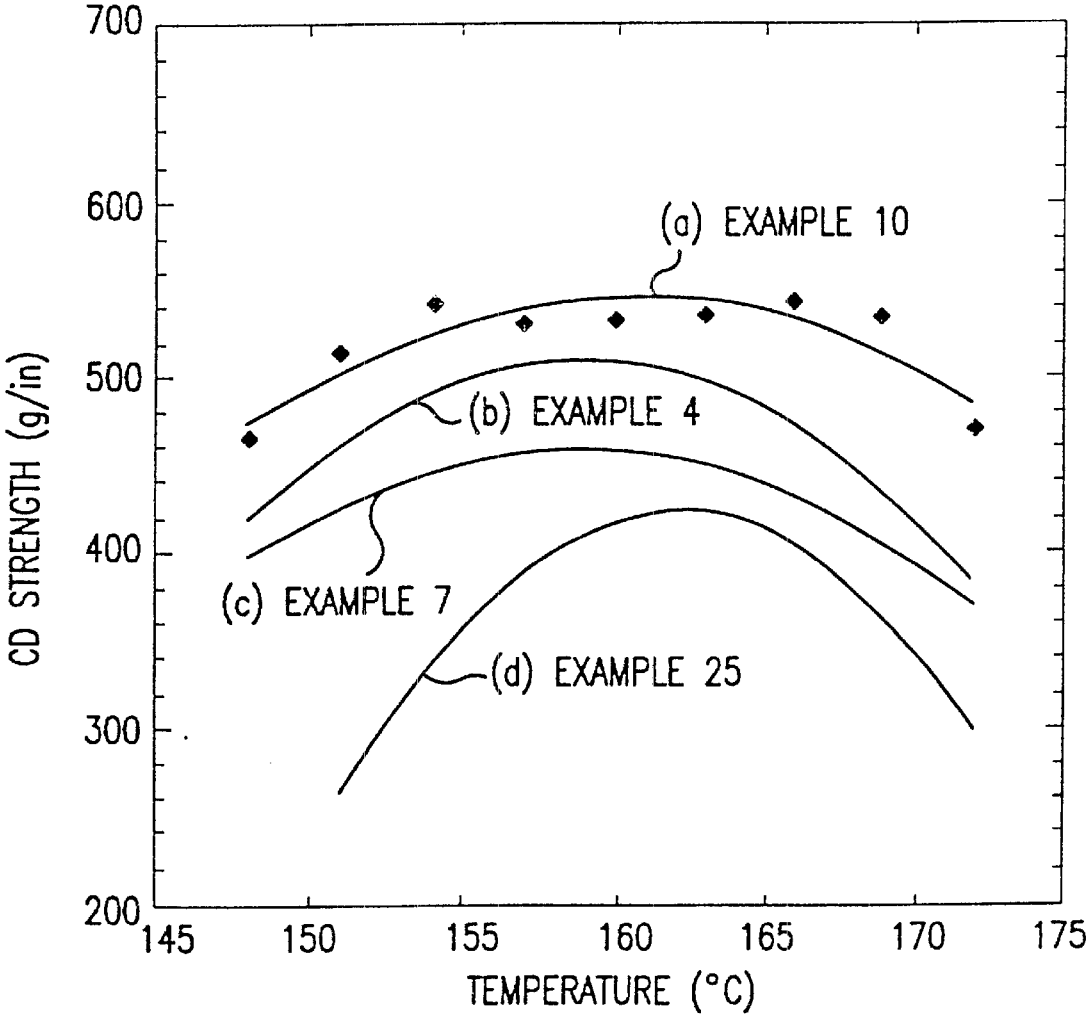
FIG. 5 illustrates bonding curves of cross-directional strength vs. bonding temperature.
Figure 6:
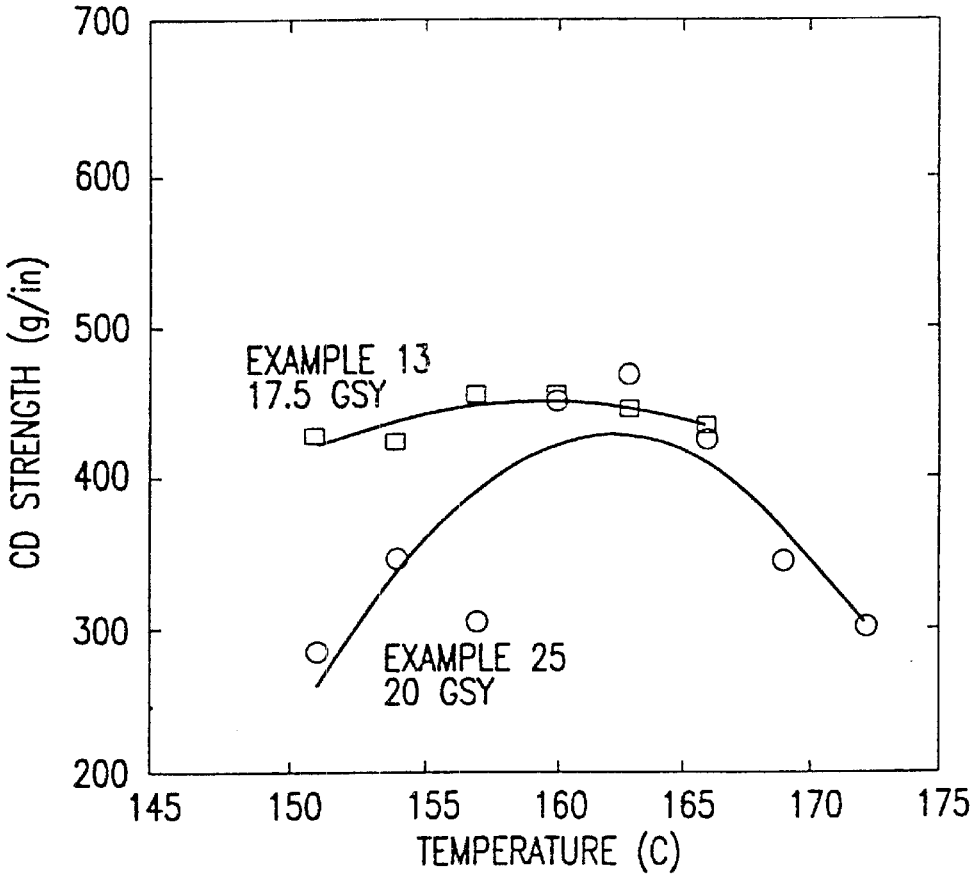
FIG. 6 illustrates bonding curves of cross-directional strength vs. bonding temperature for different basis weight nonwoven materials.

In particular, as can be seen in FIGS. 5 and 6, the bonding curve of cross-directional strength (CDS) versus temperature has a generally parabolic function, with CDS increasing with temperature until a maximum CDS is reached, and thereafter decreasing with temperature. Thus, as discussed above, if the bonding curve can be flattened, raised and/or shifted to the left, it would be possible to thermally bond the fibers at lower temperatures.

The set reference points according to the present invention are related to the maximum CDS and its associated temperature, the melting point of the fibers in the nonwoven and the CDS at the melting point, and the CDS measured at temperatures 10° C. lower than these temperatures. More specifically, values to be utilized for determining the flattening, raising and/or shifting to the left of peak of the bonding curve can be determined utilizing a second order regression quadratic fit to obtain a curve such as illustrated in FIG. 8. including lower and upper limits of regression A and B, respectively.

The quadratic fit should be conducted over a temperature range which encompasses the melting point of the fiber, as determined by differential scanning calorimetry (melting temperature or point D identified herein as $T_m$) for approximately 6° C. above the melting point to 15° C. below the melting point.

The quadratic fit is determined by the equation:

$$CDS=C_2T^2+C_1T+C_0$$

wherein:

T=Bonding Temperature (e.g., calendar roll, air temperature)

CDS=Cross-Directional Strength of Nonwoven Material $C_2$, $C_1$ and $C_0$=Coefficients of Regression In particular, the following points are illustrated in FIG. 8:

$T_m$=Temperature of differential scanning calorimetry endotherm maximum, which is believed to be the peak melting temperature of the fibers as determined by differential scanning calorimetry (illustrated as point D)

$T_p$=Temperature of regression maximum ($-C_1/2C_2$), which is the temperature at which the bonding curve exhibits maximum cross-directional strength (illustrated as point C)

$T_{m-10}$=Temperature at 10° C. to the left of $T_m$ (illustrated as point H)

$T_{p-10}$=Temperature at 10° C. to the left of $T_p$ (illustrated as point G)

$T_1$ Temperature at lower limit of regression $T_u$ Temperature at upper limit of regression $CDS_m$=Cross-directional strength at $T_m$ (illustrated as point F)

$CDS_p$=Cross-directional strength at $T_p$ (illustrated as point E)

$CDS_{m-10}$=Cross-directional strength at $T_{m-10}$ (illustrated as point J)

$CDS_{p-10}$=Cross-directional strength at $T_{p-10}$ (illustrated as point I)

$CDS_1$=Lower limit of regression, which is the cross-directional strength at the lower limit of regression (illustrated as point A)

$CDS_u$=Upper limit of regression, which is the cross-directional strength at the upper limit of regression (illustrated as point B)

$CDS_{max}$=Cross-directional strength of a line tangent to $CDS_p$ which is perpendicular to the CDS axis of the bonding curve (illustrated as the value at point K)

O=Origin at CDS=0 and $T_1$

M=Point at CDS=0 and $T_u$

K=Point having coordinates of $T_1$ and $CDS_p$

L=Point having coordinates of $T_{m-10}$ and $CDS_p$

N=Point having coordinates of $T_{p-10}$ and $CDS_p$

P=Point having coordinates of $T_1$ and $CDS_m$

Q=Point having coordinates of $T_m$ and $CDS_p$

The following values can be determined from the bonding curve for determining its flattening, raising and/or shifting to the left:

$C_m$=Percent of $CDS_p$ at $T_{m-10}$=($CDS_{m-10}/CDS_p$)×100

$C_p$=Percent of $CDS_p$ at $T_{p-10}$=($CDS_{p-10}/CDS_p$)×100

$C_1$=Percent of $CDS_m$ at $T_1$=($CDS_1/CDS_m$)×100

$\Delta C_m$=$C_m$ of invention−$C_m$ of control $\Delta C_p$=$C_p$ of invention−$C_p$ of control $\Delta C_1$=$C_1$ of invention−$C_1$ of control $A_m$=Area under curve from $T_m$ to $T_{m-10}$ from CDS=0, which is calculated as the integrated area of HJFD $A_p$=Area under curve from $T_p$ to $T_{p-10}$ from CDS=O, which is calculated as the integrated area of GIEC $A_1$=Area under curve from $T_m$ to $T_1$ from CDS=0, which is calculated as the integrated area of OAFD $$\%\Delta A_m = \frac{(A_m \text{ of invention} - A_m \text{ of control})}{A_m \text{ of control}} \times 100\%$$

$$\%\Delta A_p = \frac{(A_p \text{ of invention} - A_p \text{ of control})}{A_p \text{ of control}} \times 100\%$$

$$\%\Delta A_1 = \frac{(A_1 \text{ of invention} - A_1 \text{ of control})}{A_1 \text{ of control}} \times 100\%$$

$R_m$ = Reduced area under curve from $T_m$ to $T_{m-10}$ from $CDS = 0$, $$\text{which is calculated as: } \frac{\text{integrated area of } HJFD}{\text{integrated area of } HLQD} \times 100\%$$

$R_p$ = Reduced area under curve from $T_p$ to $T_{p-10}$ from $CDS = 0$, $$\text{which is calculated as: } \frac{\text{integrated area of } GIEC}{\text{integrated area of } GNEC} \times 100\%$$

$R_1$ = Reduced area under curve from $T_m$ to $T_1$ from $CDS = 0$, $$\text{which is calculated as: } \frac{\text{integrated area of } OAFD}{\text{integrated area of } OKQD} \times 100\%$$

$\Delta R_m$=$R_m$ of invention−$R_m$ of control $\Delta R_p$=$R_p$ of invention−$R_p$ of control $\Delta R_1$=$R_1$ of invention−$R_1$ of control In the examples of the present application, SigmaPlot® Scientific Graphing Software—Version 4.1, (obtained from Jandel Scientific, Corte Madera, Calif.) was used to perform the quadratic (or curvilinear) regression and to obtain the Coefficients of Regression. The SigmaPlot™ Scientific Graphing Software User's Manual for IBM®PC and Compatibles, Version 4.0, December 1989, and the Supplement to the User's Manual Version 4.1, January 1991, which are incorporated herein by reference in their entirety, describe the use of the software. In particular, in the User's Manual for IBM®PC and Compatibles, at pages 4–164 to 4–166, information is provided about regression options. A regression order of 2 is used and data is regressed through data only from the minimum to the maximum values listed in Table 9.

The quadratic fit should be obtained for at least seven or more points over the temperature range. The regression coefficient should be at least about 0.5, and is preferably above about 0.6. In the examples herein, the average is about 0.8.

The normal equations, by the method of least squares, can also be found in Fundamental Concepts in the Design of Experiments" by Hicks, CBS College Publishing, NY, 1982, at pages 130–136 for linear regression and pages 137–139 for curvilinear regression. The regression coefficient is the square root of the coefficient of determination, which is the proportion of the total sum of squares that can be accounted for by the regression.

As indicated above, $T_m$ is determined using differential scanning calorimetry (DSC). In particular, a Dupont DSC 2910 differential scanning calorimeter module with a Dupont Thermal Analyst TA 2000 was used to make the measurements. Also, the temperature was calibrated using an Indium standard. The instrument and its general operation are described in the DSC 2910 Operator's Manual, published 1993 by TA Instruments, 109 Lukens Drive, New Castle, Del. 19720.

To obtain each $T_m$ measurement, the fiber to be bonded, such as the staple fiber, is cut into 0.5 mm lengths and precisely weighed (to the nearest 0.01 mg) to about 3 mg in aluminum sample pans on a Perkin-Elmer AM-2 Autobalance. DSC scans are made at heating rates of 20° C. per minute from room temperature (about 20° C.) to about 200° C. Heat flow (in mcal/sec) is plotted vs. temperature. The melting points ($T_m$) of the fiber samples are taken as the maximum values of the endothermic peaks. For example, where the scan includes a number of peaks, $T_m$ would be determined using the highest temperature peak of the scan.

Figure 9:
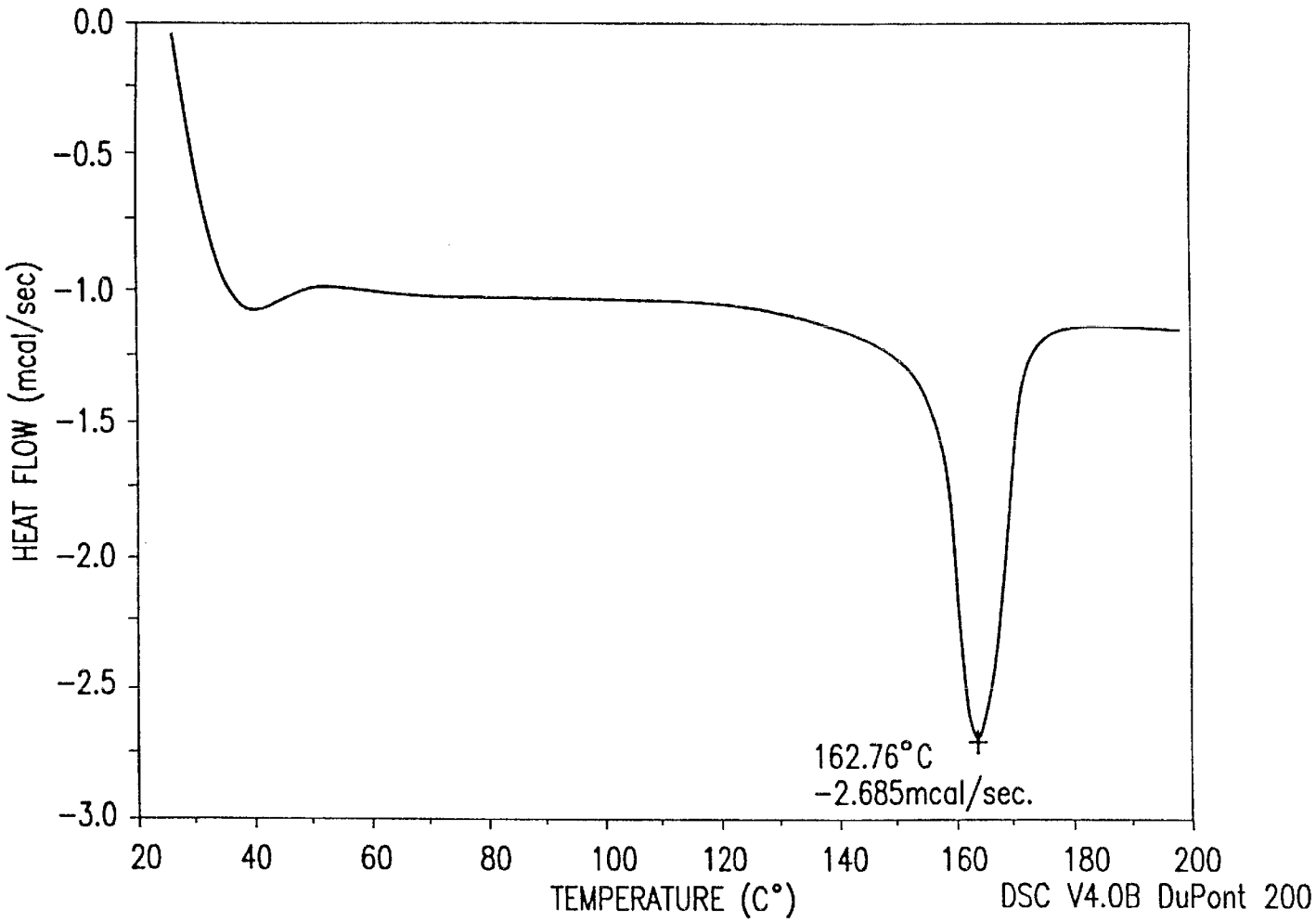
FIG. 9 illustrates a Differential Scanning Calorimetry (DSC) endotherm.

A representative DSC curve of Heat Flow (mcal/sec) vs. Temperature (°C.) is illustrated in FIG. 9. More specifically, the DSC endotherm shows a peak at about 163° C. for a 3.24 mg. sample of Example 45.

As illustrated in FIG. 8, $T_m$ is to the left of $T_p$ because the DSC melting point is lower for this illustrative example than the temperature at the peak cross-directional strength. However, this is for illustrative purposes only, and $T_m$ can be to the right of $T_p$, or $T_m$ can be equal to $T_p$.

As will be discussed in the examples, $C_2$, $C_1$, $C_0$, the minimum temperature of regression, the maximum temperature and the regression coefficient are set forth for the examples in Table 9. In most instances in the examples, $T_m$ is approximately 163° C., whereby approximately 6° C. above the DSC melting point is about 169° C., and approximately 15° C. below the DSC melting point is about 148° C. Accordingly, the lower and upper limits of regression for the quadratic fit have been determined utilizing 148° C. and 169° C., respectively, for most of the examples. However, as stated above, depending upon the DSC melting point of the fiber, other lower and upper limits of regression would be utilized.

As can be seen from the data presented in the examples below, thermally bonded nonwoven materials including fibers according to the present invention obtain absolute CDS values that are high. Additionally, the CDS values of the thermally bonded nonwoven materials produced including the fibers according to the present invention are relatively high as compared to nonwoven materials produced under the same conditions from fibers also produced under the same conditions but without the polymeric bond curve enhancing agent of the present invention. Thus, the nonwoven materials of the present invention can be defined using any one of the values described herein, or any combination of the values.

Expanding on the above, it is noted that fibers of the present invention which are thermally bonded into nonwoven materials provide resulting nonwoven materials that can have significantly higher strength properties than nonwoven materials produced under the same conditions but without the presence of polymeric bond curve enhancing agents. Thus, where all fiber production characteristics are the same, including each fiber forming step, and all nonwoven material production characteristics are the same, including all nonwoven material producing steps, the resulting nonwoven material which includes the fibers of the present invention has higher strength characteristics compared to the nonwoven material which does not include fibers according to the present invention.

For example, in a preferred embodiment of the invention wherein staple fibers are subjected to carding and bonding to form a thermally bonded nonwoven, all fiber forming, and carding and bonding operations for the fibers of the invention which include polypropylene and polymeric bond curve enhancing agent would be the same as that for the comparative fibers which contain polypropylene but not polymeric bond curve enhancing agent. In particular, the fiber processing would be conducted at the same spinning, crimping and cutting conditions to obtain staple fibers having the same or substantially the same denier, draw ratio and cross-sectional shape. The only difference would be in the composition of the polymer blend utilized in the spinning operation, and this composition would only be different in the inclusion of polymeric bond curve enhancing agent in the composition used to form the fiber according to the present invention; whereas, the composition for forming the comparative fiber would not contain polymeric bond curve enhancing agent. Then, as noted above, the formed staple fiber would be subjected to the same carding and bonding conditions.

While it is noted that the production of fibers and nonwovens under the same conditions is indicated, there will be occasions wherein the exact same conditions may not be exactly reproduceable, such as due to processing considerations. In such occasions, the conditions should be maintained as close as possible to achieve what is in effect the same conditions.

EXAMPLES

The invention is illustrated in the following non-limiting examples, which are provided for the purpose of representation, and are not to be construed as limiting the scope of the invention. All parts and percentages in the examples are by weight unless indicated otherwise.

Fibers and fabrics, including those of the present invention, were prepared using polymers identified as A-S in the following Table 1, and having the properties indicated therein. Polymers A-D are linear isotactic polypropylene homopolymers obtained from Montell USA Inc., Wilmington, Del., polymers E, F, K, M and P are ethylene vinyl acetate copolymers ELVAX®250, ELVAX®150, ELVAX®3180, ELVAX®750 and ELVAX®3124, respectively, and polymer G is an ethylene/vinylacetate/acid terpolymer ELVAX®4260, each of which is obtained from Dupont Company, Wilmington, Del., having weight percent of vinyl acetate in the polymers, as stated in Table 1. Polymers H-J are polyethylenes Aspun™6835A, INSITE™XU58200.03 (apparently now 8803), and INSITE™XU58200.02, respectively, obtained from Dow Chemical Company, Midland, Mich. Polymer L is NUCREL®925 obtained from Dupont Company, Wilmington, Del. Polymer N is ELVALOY AM obtained from Dupont Company, Wilmington, Del. Polymer O is KPATONO™G1750 obtained from Shell Chemical Company, Houston, Tex. Polymers Q, R and S are Nylon 6, Nylon 66 and polyester obtained from North Sea Oil, Greenwood, S.C., and North Sea Oil obtaining these materials from Allied Signal, Morristown, N.J., or BASF, N. Mount Olive, N.J., with the Nylon 6 having a relative viscosity of 60 (available from Allied Signal as 8200), the Nylon 66 having a relative viscosity of 45–60, and the polyester comprising a polyethylene terephthalate having an intrinsic viscosity of 0.7. The stabilizer used is the phosphite stabilizer IRGAFOS®168 obtained from Ciba-Geigy Corp., Tarrytown, N.Y., the antacid is calcium stearate from Witco Corporation, Greenswich, Conn., and the pigment is $TiO_2$ obtained from Ampacet Corporation, Tarrytown, N.Y.

In the Examples, the Montell polypropylenes may contain 75 ppm of IRGANOX®1076, the ELVAX resins may contain 50 to 1000 ppm of butylated hydroxytoluene (BHT), the Dow 6835 polyethylene may contain 1000 ppm of IRGAFOS®168, and the Dow XU58200.03 and XU58200.02 polyethylenes may contain 1000 ppm of SANDOTAB®P-EPQ, and are made with INSITE™ technology.

Fibers were individually prepared using a two step process. In the first step, polymer compositions were prepared by tumble mixing linear isotactic polypropylene flake identified as "A" to "D" in Table 1, with one or more of polymers "E" to "S" to form the polymer compositions listed in Table 2, except for the control examples wherein polymers "E" and "S" were not added.

In addition to containing the polypropylene, either alone or in combination with other polymers, as set forth in Table 2, the compositions also contained, in amounts denoted in the Table, from 0 to 500 ppm of a phosphite stabilizer, IRGAFOS®168, obtained from Ciba-Geigy, calcium stearate obtained from Witco as an antacid, and $TiO_2$ obtained from Ampacet as a pigment. Primary antioxidants, such as IRGANOX®1076 and/or BHT are also included in the compositions, because the polymers include them as in process shipping stabilizers.

After preparing the composition, the composition is then blanketed with nitrogen, heated to melt the composition, extruded and spun into circular or concave delta cross-section fibers at a melt temperature of about 280 to 315° C., i.e., the highest temperature of the composition prior to extrusion through the spinnerette, using the process conditions and spinnerettes set forth in Tables 3 and 8. The melt is extruded through 675, 782, 1068 or 3125 hole spinnerettes at take-up rates of 762 to 1220 meters per minute to prepare spin yarn which is about 2.2 to 4.5 denier per filament, (2.4 to 5.0 dtex). The fiber threadlines in the quench box are exposed to normal ambient air quench (cross blow) with 10 to 25 millimeters of the quench nearest the spinnerette blocked off from the cross blow area to delay the quenching step, except for Example 72 which is not a skin-core fiber. Standard winding equipment (available from Leesona and/or Bouligny) were used to wind the filaments onto bobbins.

Figure 10:
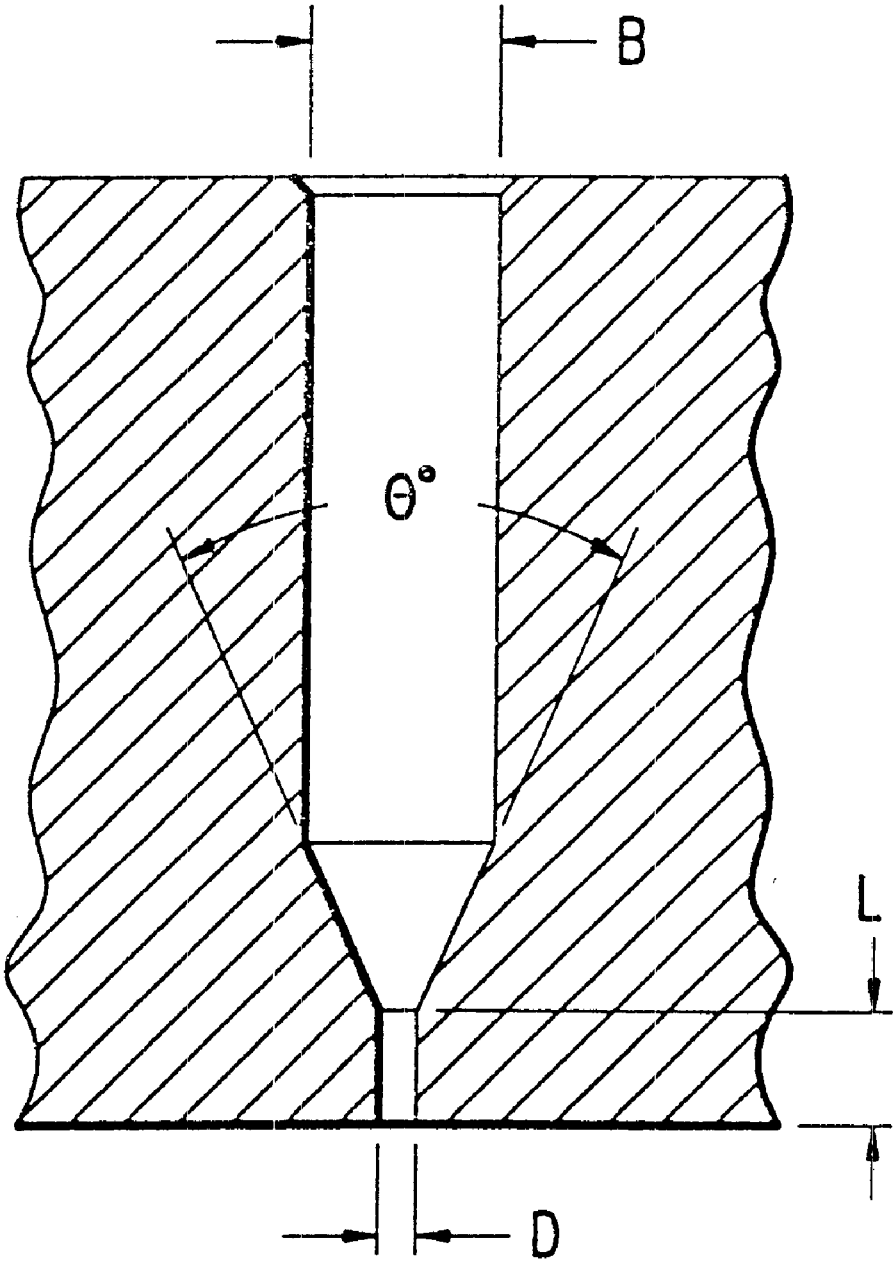
FIGS. 10, 11*a*, 11*b*, 11*c*, 12*a*, 12*b*, 13*a* and 13*b* illustrate spinnerettes listed in Table 8.
Figure 11C:
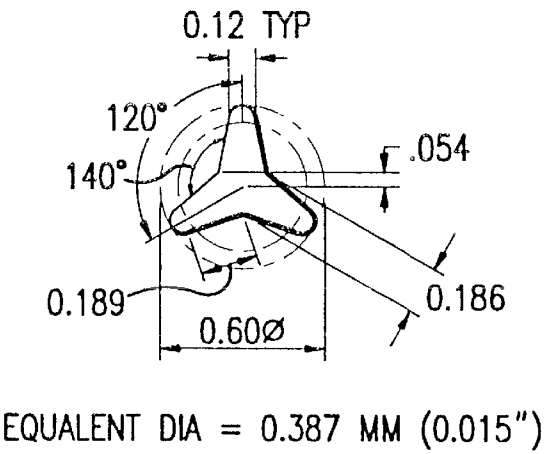
Figure 11B:
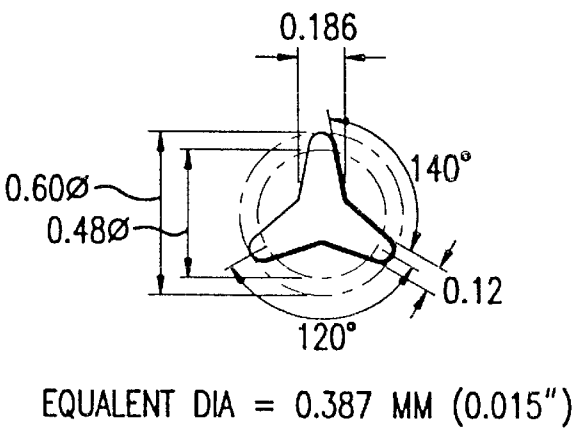
Figure 11A:
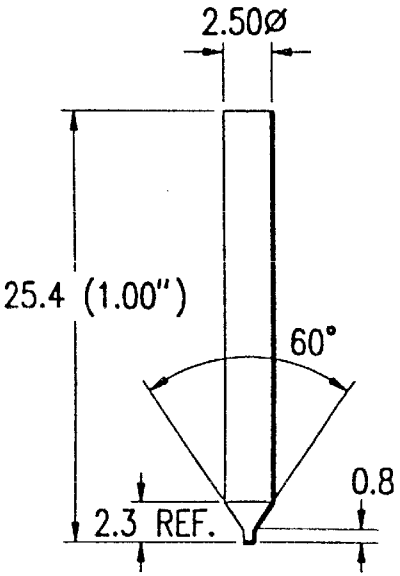
Figure 12B:
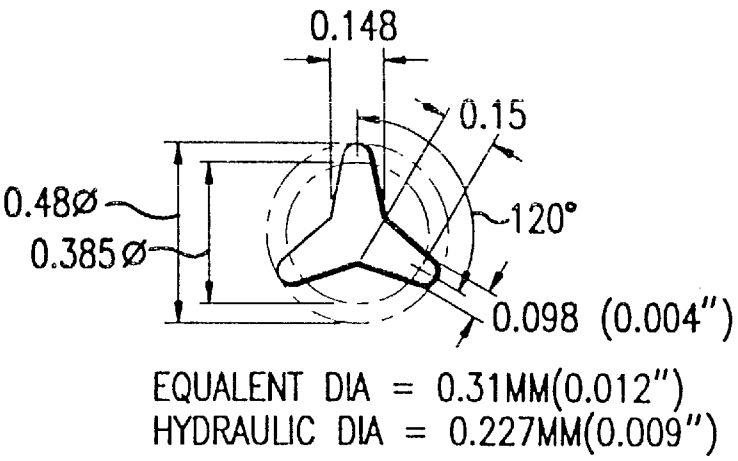
Figure 12A:
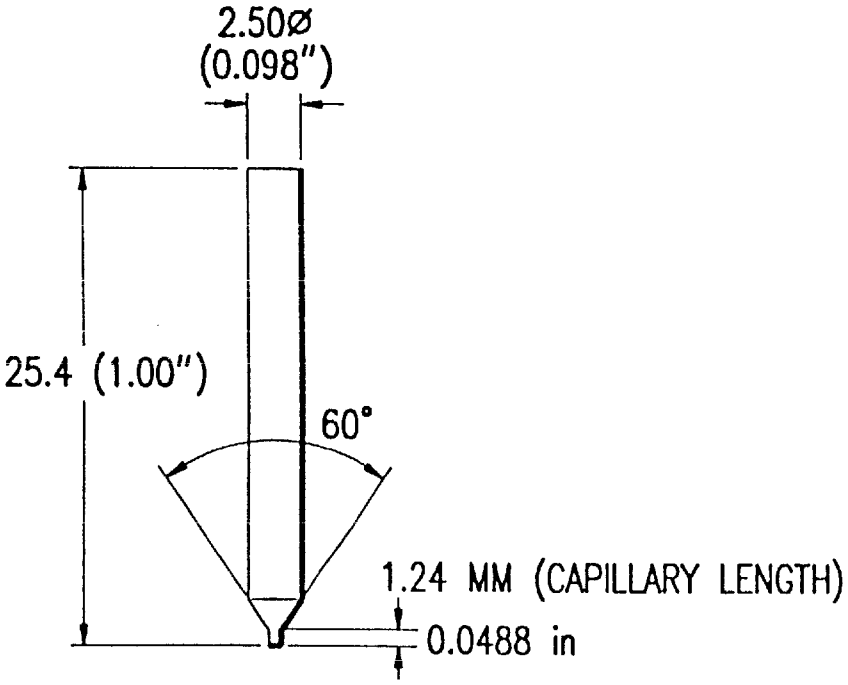
Figure 13B:
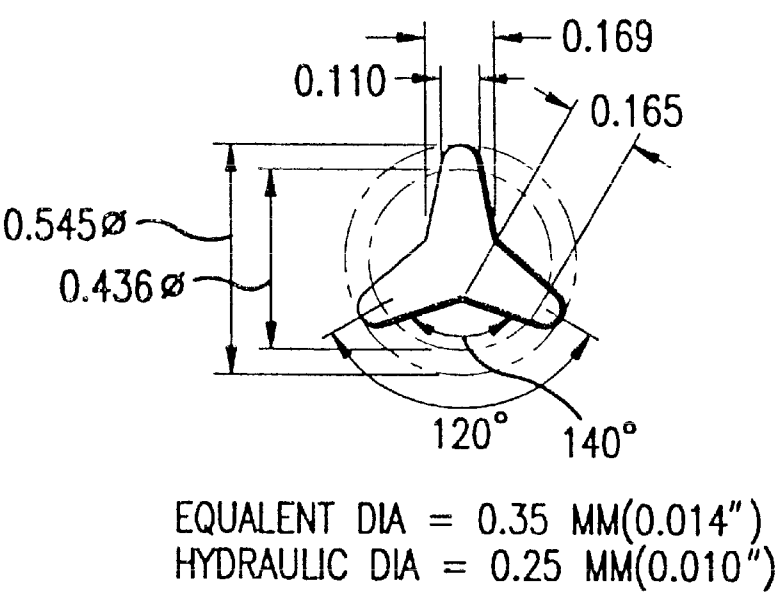
Figure 13A:
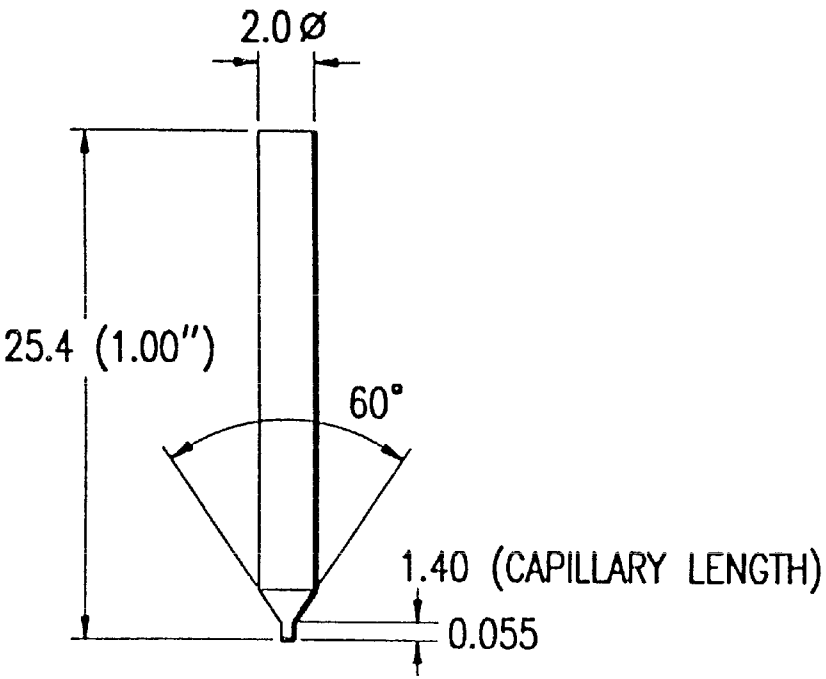

The spinnerette descriptions are listed in Table 8, and one having ordinary skill in the art would be able to design such spinnerettes having the information including the number of holes, fiber shape, equivalent diameter (D) which in the case of a round cross-section would be the diameter, capillary length (L), entrance angle (θ), counterbore diameter (B), holes per square inch, and length and width of the surface covered by the capillaries listed therein. However, to further assist in reviewing Table 8, FIG. 10 illustrating spinnerettes 1, 2, 6 and 7; FIGS. 11*a*–11*c* illustrating spinnerette 3; FIGS. 12*a* and 12*b* illustrating spinnerette 4; and FIGS. 13*a* and 13*b* illustrating spinnerette 5 are included. Dimensions illustrated in FIGS. 11–13, unless otherwise stated, are in millimeters.

In the second step, the resulting continuous filaments were collectively drawn using a mechanical draw ratio of from 1.34 to 1.90× and quintet or septet roll temperature conditions of 40 to 75° C. and 100 to 120° C., generally. The drawn tow is crimped at about 18 to 38 crimps per inch (70 to 149 crimps per 10 cm) using a stuffer box with steam or air. During each step (the spinning, drawing and crimping), the fiber is coated with a finish mixture (0.2 to 0.9% by weight finish on fiber). Four different finish systems were used. (a) Finish "X" comprised an ethoxylated fatty acid ester and an ethoxylated alcohol phosphate (from George A. Goulston Co., Inc., Monroe, N.C., under the name Lurol PP 912); (b) Finish "Y" Lurol PP5666/PP5667 (from George A. Goulston Co., Inc., Monroe, N.C.) in the first and second steps as spin and over finishes, respectively; (c) Finish "Z" comprising a mixture of 2 parts by weight of Nu Dry 90H from OSi Specialties, Inc., Norcross, Ga., and 1 part by weight of Lurol ASY from George A. Goulston Co., Inc., Monroe, N.C. in the first step as a spin finish and Lurol ASY from George A. Goulston Co., Inc., Monroe, N.C. in the second step as an over finish; or (d) Finish "W" comprising about 2 parts by weight of Lurol PP-6766 and 1 part by weight of Lurol ASY from George A. Goulston Co., Inc., Monroe, N.C. (with about 97 parts by weight of water used to dilute these to a 3% concentration and including a minor percentage (1%) of Nuosept 95 from Nuodex Inc. division of HULS America Inc., Piscataway, N.J., as a biocide) in the first step as a spin finish, and Lurol ASY from George A. Goulston Co., Inc., Monroe, N.C. in the second step as an over finish. Finishes X and Y render the fiber hydrophilic and wettable. Finish Z and W render the fiber hydrophobic and allow the fabric to repel water and aqueous liquids.

The crimped fiber is cut to staple of about 1.5 inches (38 mm) length.

Fibers of each blend composition are then carded into conventional fiber webs at 250 feet per minute (76 m/min) using equipment and procedures as discussed in Legare, R. J., 1986 TAPPI Synthetic Fibers for Wet System and Thermal Bonding Applications, Boston Park Plaza Hotel & Towers, Boston Mass. Oct. 9–10, 1986, "Thermal Bonding of Polypropylene Fibers in Nonwovens", pages 1–13, 57–71 and attached Tables and Figures. The Webmaster® randomizers described in the TAPPI article were not used. This article is incorporated herein in its entirety, by reference thereto.

Figure 7:
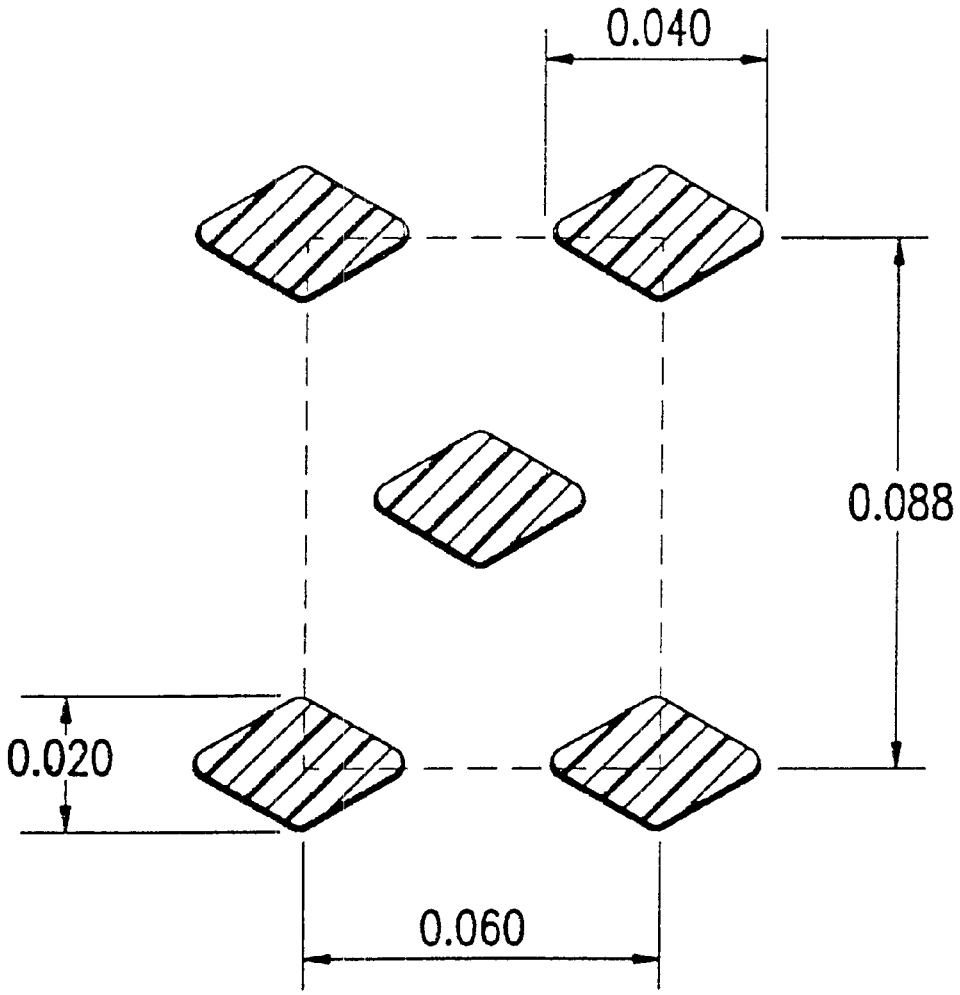
FIG. 7 illustrates the pattern for the calender roll utilized in the examples of present invention.

Specifically, two plies of the staple fibers are stacked in the machine direction, and bonded using a diamond design embossed calender roll and a smooth roll at roll temperatures ranging from about 145 to 172° C. and roll pressures of 240 pounds per linear inch (420 Newtons per linear centimeter) to obtain nonwovens weighing nominally 20±1 or 17.5±1 grams per square yard (23.9 or 20.9 grams per square meter). The diamond pattern calender roll has a 15% land area, 379 spots/sq. in. with a depth of 0.030 inch. Further, the diamonds have a width of 0.040 inch, a height of 0.020 inch, and are spaced height-wise 0.088 inch on center, and width-wise 0.060 inch on center, and a pattern as illustrated in FIG. 7.

Test strips (six per sample) of each nonwoven, 1 inch×7 inches (25 mm×178 mm) are then tested, using a tensile tester Model 1122 from Instron Corporation, Canton, Mass. for cross-directional (CD) strength, elongation, and toughness (defined as energy to break fabric based on the area under the stress-strain curve values).

Specifically, the breaking load and elongation are determined in accordance with the "cut strip test" in ASTM D-1682-64 (Reapproved 1975), which is incorporated by reference in its entirety, using the Instron Tester set at constant rate of traverse testing mode. The gauge length is 5 inches, the crosshead speed is 5 inches/minute, and the extension rate is 100%/minute.

As noted above, the composition of each blend is shown in Table 2. Process conditions are shown in Table 3. Characterizations of fiber spun from each composition and subjected to the listed process conditions are shown in Table 4. Tables 5, 6, and 7 show fabric cross directional properties obtained for each sample, with Table 5 showing cross-directional strength, Table 6 showing cross-directional elongation, and Table 7 showing cross-directional toughness. The strength values (Table 5) and toughness values (Table 7) are normalized for a basis weight of 20 grams per square yard (23.9 grams per square meter), except where noted in Examples 44 and 45 where the values were normalized for a basis weight of 17.5 gsy (20.9 grams per square meter). The fabric elongation values are not normalized.

The control samples are those made from samples 16, 17, 25, 26, 34, 36, 38, 50, 58, 62 and 65, as well as sample 72 which is not a skin-core fiber.

FIG. 5 illustrates a graph of a bonding curve of a nonwoven fabric containing fibers according to Examples 4, 7 and 10, as compared to control Example 25. As can been seen from this graph, the three uppermost curves (a), (b) and (c) of Examples 10, 4 and 7, respectively, have a flatter curve and enable bonding at lower temperatures as compared to curve (d) of Example 25. Thus, bonding can be achieved at lower temperatures using the fiber of the present invention, while preserving cross-directional strength and enabling the obtaining of a softer nonwoven fabric.

FIG. 6 illustrates a graph of a bonding curve for a nonwoven fabric containing fibers according to Example 13 at a basis weight of 17.5 gsy instead of 20 gsy as compared to Example 25 at a basis weight of 20 gsy. This graph shows a flatter bonding curve for the fiber according to the present invention, and the ability to bond at lower temperatures while achieving a high cross-directional strength. Thus, high cross-directional strengths are achievable with the fibers of the present invention at lower bonding temperatures, whereby softer nonwoven fabrics can be obtained. It is noted that the data for Example 13 in the Tables is normalized to 20 gsy.

Representative data concerning bonding curve (cross-directional strength vs. bonding temperature relationship) characteristics for the examples according to the invention are set forth in Tables 9–11 and Tables 12–14 illustrate comparative data.

More specifically, $C_2$, $C_1$, $C_0$, the minimum (lower) temperature of regression, the maximum (upper) temperature of regression and the regression coefficient, $T_p$ and $T_m$ are set forth for the examples in Table 9. As noted above, for most of the examples the minimum and maximum temperatures of regression are 148° C. and 169° C., respectively. However, for certain comparative examples the data is determined by using other than 148° C. and 169° C. in view of the availability of data for these examples. In each of these instances, the lower point of regression is higher than 148° C. However, once the bonding curve and regression coefficient have been determined, the calculated values of $C_1$, $A_1$, $R_1$, $CDS_1$ were determined using the definitions of $C_1$, $A_1$, $R_1$, $CDS_1$ as set forth above.

Table 10 lists $CDS_1$, $CDS_m$, $CDS_p$, $CDS_{p-10}$, $CDS_{m-10}$, $C_p$, $C_m$ and $C_1$ for the examples, with higher values of $C_p$, $C_m$ and $C_1$ indicating better performance at lower temperatures.

Table 11 lists $A_p$, $A_m$, $A_1$, $R_m$, $R_p$ and $R_1$ for the examples.

Improvements in the area values $A_p$, $A_m$ and $A_1$ represent either cross-directional strength improvements at all temperatures of the temperature interval, improvements at lower bonding temperatures, or both. Thus, either improvement could improve the integrated area value. However, the highest values result from flatter curves with high cross-directional strength values.

$R_m$, $R_p$ and $R_1$ are values wherein the integrated areas under the bonding curves are subjected to a "double reduction" to remove contributions of both the maximum cross-directional strength and the temperature interval. Thus, these reduced areas represent flatness of the bonding curve independent of the magnitude of the cross-directional strength. A value of 100% represents a completely flat cross-directional strength—temperature relationship.

Tables 12–14 show calculations obtained from Tables 10 and 11, wherein various values as denoted in Tables 10 and 11 are compared so as to denote flattening and/or shifting to the left of the bonding curve using a polymeric bond curve enhancing agent as compared to a bonding curve prepared under the same conditions (for fiber and nonwoven material production) except for the omission of polymeric bond curve enhancing agent. For example, improvements in the area under the bonding curve can be due to flattening of the bonding curve, to a cross-directional strength increase in the bonding curve, or both.

As can be discerned from the tables, the examples of the invention have been prepared with a range of properties and over a range of processing conditions, and with regard to a number of comparative examples of the same processing conditions but with the omission of polymeric bond curve enhancing agent. Thus, the performance of nonwovens containing fibers including polymeric bond curve enhancing agent can be compared to controls without polymeric bond curve enhancing agent. As noted above, Tables 12, 13, and 14 show these comparisons.

More specifically, Table 12 shows comparisons of $C_p$, $C_m$ and $C_1$ between nonwovens of the invention obtained from fibers produced according to the invention wherein polymeric bond curve enhancing agent is included therein, and control nonwovens obtained from fibers produced under the same conditions but without polymeric bond curve enhancing agent therein. The comparisons are obtained by obtaining values of $C_p$, $C_m$ and $C_1$ for a nonwoven according to the invention, values of $C_p$, $C_m$ and $C_1$ for a control nonwoven, and respectively subtracting the control values from the values according to the invention to obtain $\Delta C_p$, $\Delta C_m$ and $\Delta C_1$, respectively.

Table 13 shows comparisons of $A_p$, $A_m$ and $A_1$ between nonwovens of the invention obtained from fibers produced according to the invention wherein polymeric bond curve enhancing agent is included therein, and control nonwovens obtained from fibers produced under the same conditions but without polymeric bond curve enhancing agent therein. The comparisons are obtained by obtaining values of $A_p$, $A_m$ and $A_1$ for a nonwoven according to the invention, and values of $A_p$, $A_m$ and $A_1$ for a control nonwoven. The respective control values are then subtracted from the values according to the invention, the result is divided by the control value, and multiplied by 100% to obtain $\%\Delta A_p\%\Delta A_m$ and $\%\Delta A_1$, respectively.

Table 14 shows comparisons of $R_p$, $R_m$ and $R_1$ between nonwovens of the invention obtained from fibers produced according to the invention wherein polymeric bond curve enhancing agent is included therein, and control nonwovens obtained from fibers produced under the same conditions but without polymeric bond curve enhancing agent therein. The comparisons are obtained by obtaining values of $R_p$, $R_m$ and $R_1$ for a nonwoven according to the invention, the values of $R_p$, $R_m$ and $R_1$ for a control nonwoven, and respectively subtracting the control values from the values according to the invention to obtain $\Delta R_p$, $\Delta R_m$ and $\Delta R_1$, respectively.

Table 15 illustrates Theological data for elastic (storage) modulus and complex viscosity for various polymer additives, and compares this data to that of polypropylene in the columns which list the ratio of the polymer additive to the polypropylene. As can be seen in Table 15, preferred polymeric additives have a lower elastic modulus and complex viscosity than polypropylene. Table 15 also lists the DSC melting temperature of the polymers.

Comparison 1

Examples 3, 7 and 12 may be compared to control example 16. All examples were made to 2.2 dpf (nominally) by using a 1.55× draw ratio with polymer B. All were of round cross-section. Examples 3 and 7 contain 5% EVA; example 12 contains 3% EVA; and the control 16 has no EVA.

Although the control shows a good $CDS_p$, it occurs at a high temperature and the bonding curve is steep. Thus, no improvement is realized for $\Delta C_p$, with $C_p$ being 89.1% for the control, and 75.5%, 81.9%, and 86% for the nonwoven according to the invention. However, at $T_{m-10}$ and at temperatures as low 15° C. below the melting point of the fibers, improvements are made. Thus, $C_m$ is 45.3% for the control, and 89%, 95.3%, and 86.4% for the nonwoven according to the invention, thereby providing a $\Delta C_m$ of about 41 to 50%. Further, $C_1$ is 21.8% for the control, and 68.4%, 85.2%, and 69.1% for the nonwoven according to the invention, thereby providing a $\Delta C_1$ of about 47 to 63%.

The control shows a good $A_p$ due to the high temperature at which $CDS_p$ occurs. Thus, no improvement is realized for $\%\Delta A_p$, with Ap being 6114 for the control, and 4716, 4435 and 5032 for the nonwoven according to the invention. However, at $T_{m-10}$ and to temperatures as low as 15° C. below the melting point of the fibers, improvements are made. Thus, $A_m$ is 4191 for the control, and 4995, 4649 and 5042 for the nonwoven according to the invention, thereby providing a $\%\Delta A_m$ of about 11 to 20%. Further, $A_1$ is 5212 for the control, and 7018, 6752 and 7109 for the nonwoven according to the invention, thereby providing a $\%\Delta A_1$ of about 30 to 36%.

The control shows a good $R_p$ due to the high temperature at which $CDS_p$ occurs. Thus, no improvement is realized for $\Delta R_p$, with $R_p$ being 96.4% for the control, and 91.8%, 94% and 95.3% for the nonwoven according to the invention.

However, at $T_{m-10}$ and at temperatures to as low as 15° C. below the melting point of the fibers, improvements are made. Thus, $R_m$ is 66.1% for the control, and 97.3%, 98.5% and 95.5% for the nonwoven according to the invention, thereby providing a significant $\Delta R_m$ of about 30%. Further, $R_1$ is 54.8% for the control, and 91.1%, 95.4% and 89.8% for the nonwoven according to the invention, thereby providing a $\Delta R_1$ of about 35 to 40%.

The above comparative examples, as well as the comparative examples below are interesting in that they establish that nonwovens according to the present invention retain higher cross-directional strengths at lower temperatures than those of the controls. In other words, as compared to the controls, the nonwovens according to the present invention show higher retained cross-directional strengths as the comparisons are made at lower and lower temperatures. Thus, the nonwovens according to the present invention obtain $\Delta C_1$ values which are generally higher than $\Delta C_m$ values which are generally higher than $\Delta C_p$ values; $\%\Delta A_1$ values which are generally higher than $\%\Delta A_m$ values which are generally higher than $\%\Delta A_p$ values; and $\Delta R_1$ values which are generally higher than $\Delta R_m$ values which are generally higher than $\Delta R_p$ values.

Further comparisons are set forth below wherein data may be compared as described in Comparison 1, using the information provided in the Tables.

Comparison 2

Examples 13, 18, 40, 41 and 42 may be compared to control example 17. All were made to 1.9 dpf (nominally) by using a 1.35× draw ratio with polymer B. All were of round cross-section. Examples 13, 18, 40, 41 and 42 contain 3% EVA. The control 17 has no EVA. Improvements may be noted in each range and type of comparison as denoted in Tables 12–14.

Comparison 3

Groupings 3a, 3b and 3c represent samples prepared on a larger extruder at higher rates as noted in Table 3. Results may be once again be noted in Tables 12–14.

(a) Example 35 may be compared to control example 34. Each was made to 1.9 dpf (nominally) by using a 1.35× draw ratio with polymer B. Each was of concave delta cross-section. Example 35 contains 3% EVA. The control 34 has no EVA. Improvements may be noted in each range and type of comparison.

(b) Example 37 may be compared to control example 36. Each was made to 1.9 dpf (nominally) by using a 1.35× draw ratio with polymer B. Each was of concave delta cross-section. Tables 3 and 8 shows the difference in spinnerette and amount of cross air blocked between examples 34, 35 and examples 36,37. Example 37 contains 3% EVA. The control 36 has no EVA. In this comparison, the flatness of the bond curve as indicated by the reduced area is not generally improved, but the values of $A_p$, $A_m$, and $A_1$ are higher by about 21 to 24% indicating cross-directional strength increases over the entire temperature range.

(c) Example 39 may be compared to control example 38. Each was made to 1.9 dpf (nominally) by using a 1.35× draw ratio with polymer B. Each was of round cross-section. Example 39 contains 3% EVA. The control 38 has no EVA. In this comparison, the flatness of the bond curve is not generally improved but the values of $A_p$, $A_m$, and $A_1$ are higher by about 42 to 37% indicating cross-directional strength increases over the entire temperature range.

Comparison 4

Examples 19, 20, 21 and 22 may be compared to control example 16. All were made to 2.2 dpf (nominally) by using a 1.55× draw ratio with polymer B. All were of round cross-section. Examples 19, 20, 21 and 22 contain a combined 3 to 7% amount of EVA and PE (see Table 2 for specific amounts). The control 16 has no EVA. Performance at lower ranges of temperature is improved as can be seen from reviewing the results in Tables 12–14.

Comparison 5

Example 24 may be compared to control example 26. Each was made to 1.8 dpf (nominally) by using a 1.85× draw ratio with polymer B. Each was of round cross-section. Both were made with hydrophobic finish system "Z". Example 24 contains 3% EVA. The control 26 has no EVA. Improvements may be noted in each range and type of comparison as denoted in Tables 12–14.

Comparison 6

Examples 28, 29 and 30 may be compared to control example 25. All were made to 2.2 dpf (nominally) by using a 1.55× or 1.60× draw ratio with polymer B. All were of round cross-section. Examples 28, 29 and 30 contain 3% EVA. The control 25 has no EVA. These samples were made on larger equipment at higher rates. Improvements may be noted in each range and type of comparison as denoted in Tables 12–14. Enhancement of properties at lower bonding temperatures is evident.

Comparison 7

Examples 44 and 45 may be compared to control example 38. Each was made at similar rates into, nominally, 17.5 gsy fabrics. Example 38 is of round cross-section and contains no EVA bond curve flattening agent. The data are normalized to 20 gsy, similarly to all the other examples. Examples 44 and 45, however, are normalized to 17.5 gsy and represent fabrics of fibers according to the present invention made to a lower basis weight. Examples 44 and 45 each contain 3% of ELVAX®3180 and are concave delta cross-section. Even though basis weight differences of 2.5 gsy typically account for about 50 to 125 g/in differences in cross-directional strength under these bonding conditions (about 140), examples 44 and 45 still exceed the control example 38 in all of the comparative values ($\Delta C$, $\Delta A$ and $\Delta R$), as indicated by the values in Tables 12, 13 and 14. This indicates that cross-directional strength is improved over the entire temperature range and that the bond curves are "flatter" also. Example 46 shows the values when the data of example 45 is normalized to 20 gsy. A 14% increase in each CDS value (in Table 5) is realized.

Comparison 8

Examples 51, 52, 53, 54, 59, 60 and 61 may be compared with control example 58. All were made at similar rates to nominally 1.9 denier using a 1.35× draw ratio. The control contains no polymeric bond curve enhancing agent. The invention examples contain 3% of various ethylene copolymers, as denoted in Tables 1 and 2. Although $\Delta C$ and $\Delta R$ values actually are negative, all the $\Delta A$ values are positive by 14 to 48%, indicating CD strength improvement over the entire temperature range, as seen from the cross-directional strength values in Tables 5, 9 and 10.

Comparison 9

Examples 56 and 57 may be compared to control example 62. Each was made at similar rates into, nominally, 1.9 dpf using a 1.35× draw ratio. Each was of concave delta cross-sectional shape. Examples 56 and 57 were made into about 17.5 gsy fabrics and the cross-directional strength values normalized to 20 gsy basis weight. The control, example 62, was bonded into 19.7 gsy fabrics and normalized to 20 gsy basis weight. Example 56 contains 3% Elvax®3180 and 1,000 ppm of a fluorocarbon processing aid, Dynamar™ FX5920A. Example 57 contains 3% Elvax® 3124 and 500 ppm of Dynamar™ FX5920A. The control, example 62, contains no ethylene vinyl acetate copolymer bond curve enhancing agent nor any processing aid. The ΔC and ΔR values are negative. The ΔA values are positive by 3 to 24%, indicating cross-directional strength improvement over the entire temperature range.

Comparison 10

Example 71 may be compared to control example 50. Each was made on similar equipment into, nominally, 1.9 dpf using a 1.35× draw ratio. Each was made with a round cross-sectional shape. The main difference is in the type of finish used and that Example 71 contains 3% ELVAX®3124 and control Example 50 does not contain any polymeric bond curve flattening agent. The fabric tensile values for Example 71 are high, especially for nonwoven fabric from hydrophobic fiber. Example 71 used finish "W", control 50 used finish "X". The values of $A_p$, $A_m$ and $A_1$ are higher by about 31 to 35% indicating cross-directional strength increase over the entire temperature range.

Comparison 11

Examples 66, 67, 68, and 69, may be compared with control example 65. All were made at similar rates using a 675 hole spinnerette (round cross-section) to nominally 2.2 to 2.5 denier using a 1.35× draw ratio. The control contains no additives. The invention examples contain 3% of various additives (note Tables 1 and 2). The ΔA values are positive by 4 to 18% when the additive is Nylon 6 indicating CDS improvement over the entire temperature range. The ΔA values are negative when the additive is either polyethylene terephthalate or Nylon 66 indicating that not all polymeric additives function as polymeric bond curve enhancing agents.

Comparison 12

Example 70 may be compared to control example 17. Each was made at similar rates into, nominally, 1.9 dpf using a 1.35× draw ratio. Each was made suing a 1068 hole (round cross-section) spinnerette. Example 70 contains 3% Elvax®3124 and 3% Nylon 6. The control 17 contains no polymeric additives. Each ΔC, ΔA, and ΔR value is positive, indicating bond curve enhancement by CDS improvement over the entire temperature range by shifting of the peak temperature maximum and by flattening the curve in general. The ΔA values are shown in Table 13 to increase by 21 to 44%.

Comparison 13

The ΔA values of examples 27, 40, 43, 46, 47, 70, and 71 exceed the best complete set of ΔA values of all the controls. For $\Delta A_p$, the best control value is 6114 from control sample 16. For $\Delta A_m$ and $\Delta A_1$, the best values are 5453 and 7716 from control sample 50. Examples 27, 40, 43, 46, 47 contain 3% ELVAX®3180 or ELVAX®250. Example 71 contains 3% ELVAX®3124 and Example 70 contains 3% ELVAX®3124 and 3% Nylon 6. The values are shown in Table 13.

A much larger group of examples show improvement over the best control when only $\%\Delta A_m$ and $\%\Delta A_1$ are examined. In addition to the examples listed above, examples 13, 18, 21, 22, 27, 37, 39, 41, 45, 52, 53, 55, 56, 59, 60, and 66 also exhibit improved %ΔAm and $\%\Delta A_1$ values.

Although the invention has been described with reference to particular means, materials and embodiments, it is to be understood that the invention is not limited to the particulars disclosed and extends to all equivalents within the scope of the claims.

TABLE 1

POLYMERS

| POLYMER | SUPPLIER | TRADE NAME | TYPE | DENSITY g/cc | % VA | MFR dg/min | MI dg/min | PI* |
|---|---|---|---|---|---|---|---|---|
| A | MONTELL | PROFAX P177 | PP | 0.905 | — | 3.0–5.0 | — | 4.4–5.0 |
| B | MONTELL | PROFAX P165 | PP | 0.905 | — | 8.5–10.5 | — | 4.6–5.2 |
| C | MONTELL | PROFAX P128 | PP | 0.905 | — | 11.5–14.5 | — | 4.1–4.7 |
| D | MONTELL | PROFAX P182 | PP | 0.905 | — | 16.5–20.5 | — | 4.4–5.0 |
| E | DUPONT | ELVAX 250 | EVA | 0.951 | 28 | — | 25 | — |
| F | DUPONT | ELVAX 150 | EVA | 0.957 | 33 | — | 43 | — |
| G | DUPONT | ELVAX 4260 | EVA | 0.95 | 28 | — | 6.0 | — |
| H | DOW | 6835A | PE | 0.95 | — | — | 17 | — |
| I | DOW | XU58200.03 | PE | 0.91 | — | — | 28 | — |
| J | DOW | XU58200.02 | PE | 0.87 | — | — | 30 | — |
| K | DUPONT | ELVAX 3180 | EVA | 0.951 | 28 | — | 25 | — |
| L | DUPONT | NUCREL 925 | EMA | 0.97 | — | — | 21 | — |
| M | DUPONT | ELVAX 750 | EVA | 0.93 | 9 | — | 7 | — |
| N | DUPONT | ELVALOY AM | EA | — | — | | 12 | |
| O | SHELL | KRATON G1750 | $H_2$-EP | 0.86 | — | NA | 7.5 | — |
| P | DUPONT | ELVAX 3124 | EVA | 0.93 | 9 | — | 7 | — |
| Q | NORTH SEA OIL | NYLON 6 | PA | 1.26 | — | — | — | — |
| R | NORTH SEA OIL | NYLON 66 | PA | 1.23 | — | — | — | — |
| S | NORTH SEA OIL | POLYESTER | PET | 1.34 | — | — | — | — |

*POLYDISPERSITY INDEX (PI) IS DETERMINED FROM RHEOMETRICS DATA

TABLE 2

| | | | | COMPOSITIONS (BY WEIGHT) | | | | | |
|---|---|---|---|---|---|---|---|---|---|
| EXAMPLE | PP | wt. % PP | AGENT 1 | wt. % AGENT 1 | AGENT 2 | WT. % AGENT 2 | STABILIZER | ANTACID | PIGMENT |
| 1 | C | 89.8 | E | 10 | — | — | 0.05 | 0.050 | 0.063 |
| 2 | C | 94.9 | E | 5 | — | — | 0.05 | 0.025 | 0.063 |
| 3 | B | 94.9 | E | 5 | — | — | 0.05 | 0.025 | 0.063 |
| 4 | A | 94.9 | E | 5 | — | — | 0.00 | 0.025 | 0.063 |
| 5 | A | 94.9 | E | 5 | — | — | 0.00 | 0.025 | 0.063 |
| 6 | A/D | 72.9/20 | E | 7 | — | — | 0.00 | 0.025 | 0.063 |
| 7 | B | 94.9 | E | 5 | — | — | 0.05 | 0.025 | 0.063 |
| 8 | B | 94.9 | F | 5 | — | — | 0.05 | 0.025 | 0.063 |
| 9 | B | 94.9 | E | 5 | — | — | 0.05 | 0.025 | 0.063 |
| 10 | B | 96.9 | E | 3 | — | — | 0.05 | 0.025 | 0.063 |
| 11 | B | 94.9 | E | 5 | — | — | 0.05 | 0.025 | 0.063 |
| 12 | B | 96.9 | E | 3 | — | — | 0.05 | 0.025 | 0.063 |
| 13 | B | 96.9 | E | 3 | — | — | 0.05 | 0.025 | 0.063 |
| 14 | B | 96.8 | E | 3 | — | — | 0.05 | 0.050 | 0.063 |
| 15 | B | 94.9 | G | 5 | — | — | 0.05 | 0.025 | 0.063 |
| C-16 | B | 99.9 | — | — | — | — | 0.05 | 0.025 | 0.063 |
| C-17 | B | 99.9 | — | — | — | — | 0.05 | 0.025 | 0.063 |
| 18 | B | 96.9 | E | 3 | — | — | 0.05 | 0.025 | 0.063 |
| 19 | B | 96.9 | E | 1 | I | 2 | 0.05 | 0.025 | 0.063 |
| 20 | B | 92.9 | E | 2.3 | I | 4.7 | 0.05 | 0.025 | 0.063 |
| 21 | B | 93.9 | E | 2 | J | 4 | 0.05 | 0.025 | 0.063 |
| 22 | B | 92.9 | E | 2.3 | H | 4.7 | 0.05 | 0.025 | 0.063 |
| 23 | B | 96.9 | E | 3 | — | — | 0.05 | 0.025 | 0.063 |
| 24 | B | 96.9 | E | 3 | — | — | 0.05 | 0.025 | 0.063 |
| C-25 | B | 99.8 | — | — | — | — | 0.05 | 0.100 | 0.075 |
| C-26 | B | 99.8 | — | — | — | — | 0.05 | 0.100 | 0.075 |
| 27 | B | 96.9 | E | 3 | — | — | 0.05 | 0.025 | 0.063 |
| 28 | B | 96.9 | E | 3 | — | — | 0.05 | 0.025 | 0.063 |
| 29 | B | 96.9 | E | 3 | — | — | 0.05 | 0.025 | 0.063 |
| 30 | B | 96.9 | E | 3 | — | — | 0.05 | 0.025 | 0.063 |
| 31 | B | 96.9 | E | 3 | — | — | 0.00 | 0.025 | 0.063 |
| 32 | B | 96.9 | E | 3 | — | — | 0.00 | 0.025 | 0.063 |
| 33 | B | 96.9 | E | 3 | — | — | 0.00 | 0.025 | 0.063 |
| C-34 | B | 99.8 | — | — | — | — | 0.05 | 0.100 | 0.100 |
| 35 | B | 96.8 | E | 3 | — | — | 0.05 | 0.100 | 0.100 |
| C-36 | B | 99.8 | — | — | — | — | 0.05 | 0.100 | 0.100 |
| 37 | B | 96.8 | E | 3 | — | — | 0.05 | 0.100 | 0.100 |
| C-38 | B | 99.8 | — | — | — | — | 0.05 | 0.100 | 0.100 |
| 39 | B | 96.8 | E | 3 | — | — | 0.05 | 0.100 | 0.100 |
| 40 | B | 96.9 | K | 3 | — | — | 0.05 | 0.00 | 0.063 |
| 41 | B | 96.9 | K | 3 | — | — | 0.05 | 0.30 | 0.063 |
| 42 | B | 96.9 | K | 3 | — | — | 0.05 | 0.30 | 0.063 |
| 43 | B | 96.9 | K | 3 | — | — | 0.01 | 0.05 | 0.075 |
| 44 | B | 96.9 | K | 3 | — | — | 0.01 | 0.05 | 0.075 |
| 45 | B | 96.9 | K | 3 | — | — | 0.01 | 0.05 | 0.075 |
| 46 | B | 96.9 | K | 3 | — | — | 0.01 | 0.05 | 0.075 |
| 47 | B | 96.9 | K | 3 | — | — | 0.01 | 0.05 | 0.075 |
| 48 | B | 96.9 | K | 3 | — | — | 0.01 | 0.05 | 0.075 |
| 49 | B | 96.9 | K | 3 | — | — | 0.01 | 0.05 | 0.075 |
| C-50 | B | 99.8 | — | — | — | — | 0.05 | 0.10 | 0.100 |
| 51 | B | 96.9 | M | 3 | — | — | 0.05 | 0.05 | 0.06 |
| 52 | B | 96.9 | L | 3 | — | — | 0.05 | 0.05 | 0.06 |
| 53 | B | 96.9 | N | 3 | — | — | 0.05 | 0.05 | 0.06 |
| 54 | B | 96.9 | O | 3 | — | — | 0.05 | 0.05 | 0.06 |
| 55[1] | B | 99.8 | — | — | — | — | 0.05 | 0.05 | 0.06 |
| 56[2] | B | 96.9 | E | 3 | — | — | 0.01 | 0.05 | 0.05 |
| 57[3] | B | 96.9 | P | 3 | — | — | 0.00 | 0.02 | 0.05 |
| C-58 | B | 99.9 | — | — | — | — | 0.01 | 0.05 | 0.075 |
| 59 | B | 96.9 | H | 3 | — | — | 0.01 | 0.05 | 0.075 |
| 60 | B | 96.9 | E | 3 | — | — | 0.01 | 0.05 | 0.075 |
| 61 | B | 96.9 | I | 3 | — | — | 0.01 | 0.05 | 0.075 |
| C-62 | B | 99.9 | — | — | — | — | 0.01 | 0.05 | 0.075 |
| 63 | B | 89.7 | J | 10 | — | — | 0.05 | 0.10 | 0.10 |
| 64 | B | 89.7 | J | 10 | — | — | 0.05 | 0.10 | 0.10 |
| C-65 | B | 99.9 | — | — | — | — | 0.05 | 0.05 | 0.065 |
| 66 | B | 96.9 | Q | 3 | — | — | 0.05 | 0.05 | 0.065 |
| 67 | B | 96.9 | R | 3 | — | — | 0.05 | 0.05 | 0.065 |
| 68 | B | 96.9 | S | 3 | — | — | 0.05 | 0.05 | 0.065 |

TABLE 2-continued

COMPOSITIONS (BY WEIGHT)

| EXAMPLE | PP | wt. % PP | AGENT 1 | wt. % AGENT 1 | AGENT 2 | WT. % AGENT 2 | STABILIZER | ANTACID | PIGMENT |
|---|---|---|---|---|---|---|---|---|---|
| 69 | B | 96.9 | Q | 3 | — | — | 0.05 | 0.05 | 0.065 |
| 70 | B | 93.9 | P | 3 | Q | 3 | 0.05 | 0.05 | 0.065 |
| 71 | B | 96.9 | P | 3 | — | — | 0.0 | 0.02 | 0.05 |
| C-72 | C | 89.9 | E | 10 | — | — | 0.2 | 0.00 | 0.00 |

[1]Example 55 includes 0.5 wt. % Hydrobrite 550 PO oil (available from Witco Corporation, Greenswich, Connecticutt)
[2]Example 56 includes 0.10 wt. % Dynamar ™ FX5920A (available from 3M, Specialty Fluoropolymers Dept., St. Paul, MN)
[3]Example 57 includes 0.05 wt. % Dynamar ™ FX5920A (available from 3M, Specialty Fluoropolymers Dept., ST. Paul, MN)

TABLE 3

PROCESS CONDITIONS - FIBER DENIERS

| EX. | SPIN TEMP (° C.) | SPIN ID[1] | CROSS BLOW BLOCKED (mm) | THROUGHPUT[3] (g/min/hole) | TAKE-UP RATE (m/min) | SPIN DPF (g/9000 m) | DRAW RATIO | STAPLE DPF (g/9000 m) | DENIER DRAW RATIO[2] |
|---|---|---|---|---|---|---|---|---|---|
| 1 | 303 | 1 | 25 | 0.31 | 770 | 3.6 | 1.52 | 3.0 | 1.20 |
| 2 | 315 | 1 | 25 | 0.27 | 900 | 2.7 | 1.54 | 2.3 | 1.20 |
| 3 | 315 | 1 | 25 | 0.27 | 900 | 2.7 | 1.53 | 2.1 | 1.29 |
| 4 | 315 | 1 | 25 | 0.27 | 900 | 2.7 | 1.55 | 2.1 | 1.28 |
| 5 | 315 | 1 | 25 | 0.27 | 900 | 2.7 | 1.53 | 2.2 | 1.25 |
| 6 | 315 | 1 | 25 | 0.27 | 900 | 2.7 | 1.53 | 2.2 | 1.24 |
| 7 | 296 | 2 | 25 | 0.23 | 765 | 2.7 | 1.55 | 2.1 | 1.27 |
| 8 | 310 | 2 | 25 | 0.26 | 850 | 2.7 | 1.53 | 2.2 | 1.21 |
| 9 | 295 | 3 | 25 | 0.26 | 850 | 2.8 | 1.54 | 2.4 | 1.15 |
| 10 | 295 | 3 | 25 | 0.26 | 850 | 2.8 | 1.55 | 2.3 | 1.21 |
| 11 | 300 | 2 | 25 | 0.27 | 900 | 2.7 | 1.56 | 2.2 | 1.23 |
| 12 | 300 | 2 | 25 | 0.27 | 900 | 2.7 | 1.54 | 2.3 | 1.21 |
| 13 | 295 | 4 | 25 | 0.23 | 900 | 2.3 | 1.35 | 2.1 | 1.08 |
| 14 | 300 | 2 | 25 | 0.26 | 850 | 2.7 | 1.53 | 2.4 | 1.15 |
| 15 | 300 | 2 | 25 | 0.31 | 900 | 3.1 | 1.54 | 2.4 | 1.27 |
| C-16 | 295 | 2 | 25 | 0.27 | 900 | 2.7 | 1.55 | 2.2 | 1.21 |
| C-17 | 295 | 2 | 25 | 0.23 | 900 | 2.3 | 1.36 | 2.0 | 1.15 |
| 18 | 295 | 2 | 25 | 0.23 | 900 | 2.2 | 1.34 | 2.0 | 1.12 |
| 19 | 295 | 2 | 25 | 0.27 | 900 | 2.7 | 1.55 | 2.4 | 1.17 |
| 20 | 295 | 2 | 25 | 0.27 | 900 | 2.7 | 1.55 | 2.3 | 1.17 |
| 21 | 295 | 2 | 25 | 0.27 | 900 | 2.7 | 1.56 | 1.9 | 1.42 |
| 22 | 295 | 2 | 25 | 0.27 | 900 | 2.7 | 1.55 | 1.9 | 1.42 |
| 23 | 305 | 2 | 20 | 0.31 | 1130 | 2.5 | 1.35 | 2.2 | 1.14 |
| 24 | 305 | 2 | 20 | 0.31 | 1130 | 2.5 | 1.85 | 1.8 | 1.39 |
| C-25 | 297 | 7 | 25 | 0.35 | 1100 | 2.9 | 1.55 | 2.2 | 1.32 |
| C-26 | 305 | 2 | 25 | 0.32 | 1100 | 2.6 | 1.90 | 1.8 | 1.44 |
| 27 | 305 | 2 | 20 | 0.34 | 1130 | 2.7 | 1.40 | 2.2 | 1.23 |
| 28 | 305 | 2 | 20 | 0.34 | 1130 | 2.7 | 1.40 | 2.2 | 1.23 |
| 29 | 305 | 2 | 20 | 0.34 | 1130 | 2.7 | 1.40 | 2.2 | 1.23 |
| 30 | 305 | 2 | 20 | 0.34 | 1130 | 2.7 | 1.40 | 2.2 | 1.23 |
| 31 | 300 | 2 | 20 | 0.32 | 949 | 3.0 | 1.60 | 2.3 | 1.30 |
| 32 | 300 | 2 | 20 | 0.32 | 949 | 3.0 | 1.60 | 2.3 | 1.30 |
| 33 | 300 | 2 | 20 | 0.32 | 949 | 3.0 | 1.60 | 2.3 | 1.30 |
| C-34 | 300 | 4 | 20 | 0.30 | 1220 | 2.2 | 1.40 | 2.1 | 1.05 |
| 35 | 300 | 4 | 20 | 0.30 | 1220 | 2.2 | 1.40 | 2.2 | 1.00 |
| C-36 | 300 | 5 | 10 | 0.30 | 1220 | 2.2 | 1.40 | 2.1 | 1.05 |
| 37 | 300 | 5 | 10 | 0.30 | 1220 | 2.2 | 1.40 | 1.9 | 1.16 |
| C-38 | 300 | 2 | 20 | 0.30 | 1220 | 2.2 | 1.40 | 1.9 | 1.16 |
| 39 | 300 | 2 | 20 | 0.30 | 1220 | 2.2 | 1.40 | 2.1 | 1.05 |
| 40 | 295 | 2 | 25 | 0.22 | 900 | 2.2 | 1.35 | 1.9 | 1.16 |
| 41 | 295 | 2 | 25 | 0.22 | 900 | 2.2 | 1.35 | 1.9 | 1.16 |
| 42 | 310 | 2 | 25 | 0.22 | 900 | 2.2 | 1.35 | 1.9 | 1.16 |
| 43 | 300 | 5 | 16 | 0.31 | 1220 | 2.3 | 1.35 | 2.0 | 1.15 |
| 44 | 300 | 5 | 16 | 0.31 | 1220 | 2.3 | 1.35 | 2.0 | 1.15 |
| 45 | 295 | 5 | 16 | 0.31 | 1226 | 2.3 | 1.35 | 2.0 | 1.17 |
| 46 | 295 | 5 | 16 | 0.31 | 1226 | 2.3 | 1.35 | 2.0 | 1.17 |
| 47 | 295 | 5 | 16 | 0.31 | 1226 | 2.3 | 1.35 | 2.0 | 1.17 |
| 48 | 295 | 5 | 16 | 0.31 | 1226 | 2.3 | 1.35 | 2.1 | 1.12 |
| 49 | 300 | 2 | 20 | 0.31 | 1226 | 2.3 | 1.35 | 2.2 | 1.06 |
| C-50 | 300 | 2 | 20 | 0.31 | 1226 | 2.3 | 1.35 | 2.0 | 1.15 |
| 51 | 305 | 2 | 25 | 0.22 | 900 | 2.2 | 1.35 | 1.9 | 1.16 |
| 52 | 300 | 2 | 25 | 0.27 | 900 | 2.7 | 1.55 | 2.0 | 1.35 |
| 53 | 300 | 2 | 25 | 0.22 | 900 | 2.2 | 1.35 | 1.9 | 1.16 |
| 54 | 300 | 2 | 25 | 0.22 | 900 | 2.2 | 1.35 | 1.9 | 1.16 |

TABLE 3-continued

PROCESS CONDITIONS - FIBER DENIERS

| EX. | SPIN TEMP (° C.) | SPIN ID[1] | CROSS BLOW BLOCKED (mm) | THROUGHPUT[3] (g/min/hole) | TAKE-UP RATE (m/min) | SPIN DPF (g/9000 m) | DRAW RATIO | STAPLE DPF (g/9000 m) | DENIER DRAW RATIO[2] |
|---|---|---|---|---|---|---|---|---|---|
| 55 | 300 | 2 | 25 | 0.22 | 900 | 2.2 | 1.35 | 1.9 | 1.16 |
| 56 | 300 | 5 | 13 | 0.22 | 850 | 2.3 | 1.35 | 2.2 | 1.05 |
| 57 | 300 | 5 | 13 | 0.22 | 850 | 2.3 | 1.35 | 1.9 | 1.21 |
| C-58 | 300 | 2 | 18 | 0.22 | 900 | 2.2 | 1.35 | 1.9 | 1.15 |
| 59 | 300 | 2 | 18 | 0.22 | 900 | 2.2 | 1.35 | 2.0 | 1.10 |
| 60 | 300 | 2 | 18 | 0.22 | 900 | 2.2 | 1.35 | 2.1 | 1.04 |
| 61 | 300 | 2 | 18 | 0.22 | 900 | 2.2 | 1.35 | 2.1 | 1.04 |
| C-62 | 300 | 4 | 18 | 0.22 | 900 | 2.2 | 1.35 | 2.1 | 1.04 |
| 63 | 305 | 2 | 25 | 0.22 | 800 | 2.5 | 1.25 | 2.3 | 1.07 |
| 64 | 310 | 2 | 25 | 0.22 | 800 | 2.5 | 1.25 | 2.3 | 1.10 |
| C-65 | 295 | 6 | 25 | 0.27 | 900 | 2.7 | 1.35 | 2.5 | 1.09 |
| 66 | 280 | 6 | 25 | 0.27 | 900 | 2.7 | 1.35 | 2.5 | 1.08 |
| 67 | 280 | 6 | 25 | 0.27 | 900 | 2.7 | 1.35 | 2.5 | 1.06 |
| 68 | 306 | 6 | 25 | 0.26 | 900 | 2.6 | 1.35 | 2.2 | 1.20 |
| 69 | 300 | 6 | 25 | 0.28 | 900 | 2.8 | 1.35 | 2.6 | 1.07 |
| 70 | 300 | 2 | 25 | 0.23 | 900 | 2.3 | 1.35 | 2.1 | 1.10 |
| 71 | 305 | 2 | 20 | 0.24 | 943 | 2.3 | 1.35 | 2.0 | 1.15 |
| C-72 | 280 | 6 | 0 | 0.38 | 762 | 4.5 | 1.65 | 3.4 | 1.32 |

[1]See Table 8
[2]Denier Draw Ratio = Spin DPF/Staple DPF
[3]Throughput = (dpf × no. of holes in spinnerette) × Take up rate / 9000
(Take up rate = Speed of godet roll in m/min)

TABLE 4

FIBER PROPERTIES

| EX. | MFR with quench delay (dg/min) | Gc | MFR w/out quench delay (dg/min) | % Inc. MFR | MICRO-FUSION RESIDUE[4] | FINISH TYPE | FINISH % | CROSS-SECTION SHAPE | FINENESS (g/9000 m) | TENAC-ITY (g/denier) | ELONG. (%) | CPI | CO-HESION |
|---|---|---|---|---|---|---|---|---|---|---|---|---|---|
| 1 | 24.2 | 219906 | 19.5 | 24 | P | Y | 0.56 | ROUND | 3.0 | 1.77 | 405 | 30.7 | 3.9 |
| 2 | 44.7 | 240688 | 22.9 | 95 | F | Y | 0.63 | ROUND | 2.3 | 1.91 | 322 | 30.9 | 5.3 |
| 3 | 32.0 | 233503 | 16.9 | 89 | F | Y | 0.62 | ROUND | 2.1 | 2.01 | 340 | 24.6 | 4.4 |
| 4 | 28.6 | 252132 | 15.2 | 88 | F | Y | 0.45 | ROUND | 2.1 | 2.36 | 288 | 26.4 | 6.3 |
| 5 | 23.1 | 241277 | 14.7 | 57 | F | X | 0.67 | ROUND | 2.2 | 2.32 | 324 | 29.8 | 5.5 |
| 6 | 21.4 | 233332 | | | F | X | 0.61 | ROUND | 2.2 | 2.15 | 351 | 23.7 | 5.1 |
| 7 | 31.1 | | | | G | X | 0.68 | ROUND | 2.1 | 3.80 | 364 | 31.9 | 8.2 |
| 8 | 35.2 | | | | F | X | 0.65 | ROUND | 2.2 | 1.79 | 334 | 32.7 | 7.9 |
| 9 | 40.4 | 214265 | 16.3 | 148 | F/G | X | 0.58 | C.D.[5] | 2.4 | 1.75 | 379 | 29.7 | 5.0 |
| 10 | 36.7 | 221146 | 13.6 | 170 | G | X | 0.56 | C.D. | 2.3 | 1.86 | 390 | 25.6 | 3.8 |
| 11 | 27.0 | | 19.4 | 39 | | X | 0.71 | ROUND | 2.2 | 1.90 | 376 | 37.9 | 5.9 |
| 12 | 27.7 | 225034 | 16.2 | 71 | | X | 0.65 | ROUND | 2.3 | 1.86 | 345 | 28.4 | 6.0 |
| 13 | 29.6 | | 11.5 | 157 | F/G | X | 0.75 | C.D. | 2.1 | 1.76 | 376 | 27.6 | 6.9 |
| 14 | 25.0 | 232419 | 13.4 | 87 | F | X | 0.66 | ROUND | 2.4 | 1.82 | 336 | 30.7 | |
| 15 | 19.0 | 213161 | 14.1 | 35 | | X | 0.71 | ROUND | 2.4 | 1.84 | 328 | 31.8 | |
| C16 | 25.0 | | 12.1 | 107 | | X | 0.73 | ROUND | 2.2 | 2.14 | 401 | 22.1 | |
| C17 | 26.0 | | | | | X | 0.85 | ROUND | 2.0 | 1.86 | 403 | 27.4 | |
| 18 | 24.0 | | 11.5 | 109 | F/G | X | 0.61 | ROUND | 2.0 | 1.84 | 414 | 27.5 | |
| 19 | 24.0 | | 11.3 | 112 | | X | 0.62 | ROUND | 2.4 | 1.96 | 394 | 30.4 | |
| 20 | 24.0 | | 12.0 | 100 | | X | 0.66 | ROUND | 2.3 | 1.88 | 365 | 30.2 | |
| 21 | 31.0 | | 14.0 | 121 | | X | 0.55 | ROUND | 2.2 | 1.85 | 364 | 27.1 | |
| 22 | 25.0 | | | | | X | 0.54 | ROUND | 2.2 | 1.85 | 412 | 27.2 | 5.1 |
| 23 | 28.0 | 235710 | 14.0 | 100 | | Z | 0.52 | ROUND | 2.2 | | | | |
| 24 | 28.0 | 235710 | 14.0 | 100 | | Z | 0.27 | ROUND | 1.8 | 2.32 | 361 | | |
| C25 | (32.0) | | (16) | (100) | (F/G) | X | (0.6) | ROUND | (2.2) | | (350) | | |
| C26 | (32.0) | | (16) | (100) | (F/G) | Z | (0.3) | ROUND | (1.8) | | | | |
| 27 | 25.5 | | | | F/G | X | 0.62 | ROUND | 2.3 | 1.94 | 436 | 18.6 | 5.2 |
| 28 | 25.5 | | | | F/G | X | 0.62 | ROUND | 2.2 | 1.86 | 382 | 23.3 | 7.1 |
| 29 | 25.5 | | | | F/G | X | 0.62 | ROUND | 2.3 | 1.90 | 356 | 19.2 | 9.6 |
| 30 | 25.5 | | | | F/G | X | 0.62 | ROUND | 2.3 | 1.82 | 356 | 23.3 | 5.2 |
| 31 | | | | | F/G | Y | | ROUND | | | | | 5.0 |
| 32 | | | | | F/G | Y | | ROUND | | | | | |
| 33 | | | | | F/G | Y | | ROUND | | | | | |
| C34 | 32.3 | 238449 | 24.6 | 31 | F | X | 0.53 | C.D. | 2.1 | 2.02 | 310 | 27.6 | 6.4 |
| 35 | 34.0 | 235277 | 22.2 | 53 | P | X | 0.55 | C.D. | 2.2 | 1.99 | 327 | 27.2 | 5.6 |
| C36 | 39.7 | 234264 | 24.6 | 61 | G | X | 0.81 | C.D. | 2.1 | 1.82 | 309 | 30.7 | 6.5 |

TABLE 4-continued

FIBER PROPERTIES

| EX. | MFR with quench delay (dg/min) | Gc | MFR w/out quench delay (dg/min) | % Inc. MFR | MICRO-FUSION RESIDUE[4] | FINISH TYPE | FINISH % | CROSS-SECTION SHAPE | FINENESS (g/9000 m) | TENAC-ITY (g/denier) | ELONG. (%) | CPI | CO-HESION |
|---|---|---|---|---|---|---|---|---|---|---|---|---|---|
| 37 | 36.7 | 226518 | 22.2 | 65 | F | X | 0.68 | C.D. | 1.9 | 1.90 | 361 | 32.6 | 4.8 |
| C38 | 31.8 | 240230 | 24.6 | 29 | G | X | 0.39 | ROUND | 1.9 | 2.07 | 338 | 25.5 | 6.1 |
| 39 | 26.1 | 227986 | 22.2 | 18 | P | X | 0.52 | ROUND | 2.1 | 1.91 | 352 | 24.7 | 5.1 |
| 40 | 24.4 | | — | — | G | X | 0.56 | ROUND | 1.9 | 1.88 | 430 | 26.9 | 4.4 |
| 41 | 22.1 | | 11.5 | 96 | — | X | 0.68 | ROUND | 1.9 | 1.87 | 471 | 24.8 | 4.7 |
| 42 | 39.5 | | 14.1 | 180 | G | X | 0.58 | ROUND | 1.9 | 1.62 | 366 | 26.3 | 4.2 |
| 43 | 36.2 | 223726 | 22.9 | 58 | F/G | X | 0.75 | C.D. | 2.0 | 1.92 | 319 | 23.4 | 4.4 |
| 44 | 36.2 | 223726 | 22.9 | 58 | F/G | X | 0.75 | C.D. | 2.0 | 1.92 | 319 | 23.4 | 4.4 |
| 45 | 34.5 | | 25.0 | 38 | F | Y | 0.60 | C.D. | 2.0 | 2.04 | 326 | 22.2 | 3.0 |
| 46 | 34.5 | | 25.0 | 38 | F | Y | 0.60 | C.D. | 2.0 | 2.04 | 326 | 22.2 | 3.0 |
| 47 | 34.5 | | 25.0 | 38 | F | Y | 0.60 | C.D. | 2.0 | 2.04 | 326 | 22.2 | 3.0 |
| 48 | 34.5 | | 25.0 | 38 | F | Y | 0.68 | C.D. | 2.1 | 1.84 | 293 | 26.3 | 4.0 |
| 49 | 29.5 | | 19.0 | 38 | F | Y | 0.59 | ROUND | 2.2 | 1.85 | 504 | 26.0 | 5.2 |
| C50 | (35) | | (17) | (106) | | X | 0.60 | ROUND | (2.0) | (1.9) | (350) | 24 | 6.8 |
| 51 | 31.0 | — | — | — | | X | 0.68 | ROUND | 1.9 | 1.72 | 368 | 26.7 | — |
| 52 | 23.7 | — | — | — | | X | 0.69 | ROUND | 2.0 | 1.80 | 373 | 25.6 | — |
| 53 | 25.2 | — | — | — | | X | 0.88 | ROUND | 1.9 | 1.51 | 560 | 21.7 | — |
| 54 | 24.5 | | | — | | X | 0.89 | ROUND | 1.9 | 1.75 | 517 | 26 | — |
| 55 | 31.0 | | | — | | X | 0.98 | ROUND | 1.9 | 1.73 | 349 | 27 | — |
| 56 | 39.2 | 254080 | 18.1 | 117 | G | Y | 0.65 | C.D. | 2.2 | 1.75 | 368 | 26.9 | 7.6 |
| 57 | 39.0 | | 18.7 | 108 | G | Y | 0.55 | C.D. | 1.9 | 1.73 | 347 | 24.5 | 5.4 |
| C58 | 39.9 | | 14.9 | 168 | G | X | 0.49 | ROUND | 1.9 | 1.82 | 370 | 25.8 | 4.4 |
| 59 | 40.1 | | 14.0 | 186 | G | X | 0.51 | ROUND | 2.0 | 1.73 | 414 | 26.0 | 4.4 |
| 60 | 37.4 | | 13.9 | 169 | G | X | 0.52 | ROUND | 2.1 | 1.68 | 569 | 27.6 | 3.9 |
| 61 | 35.7 | | 14.2 | 151 | G | X | 0.58 | ROUND | 2.1 | 1.68 | 632 | 23.6 | 4.1 |
| C62 | 58.6 | | 16.2 | 262 | G | X | 0.42 | C.D. | 2.1 | 1.63 | 594 | 24.0 | 3.6 |
| 63 | 39.0 | | 15.4 | 153 | G | X | 0.78 | ROUND | 2.3 | 1.40 | 428 | 29.6 | — |
| 64 | 48.0 | | 18.8 | 155 | G | X | 0.54 | ROUND | 2.3 | 1.45 | 410 | 35.5 | 3.67 |
| C65 | 30.8 | | | | | X | 0.71 | ROUND | 2.5 | 1.69 | 399 | 31.1 | 6.3 |
| 66 | 36.3 | | | | G | X | 0.81 | ROUND | 2.5 | 1.67 | 397 | 27.0 | 6.3 |
| 67 | NA | | | | G | X | 0.87 | ROUND | 2.5 | 1.65 | 393 | 30.2 | — |
| 68 | 26.9 | | | | P | X | 0.71 | ROUND | 2.2 | 1.99 | 340 | 27.3 | 4.9 |
| 69 | 35.9 | | | | G | X | 0.71 | ROUND | 2.5 | 1.66 | 401 | 29.9 | 6.1 |
| 70 | 31.6 | — | — | | P | X | 0.70 | ROUND | 2.1 | 1.72 | 501 | 25.3 | 4.5 |
| 71 | 39.0 | — | 23 | 70 | G | W | 0.25 | ROUND | 2.2 | | 418 | 23.1 | — |
| C72 | — | — | 15.7 | — | — | X | 0.60 | ROUND | 3.4 | 1.91 | 397 | 25.0 | — |

[4]Microdiffusion residue: P = Poor, F = Fair, G = Good, F/G = Fair to Good
[5]C.D. = CONCAVE DELTA
Values in parenthesis indicate nominal values for standard product fiber

TABLE 5

NORMALIZED CROSS-DIRECTIONAL STRENGTH (CDS) (g/in)

| EX. | ACTUAL AVERAGE FABRIC WEIGHT (g/yd$^2$) | CDS @ 148° C. (g/in) | CDS @ 151° C. (g/in) | CDS @ 154° C. (g/in) | CDS @ 157° C. (g/in) | CDS @ 160° C. (g/in) | CDS @ 163° C. (g/in) | CDS @ 166° C. (g/in) | CDS @ 169° C. (g/in) | CDS @ 172° C. (g/in) |
|---|---|---|---|---|---|---|---|---|---|---|
| 1 | 20.0 | 95 | 116 | 207 | 259 | 354 | 307 | 293 | 288 | 293 |
| 2 | 19.8 | 388 | 398 | 416 | 418 | 339 | 266 | 249 | 258 | 229 |
| 3 | 20.0 | 305 | 463 | 496 | 484 | 506 | 497 | 438 | 426 | 404 |
| 4 | 19.9 | 365 | 515 | 515 | 542 | 503 | 483 | 400 | 456 | 415 |
| 5 | 20.4 | 342 | 416 | 423 | 472 | 541 | 549 | 489 | 480 | 442 |
| 6 | 20.3 | 369 | 409 | 512 | 520 | 505 | 453 | 540 | 539 | 506 |
| 7 | 19.9 | 358 | 481 | 467 | 418 | 482 | 464 | 418 | 371 | 404 |
| 8 | 20.4 | 319 | 352 | 324 | 319 | 370 | 393 | 320 | 314 | 247 |
| 9 | 20.0 | 385 | 470 | 427 | 484 | 506 | 482 | 468 | 437 | 448 |
| 10 | 19.9 | 466 | 514 | 541 | 531 | 533 | 536 | 544 | 535 | 472 |
| 11 | | | | | | | | | | |
| 12 | 20.7 | 353 | 461 | 519 | 510 | 544 | 451 | 516 | 517 | 405 |
| 13 | 20.1 | 416 | 464 | 518 | 580 | 542 | 562 | 551 | 541 | 525 |
| 14 | 19.6 | 297 | 398 | 488 | 486 | 468 | 427 | 446 | 435 | — |
| 15 | | | | | | | | | | |
| C16 | 20.1 | 145 | 173 | 354 | 347 | 504 | 525 | 612 | 578 | 517 |
| C17 | 20.7 | 203 | 349 | 451 | 530 | 562 | 603 | 547 | 563 | 530 |
| 18 | 20.1 | 402 | 504 | 577 | 642 | 608 | 600 | 659 | 549 | 574 |

TABLE 5-continued

NORMALIZED CROSS-DIRECTIONAL STRENGTH (CDS) (g/in)

| EX. | ACTUAL AVERAGE FABRIC WEIGHT (g/yd$^2$) | CDS @ 148° C. (g/in) | CDS @ 151° C. (g/in) | CDS @ 154° C. (g/in) | CDS @ 157° C. (g/in) | CDS @ 160° C. (g/in) | CDS @ 163° C. (g/in) | CDS @ 166° C. (g/in) | CDS @ 169° C. (g/in) | CDS @ 172° C. (g/in) |
|---|---|---|---|---|---|---|---|---|---|---|
| 19 | 20.6 | 268 | 293 | 402 | 480 | 466 | 511 | 492 | 464 | — |
| 20 | 20.1 | 272 | 360 | 470 | 484 | 493 | 451 | 465 | 420 | 402 |
| 21 | 20.1 | 459 | 516 | 573 | 556 | 629 | 493 | 508 | 411 | 449 |
| 22 | 20.9 | 356 | 426 | 527 | 560 | 578 | 520 | 531 | 482 | 465 |
| 23 | 20.9 | 246 | 272 | 356 | 409 | 440 | 409 | 428 | 375 | 342 |
| 24 | 20.1 | 177 | 208 | 259 | 330 | 372 | 430 | 354 | 357 | 367 |
| C25 | 20.9 | | 285 | 346 | 304 | 450 | 467 | 423 | 344 | 299 |
| C26 | 19.7 | | | | 172 | 260 | 249 | 290 | 267 | 238 |
| 27 | 20.4 | 386 | 569 | 594 | 680 | 677 | 757 | 542 | 561 | — |
| 28 | 20.8 | 404 | 389 | 503 | 471 | 561 | 542 | 554 | 470 | — |
| 29 | 21.4 | 293 | 475 | 476 | 405 | 480 | 435 | 409 | 463 | — |
| 30 | 20.2 | 365 | 394 | 506 | 502 | 535 | 498 | 492 | 423 | — |
| 31 | | | | | | | | | | |
| 32 | | | | | | | | | | |
| 33 | | | | | | | | | | |
| C34 | 16.9 | 276 | 320 | 474 | 518 | 515 | 570 | 471 | 492 | — |
| 35 | 16.7 | 386 | 492 | 510 | 540 | 560 | 471 | 502 | 449 | — |
| C36 | 16.7 | 357 | 473 | 418 | 534 | 517 | 439 | 519 | 440 | — |
| 37 | 18.1 | 463 | 584 | 535 | 600 | 629 | 615 | 594 | 573 | — |
| C38 | 16.7 | 303 | 379 | 443 | 472 | 462 | 415 | 412 | 450 | — |
| 39 | 17.3 | 442 | 532 | 601 | 597 | 585 | 604 | 564 | 625 | — |
| 40 | 20.2 | 363 | 536 | 602 | 646 | 690 | 633 | 651 | 692 | — |
| 41 | 20.1 | 300 | 445 | 548 | 572 | 680 | 610 | 618 | 613 | — |
| 42 | 20.2 | 427 | 532 | 434 | 572 | 509 | 574 | 530 | 550 | 481 |
| 43 | 18.2 | 509 | 612 | 641 | 682 | 552 | 672 | 631 | 539 | 512 |
| 44** | 15.6 | 452 | 482 | 520 | 534 | 467 | 456 | 488 | 464 | 414 |
| 45** | 17.4 | 525 | 534 | 654 | 635 | 638 | 586 | 597 | 546 | — |
| 46 | 17.4 | 600 | 610 | 748 | 726 | 729 | 669 | 682 | 624 | — |
| 47 | 19.5 | 567 | 734 | 702 | 722 | 721 | 767 | 765 | 698 | — |
| 48 | 20.3 | 430 | 407 | 458 | 485 | 531 | 492 | 454 | 491 | — |
| 49 | 21.0 | 296 | 439 | 495 | 515 | 509 | 475 | 446 | 466 | — |
| C50 | 19.0 | 362 | 395 | 541 | 573 | 532 | 542 | 505 | 477 | — |
| 51 | 20.1 | — | 424 | 469 | 509 | 527 | 560 | 495 | 484 | — |
| 52 | 20.4 | — | 514 | 542 | 624 | 632 | 636 | 645 | 566 | — |
| 53 | 20.1 | — | 501 | 562 | 539 | 598 | 564 | 524 | 554 | — |
| 54 | 20.2 | — | 431 | 438 | 476 | 535 | 551 | 469 | 436 | — |
| 55 | 19.9 | — | 473 | 469 | 602 | 608 | 613 | 626 | 613 | — |
| 56 | 17.3 | 408 | 481 | 589 | 553 | 575 | 611 | 526 | 468 | — |
| 57 | 17.7 | 410 | 313 | 532 | 558 | 534 | 454 | 442 | 450 | — |
| C58 | 20.5 | 348 | 396 | 418 | 442 | 438 | 383 | 393 | 416 | — |
| 59 | 20.7 | 453 | 525 | 523 | 590 | 647 | 573 | 521 | 446 | — |
| 60 | 21.3 | 529 | 534 | 588 | 661 | 629 | 599 | 542 | 486 | — |
| 61 | 19.9 | 444 | 489 | 537 | 529 | 540 | 446 | 452 | 463 | — |
| C62 | 19.7 | 501 | 413 | 507 | 441 | 444 | 438 | 485 | 446 | — |
| 63 | 21.2 | 495 | 504 | 506 | 513 | 507 | 470 | 432 | 380 | — |
| 64 | 20.4 | 310 | 362 | 461 | 492 | 424 | 442 | 366 | 335 | — |
| C65 | 20.3 | 438 | 421 | 479 | 548 | 523 | 478 | 395 | 478 | — |
| 66 | 20.4 | 488 | 543 | 591 | 580 | 587 | 558 | 591 | 524 | — |
| 67 | 20.3 | — | 439 | 464 | 472 | 474 | 469 | 476 | 484 | — |
| 68 | 20.3 | 205 | 424 | 417 | 449 | 463 | 439 | 414 | 432 | — |
| 69 | 20.2 | 443 | 455 | 537 | 539 | 505 | 504 | 499 | 495 | — |
| 70 | 19.9 | 456 | 535 | 637 | 692 | 644 | 699 | 668 | 629 | — |
| 71 | 17.2 | 565 | 637 | 757 | 648 | 746 | 694 | 649 | 451 | — |
| C72 | 20.4 | — | — | — | 167 | 214 | 254 | 298 | 271 | 283 |

**Examples 44 and 45 normalized to basis weight of 17.5 gsy.

TABLE 6

CROSS-DIRECTIONAL ELONGATION (CDE) (%)

| EX. | ACTUAL AVERAGE FABRIC WEIGHT (g/yd$^2$) | CDE @ 148° C. (%) | CDE @ 151° C. (%) | CDE @ 154° C. (%) | CDE @ 157° C. (%) | CDE @ 160° C. (%) | CDE @ 163° C. (%) | CDE @ 166° C. (%) | CDE @ 169° C. (%) | CDE @ 172° C. (%) |
|---|---|---|---|---|---|---|---|---|---|---|
| 1 | 20.0 | 49 | 57 | 76 | 84 | 97 | 86 | 80 | 76 | 72 |
| 2 | 19.8 | 109 | 108 | 112 | 101 | 85 | 77 | 66 | 68 | 56 |

TABLE 6-continued

CROSS-DIRECTIONAL ELONGATION (CDE) (%)

| EX. | ACTUAL AVERAGE FABRIC WEIGHT (g/yd$^2$) | CDE @ 148° C. (%) | CDE @ 151° C. (%) | CDE @ 154° C. (%) | CDE @ 157° C. (%) | CDE @ 160° C. (%) | CDE @ 163° C. (%) | CDE @ 166° C. (%) | CDE @ 169° C. (%) | CDE @ 172° C. (%) |
|---|---|---|---|---|---|---|---|---|---|---|
| 3 | 20.0 | 84 | 108 | 106 | 100 | 104 | 92 | 78 | 76 | 73 |
| 4 | 19.9 | 81 | 106 | 101 | 107 | 93 | 89 | 73 | 83 | 73 |
| 5 | 20.4 | 89 | 97 | 101 | 105 | 112 | 112 | 98 | 96 | 90 |
| 6 | 20.3 | 95 | 99 | 105 | 103 | 102 | 87 | 99 | 94 | 78 |
| 7 | 19.9 | 103 | 121 | 125 | 112 | 122 | 111 | 89 | 76 | 82 |
| 8 | 20.4 | 108 | 108 | 102 | 96 | 111 | 108 | 89 | 78 | 67 |
| 9 | 20.0 | 104 | 112 | 101 | 108 | 112 | 100 | 88 | 82 | 81 |
| 10 | 19.9 | 109 | 117 | 117 | 115 | 104 | 96 | 99 | 89 | 70 |
| 11 | | | | | | | | | | |
| 12 | 20.7 | 100 | 119 | 131 | 117 | 123 | 103 | 106 | 99 | 79 |
| 13 | 20.1 | 127 | 124 | 133 | 144 | 120 | 120 | 108 | 104 | 98 |
| 14 | 19.6 | 94 | 101 | 130 | 124 | 121 | 98 | 98 | 96 | — |
| 15 | | | | | | | | | | |
| C16 | 20.1 | 54 | 49 | 80 | 76 | 103 | 96 | 105 | 91 | 85 |
| C17 | 20.7 | 59 | 87 | 105 | 112 | 121 | 128 | 103 | 105 | 98 |
| 18 | 20.1 | 93 | 120 | 129 | 137 | 117 | 107 | 116 | 97 | 88 |
| 19 | 20.6 | 75 | 83 | 100 | 123 | 112 | 113 | 106 | 95 | 93 |
| 20 | 20.1 | 79 | 100 | 119 | 111 | 104 | 93 | 103 | 89 | 87 |
| 21 | 20.1 | 121 | 121 | 136 | 123 | 132 | 109 | 109 | 82 | 89 |
| 22 | 20.9 | 90 | 109 | 119 | 128 | 128 | 114 | 102 | 89 | 86 |
| 23 | 20.9 | 100 | 102 | 129 | 124 | 142 | 121 | 114 | 101 | 88 |
| 24 | 20.1 | 94 | 92 | 98 | 114 | 118 | 109 | 87 | 83 | 80 |
| C25 | 20.9 | | 77 | 85 | 78 | 94 | 100 | 75 | 69 | 61 |
| C26 | 19.7 | | | | 76 | 83 | 89 | 95 | 81 | 73 |
| 27 | 20.4 | 83 | 93 | 102 | 99 | 99 | 97 | 70 | 69 | |
| 28 | 20.8 | 99 | 99 | 110 | 101 | 112 | 103 | 100 | 81 | |
| 29 | 21.4 | 82 | 111 | 109 | 85 | 102 | 91 | 82 | 81 | |
| 30 | 20.2 | 96 | 94 | 111 | 108 | 110 | 94 | 91 | 73 | |
| 31 | | | | | | | | | | |
| 32 | | | | | | | | | | |
| 33 | | | | | | | | | | |
| C34 | 16.9 | 77 | 85 | 104 | 98 | 103 | 95 | 85 | 81 | |
| 35 | 16.7 | 94 | 112 | 114 | 109 | 109 | 87 | 84 | 78 | |
| C36 | 16.7 | 89 | 96 | 94 | 110 | 95 | 84 | 87 | 75 | |
| 37 | 18.1 | 92 | 100 | 103 | 102 | 105 | 90 | 84 | 74 | |
| C38 | 16.7 | 77 | 85 | 100 | 106 | 87 | 83 | 80 | 83 | |
| 39 | 17.3 | 97 | 99 | 99 | 118 | 92 | 102 | 94 | 85 | |
| 40 | 20.2 | 98 | 129 | 128 | 122 | 124 | 119 | 112 | 109 | 84 |
| 41 | 20.1 | 77 | 102 | 112 | 114 | 129 | 106 | 110 | 97 | 92 |
| 42 | 20.2 | 96 | 107 | 94 | 109 | 97 | 106 | 88 | 89 | 79 |
| 43 | 18.2 | 86 | 99 | 98 | 100 | 95 | 102 | 88 | 69 | 60 |
| 44 | 15.6 | 97 | 93 | 100 | 94 | 83 | 81 | 72 | 76 | 64 |
| 45 | 17.4 | 106 | 109 | 118 | 111 | 95 | 89 | 78 | 66 | — |
| 46 | 17.4 | 106 | 109 | 118 | 111 | 95 | 89 | 78 | 66 | — |
| 47 | 19.5 | 84 | 98 | 91 | 93 | 90 | 88 | 87 | 75 | — |
| 48 | 20.3 | 85 | 77 | 91 | 84 | 91 | 82 | 72 | 74 | — |
| 49 | 21.0 | 88 | 121 | 130 | 115 | 107 | 103 | 88 | 98 | — |
| C50 | 19.0 | 77 | 80 | 100 | 97 | 87 | 90 | 83 | 73 | — |
| 51 | 20.1 | — | 97 | 103 | 103 | 95 | 102 | 87 | 79 | — |
| 52 | 20.4 | — | 97 | 92 | 104 | 96 | 101 | 99 | 83 | — |
| 53 | 20.1 | — | 102 | 115 | 108 | 108 | 99 | 84 | 87 | — |
| 54 | 20.2 | — | 100 | 97 | 97 | 107 | 95 | 86 | 77 | — |
| 55 | 19.9 | — | 93 | 90 | 104 | 101 | 95 | 93 | 95 | — |
| 56 | 17.3 | 85 | 94 | 100 | 110 | 114 | 117 | 83 | 72 | — |
| 57 | 17.7 | 97 | 97 | 116 | 121 | 98 | 67 | 85 | 87 | — |
| C58 | 20.5 | 124 | 132 | 114 | 134 | 129 | 101 | 99 | 98 | — |
| 59 | 20.7 | 116 | 129 | 118 | 131 | 134 | 108 | 96 | 77 | — |
| 60 | 21.3 | 111 | 103 | 114 | 121 | 115 | 95 | 87 | 75 | — |
| 61 | 19.9 | 104 | 113 | 113 | 98 | 100 | 85 | 85 | 85 | — |
| C62 | 19.7 | 100 | 91 | 102 | 88 | 82 | 84 | 73 | 83 | — |
| 63 | 21.2 | 135 | 143 | 134 | 137 | 118 | 103 | 85 | 73 | — |
| 64 | 20.4 | 103 | 88 | 123 | 119 | 74 | 99 | 84 | 69 | — |
| C65 | 20.3 | 132 | 132 | 118 | 127 | 127 | 120 | 89 | 104 | — |
| 66 | 20.4 | 93 | 85 | 105 | 103 | 103 | 96 | 99 | 82 | — |
| 67 | 20.3 | — | 110 | 121 | 121 | 106 | 97 | 92 | 93 | — |
| 68 | 20.3 | 66 | 88 | 85 | 87 | 91 | 87 | 73 | 79 | — |
| 69 | 20.2 | 123 | 116 | 127 | 131 | 117 | 108 | 96 | 98 | — |
| 70 | 19.9 | 90 | 101 | 120 | 116 | 102 | 104 | 103 | 97 | — |
| 71 | 17.2 | 80 | 89 | 102 | 84 | 93 | 78 | 79 | 53 | — |
| C72 | 20.4 | — | — | — | 56 | 71 | 69 | 71 | 65 | 60 |

TABLE 7

NORMALIZED CROSS-DIRECTIONAL TOUGHNESS (CD TEA) (g/in per inch)

| EX. | ACTUAL AVERAGE FABRIC WEIGHT (g/yd$^2$) | CD TEA @ 148° C. | CD TEA @ 151° C. | CD TEA @ 154° C. | CD TEA @ 157° C. | CD TEA @ 160° C. | CD TEA @ 163° C. | CD TEA @ 166° C. | CD TEA @ 169° C. | CD TEA @ 172° C. |
|---|---|---|---|---|---|---|---|---|---|---|
| 1 | 20.0 | 25 | 35 | 81 | 113 | 179 | 141 | 122 | 115 | 112 |
| 2 | 19.8 | 223 | 222 | 243 | 216 | 154 | 106 | 88 | 90 | 67 |
| 3 | 20.0 | 133 | 257 | 274 | 255 | 270 | 235 | 176 | 168 | 153 |
| 4 | 19.9 | 154 | 285 | 273 | 302 | 244 | 224 | 157 | 197 | 158 |
| 5 | 20.4 | 167 | 210 | 226 | 254 | 309 | 319 | 246 | 240 | 207 |
| 6 | 20.3 | 185 | 217 | 284 | 278 | 272 | 205 | 279 | 262 | 198 |
| 7 | 19.9 | 194 | 302 | 301 | 245 | 306 | 288 | 196 | 149 | 176 |
| 8 | 20.4 | 182 | 198 | 177 | 162 | 214 | 220 | 155 | 128 | 87 |
| 9 | 20.0 | 214 | 278 | 225 | 272 | 295 | 249 | 219 | 191 | 188 |
| 10 | 19.9 | 265 | 311 | 333 | 321 | 298 | 269 | 282 | 251 | 179 |
| 11 | | | | | | | | | | |
| 12 | 20.7 | 188 | 293 | 359 | 326 | 358 | 246 | 285 | 276 | 165 |
| 13 | 20.1 | 272 | 297 | 354 | 432 | 345 | 352 | 312 | 298 | 280 |
| 14 | 19.6 | 150 | 213 | 327 | 318 | 297 | 216 | 230 | 220 | — |
| 15 | | | | | | | | | | |
| C16 | 20.1 | 42 | 44 | 145 | 138 | 272 | 261 | 331 | 274 | 189 |
| C17 | 20.7 | 63 | 156 | 249 | 303 | 346 | 401 | 289 | 309 | 269 |
| 18 | 20.1 | 200 | 314 | 383 | 448 | 373 | 340 | 391 | 277 | 263 |
| 19 | 20.6 | 105 | 125 | 209 | 308 | 276 | 296 | 270 | 230 | 214 |
| 20 | 20.1 | 113 | 185 | 290 | 279 | 271 | 196 | 250 | 266 | 180 |
| 21 | 20.1 | 293 | 331 | 401 | 358 | 428 | 287 | 284 | 177 | 210 |
| 22 | 20.9 | 171 | 245 | 330 | 374 | 383 | 311 | 276 | 218 | 204 |
| 23 | 20.9 | 131 | 147 | 241 | 264 | 328 | 255 | 252 | 198 | 155 |
| 24 | 20.1 | 86 | 100 | 132 | 196 | 231 | 240 | 163 | 153 | 151 |
| C25 | 20.9 | | 122 | 154 | 125 | 220 | 245 | 168 | 125 | 97 |
| C26 | 19.7 | | | | 70 | 86 | 114 | 142 | 92 | 76 |
| 27 | 20.4 | 172 | 278 | 326 | 362 | 357 | 386 | 206 | 209 | — |
| 28 | 20.8 | 211 | 202 | 289 | 255 | 330 | 293 | 294 | 203 | — |
| 29 | 21.4 | 132 | 280 | 272 | 184 | 256 | 207 | 178 | 201 | — |
| 30 | 20.2 | 127 | 188 | 195 | 292 | 285 | 311 | 245 | 234 | 165 |
| 31 | | | | | | | | | | |
| 32 | | | | | | | | | | |
| 33 | | | | | | | | | | |
| C34 | 16.9 | 112 | 144 | 256 | 271 | 274 | 285 | 214 | 210 | |
| 35 | 16.7 | 194 | 289 | 310 | 311 | 322 | 231 | 227 | 200 | |
| C36 | 16.7 | 168 | 240 | 207 | 307 | 262 | 199 | 246 | 181 | |
| 37 | 18.1 | 229 | 319 | 296 | 326 | 351 | 291 | 266 | 224 | |
| C38 | 16.7 | 122 | 168 | 228 | 262 | 212 | 180 | 174 | 200 | |
| 39 | 17.3 | 229 | 283 | 315 | 372 | 289 | 331 | 293 | 284 | |
| 40 | 20.2 | 184 | 355 | 400 | 412 | 452 | 385 | 382 | 394 | 258 |
| 41 | 20.1 | 122 | 234 | 319 | 339 | 458 | 343 | 354 | 315 | 299 |
| 42 | 20.2 | 215 | 292 | 215 | 324 | 255 | 314 | 242 | 250 | 195 |
| 43 | 18.2 | 232 | 317 | 330 | 364 | 276 | 359 | 300 | 202 | 176 |
| 44** | 15.6 | 229 | 238 | 270 | 267 | 208 | 198 | 187 | 183 | 144 |
| 45** | 17.4 | 286 | 307 | 397 | 362 | 314 | 268 | 251 | 196 | — |
| 46 | 17.4 | 327 | 351 | 454 | 413 | 359 | 306 | 287 | 224 | — |
| 47 | 19.5 | 251 | 381 | 337 | 358 | 347 | 361 | 355 | 276 | — |
| 48 | 20.3 | 194 | 168 | 224 | 216 | 252 | 216 | 173 | 197 | — |
| 49 | 21.0 | 145 | 275 | 332 | 306 | 281 | 252 | 205 | 241 | — |
| C50 | 19.0 | 145 | 166 | 281 | 285 | 242 | 252 | 222 | 178 | — |
| 51 | 20.1 | — | 215 | 256 | 276 | 206 | 303 | 231 | 207 | — |
| 52 | 20.4 | — | 266 | 267 | 350 | 327 | 346 | 346 | 251 | — |
| 53 | 20.1 | — | 263 | 342 | 298 | 336 | 288 | 228 | 249 | — |
| 54 | 20.2 | — | 227 | 217 | 242 | 296 | 275 | 207 | 177 | — |
| 55 | 19.9 | — | 228 | 221 | 327 | 321 | 303 | 300 | 301 | — |
| 56 | 17.3 | 181 | 250 | 314 | 315 | 342 | 367 | 234 | 186 | — |
| 57 | 17.7 | 210 | 158 | 323 | 350 | 278 | 170 | 194 | 202 | — |
| C58 | 20.5 | 222 | 274 | 247 | 307 | 289 | 199 | 201 | 209 | — |
| 59 | 20.7 | 280 | 350 | 318 | 396 | 450 | 322 | 264 | 181 | — |
| 60 | 21.3 | 365 | 291 | 366 | 420 | 384 | 301 | 253 | 198 | — |
| 61 | 19.9 | 245 | 286 | 320 | 270 | 284 | 200 | 204 | 210 | — |
| C62 | 19.7 | 258 | 195 | 271 | 204 | 195 | 196 | 185 | 196 | — |
| 63 | 21.2 | 345 | 369 | 360 | 363 | 311 | 265 | 193 | 147 | — |
| 64 | 20.4 | 201 | 172 | 302 | 311 | 214 | 242 | 167 | 127 | — |
| C65 | 20.3 | 295 | 288 | 292 | 357 | 344 | 305 | 188 | 258 | — |
| 66 | 20.4 | 247 | 239 | 329 | 314 | 320 | 293 | 305 | 231 | — |
| 67 | 20.3 | — | 256 | 289 | 304 | 262 | 250 | 233 | 239 | — |
| 68 | 20.3 | 73 | 197 | 194 | 211 | 223 | 212 | 167 | 185 | — |
| 69 | 20.2 | 281 | 271 | 353 | 374 | 304 | 283 | 250 | 250 | — |

TABLE 7-continued

NORMALIZED CROSS-DIRECTIONAL TOUGHNESS (CD TEA) (g/in per inch)

| EX. | ACTUAL AVERAGE FABRIC WEIGHT (g/yd$^2$) | CD TEA @ 148° C. | CD TEA @ 151° C. | CD TEA @ 154° C. | CD TEA @ 157° C. | CD TEA @ 160° C. | CD TEA @ 163° C. | CD TEA @ 166° C. | CD TEA @ 169° C. | CD TEA @ 172° C. |
|---|---|---|---|---|---|---|---|---|---|---|
| 70 | 19.9 | 210 | 279 | 392 | 414 | 337 | 372 | 356 | 311 | — |
| 71 | 17.2 | 243 | 300 | 399 | 293 | 367 | 287 | 272 | 136 | — |
| C72 | 20.4 | — | — | — | 50 | 80 | 94 | 112 | 100 | 90 |

**Examples 44 and 45 normalized for basis weight of 17.5 gsy.

TABLE 8

SPINNERETTE DESCRIPTIONS

| ID NUMBER | NO. OF HOLES | FIBER SHAPE | EQUIVALENT DIAMETER (inch) | CAPILLARY LENGTH (inch) | ENTRANCE ANGLE | COUNTER BORE (inch) | HOLES/in$^2$ | L (in) | W (in) |
|---|---|---|---|---|---|---|---|---|---|
| 1 | 782 | ROUND | 0.014 | 0.056 | 30 DEG | 0.071 | 38 | 7.5 | 2.72 |
| 2 | 1068 | ROUND | 0.014 | 0.056 | 30 DEG | 0.071 | 53 | 7.5 | 2.72 |
| 3 | 1068 | CONCAVE DELTA | 0.015 | 0.031 | 60 DEG | 0.098 | 53 | 7.5 | 2.72 |
| 4 | 1068 | CONCAVE DELTA | 0.012 | 0.049 | 60 DEG | 0.098 | 53 | 7.5 | 2.72 |
| 5 | 1068 | CONCAVE DELTA | 0.014 | 0.055 | 60 DEG | 0.079 | 53 | 7.5 | 2.72 |
| 6 | 675 | ROUND | 0.014 | 0.056 | 30 DEG | 0.071 | 40 | 7.38 | 2.30 |
| 7 | 3125 | ROUND | 0.014 | 0.056 | 40 DEG | 0.087 | 56 | 15.85 | 3.50 |

TABLE 9

REGRESSION DATA AND RESULTS

| EX. | REGRESSION RANGE MIN TEMP | REGRESSION RANGE MAX TEMP | $C_0$ | $C_1$ | $C_2$ | REGRESS COEFF | Tp (° C.) | Tm (° C.) |
|---|---|---|---|---|---|---|---|---|
| 1 | 148 | 169 | −26604.33 | 328.863 | −1.0044 | 0.953 | 163.7 | 162 |
| 2 | 148 | 169 | −9215.49 | 129.522 | −0.4359 | 0.903 | 148.6 | 163 |
| 3 | 148 | 169 | −31622.39 | 402.497 | −1.2603 | 0.907 | 159.7 | 163 |
| 4 | 148 | 169 | −25329.55 | 326.457 | −1.0307 | | 158.4 | 163 |
| 5 | 148 | 169 | −22499.91 | 283.217 | −0.8711 | 0.942 | 162.6 | 163 |
| 6 | 148 | 169 | −12288.51 | 154.851 | −0.4678 | 0.824 | 165.5 | 162 |
| 7 | 148 | 169 | −20914.25 | 270.525 | −0.8555 | 0.777 | 158.1 | 163 |
| 8 | 148 | 169 | −14117.75 | 185.660 | −0.5951 | 0.784 | 156.0 | 162 |
| 9 | 148 | 169 | −14762.18 | 190.633 | −0.5957 | 0.825 | 160.0 | 164 |
| 10 | 148 | 169 | −7842.43 | 103.283 | −0.3180 | 0.903 | 162.4 | 163 |
| 11 | 148 | 169 | | | | | | 163 |
| 12 | 148 | 169 | −18806.13 | 238.885 | −0.7379 | 0.798 | 161.9 | 162 |
| 13 | 148 | 169 | −19136.45 | 242.940 | −0.7488 | 0.958 | 162.2 | 163 |
| 14 | 148 | 169 | −22261.16 | 282.649 | −0.8808 | 0.868 | 160.4 | 163 |
| 15 | 148 | 169 | | | | | | 163 |
| C-16 | 148 | 169 | −20630.10 | 242.453 | −0.6911 | 0.975 | 175.4 | 163 |
| C-17 | 148 | 169 | −41183.17 | 510.728 | −1.5611 | 0.993 | 163.6 | 162 |
| 18 | 148 | 169 | −33065.08 | 417.883 | −1.2953 | 0.942 | 161.3 | 163 |
| 19 | 148 | 169 | −27189.34 | 338.401 | −1.0340 | 0.972 | 163.6 | 162 |
| 20 | 148 | 169 | −33343.66 | 420.862 | −1.3086 | 0.960 | 160.8 | 164 |
| 21 | 148 | 169 | −32387.87 | 418.145 | −1.3258 | 0.890 | 157.7 | 164 |
| 22 | 148 | 169 | −33679.97 | 426.504 | −1.3279 | 0.966 | 160.6 | 164 |
| 23 | 148 | 169 | −25516.43 | 319.750 | −0.9852 | 0.968 | 162.3 | 164 |
| 24 | 148 | 169 | −22399.42 | 276.977 | −0.8419 | 0.950 | 164.5 | 163 |
| C-25 | 151 | 172 | −34262.00 | 427.745 | −1.3186 | 0.828 | 162.2 | 162 |
| C-26 | 157 | 172 | −28878.05 | 348.624 | −1.0424 | 0.955 | 167.2 | 163 |
| 27 | 148 | 169 | −51883.10 | 657.188 | −2.0535 | 0.902 | 160.0 | 163 |
| 28 | 148 | 169 | −20911.63 | 264.578 | −0.8160 | 0.857 | 162.1 | 163 |
| 29 | 148 | 169 | −16471.30 | 210.436 | −0.6537 | 0.593 | 161.0 | 164 |
| 30 | 148 | 169 | −29873.29 | 379.916 | −1.1871 | 0.952 | 160.0 | 163 |
| 31 | | | | | | | | |
| 32 | | | | | | | | |

TABLE 9-continued

REGRESSION DATA AND RESULTS

| EX. | REGRESSION RANGE MIN TEMP | REGRESSION RANGE MAX TEMP | $C_0$ | $C_1$ | $C_2$ | REGRESS COEFF | Tp (° C.) | Tm (° C.) |
|---|---|---|---|---|---|---|---|---|
| 33 | | | | | | | | |
| C-34 | 148 | 169 | −36379.04 | 455.499 | −1.4050 | 0.949 | 162.1 | 163 |
| 35 | 148 | 169 | −26371.92 | 338.007 | −1.0613 | 0.884 | 159.2 | 162 |
| C-36 | 148 | 169 | −20889.29 | 266.513 | −0.8300 | 0.734 | 160.5 | 163 |
| 37 | 148 | 169 | −19430.69 | 248.565 | −0.7705 | 0.876 | 161.3 | 162 |
| C-38 | 148 | 169 | −19876.65 | 252.172 | −0.7817 | 0.854 | 161.3 | 162 |
| 39 | 148 | 169 | −16255.93 | 206.971 | −0.6349 | 0.862 | 163.0 | 163 |
| 40 | 148 | 169 | −31419.95 | 392.814 | −1.2014 | 0.944 | 163.5 | 163 |
| 41 | 148 | 169 | −39390.86 | 491.564 | −1.5087 | 0.974 | 162.9 | 162 |
| 42 | 148 | 169 | −9062.32 | 116.307 | −0.3519 | 0.670 | 165.3 | 163 |
| 43 | 148 | 169 | −24805.54 | 320.173 | −1.0067 | 0.705 | 159.0 | 163 |
| 44 | 148 | 169 | −8525.74 | 114.436 | −0.3627 | 0.552 | 157.8 | 163 |
| 45 | 148 | 169 | −23726.93 | 306.358 | −0.9631 | 0.854 | 159 | 163 |
| 46 | 148 | 169 | −27116.49 | 350.120 | −1.1007 | 0.854 | 159 | 163 |
| 47 | 148 | 169 | −21080.32 | 270.44 | −0.8374 | 0.829 | 161.5 | 163 |
| 48 | 148 | 169 | −10375.85 | 133.874 | −0.4122 | 0.756 | 162.4 | 163 |
| 49 | 148 | 169 | −30269.12 | 383.810 | −1.1963 | 0.895 | 160.4 | 164 |
| C-50 | 148 | 169 | −33648.98 | 426.340 | −1.3284 | 0.928 | 160.5 | 164 |
| 51 | 151 | 169 | −26197.51 | 330.758 | −1.0231 | 0.944 | 161.6 | 164 |
| 52 | 151 | 169 | −30827.88 | 388.854 | −1.2012 | 0.945 | 161.9 | 164 |
| 53 | 151 | 169 | −14060.67 | 181.620 | −0.5636 | 0.660 | 161.1 | 162 |
| 54 | 151 | 169 | −29792.20 | 377.092 | −1.1728 | 0.846 | 160.8 | 163 |
| 55 | 151 | 169 | −22651.77 | 281.806 | −0.8529 | 0.926 | 165.2 | 163 |
| 56 | 148 | 169 | −34699.61 | 442.366 | −1.3862 | 0.935 | 159.6 | 163 |
| 57 | 148 | 169 | −27202.65 | 347.082 | −1.0865 | 0.646 | 159.7 | 163 |
| C-58 | 148 | 169 | −10921.94 | 141.792 | −0.4429 | 0.714 | 160.1 | 163 |
| 59 | 148 | 169 | −35003.59 | 448.708 | −1.4137 | 0.921 | 158.7 | 163 |
| 60 | 148 | 169 | −29577.24 | 382.166 | −1.2088 | 0.925 | 158.1 | 163 |
| 61 | 148 | 169 | −16159.64 | 211.697 | −0.6717 | 0.730 | 157.6 | 163 |
| C-62 | 145 | 169 | −5978.25 | 80.683 | −0.2525 | 0.412 | 159.8 | 163 |
| 63 | 148 | 169 | −14798.83 | 198.218 | −0.6414 | 0.991 | 154.5 | 164 |
| 64 | 148 | 169 | −33583.39 | 429.356 | −1.3536 | 0.921 | 158.6 | 163 |
| C-65 | 148 | 169 | −16144.94 | 209.591 | −0.6597 | 0.576 | 158.9 | 164 |
| 66 | 148 | 169 | −17412.26 | 225.585 | −0.7066 | 0.887 | 159.6 | 164 |
| 67 | 151 | 169 | −3353.05 | 45.952 | −0.1377 | 0.900 | 166.9 | 165 |
| 68 | 148 | 169 | −30872.62 | 388.971 | −1.2068 | 0.863 | 161.2 | 164 |
| 69 | 148 | 169 | −13334.29 | 173.652 | −0.5402 | 0.800 | 160.2 | 164 |
| 70 | 148 | 169 | −32172.35 | 406.497 | −1.257 | 0.965 | 161.7 | 163 |
| 71 | 148 | 169 | −47237.48 | 608.607 | −1.9302 | 0.891 | 157.7 | 164 |
| C-72 | 157 | 175 | −20065.25 | 239.322 | −0.7035 | 0.974 | 170.1 | 163 |

TABLE 10

| EX. | $CDS_p$ | $CDS_{p-10}$ | $CDS_{m-10}$ | $C_p$ | $C_m$ | $C_l$ | $CDS_m$ | $CDS_l$ |
|---|---|---|---|---|---|---|---|---|
| 1 | 314.9 | 214.5 | 177.1 | 68.1 | 56.3 | 11.0 | 312.0 | 34.4 |
| 2 | 406.0 | 362.4 | 397.5 | 89.3 | 97.9 | 128.8 | 315.2 | 405.9 |
| 3 | 513.6 | 387.5 | 457.3 | 75.5 | 89.0 | 68.4 | 499.7 | 341.6 |
| 4 | 520.4 | 417.3 | 490.7 | 80.2 | 94.3 | 82.2 | 498.3 | 409.6 |
| 5 | 520.4 | 433.3 | 440.7 | 83.3 | 84.7 | 64.5 | 520.2 | 335.8 |
| 6 | 526.2 | 479.4 | 440.8 | 91.1 | 83.8 | 70.3 | 520.4 | 365.9 |
| 7 | 472.0 | 386.5 | 449.7 | 81.9 | 95.3 | 85.2 | 451.5 | 384.6 |
| 8 | 362.9 | 303.3 | 353.4 | 83.6 | 97.4 | 92.2 | 341.4 | 314.8 |
| 9 | 489.2 | 429.6 | 467.7 | 87.8 | 95.6 | 86.9 | 479.7 | 417.0 |
| 10 | 543.9 | 512.1 | 515.8 | 94.2 | 94.8 | 87.9 | 543.8 | 478.0 |
| 11 | | | | | | | | |
| 12 | 527.8 | 454.0 | 455.9 | 86.0 | 86.4 | 69.1 | 527.8 | 364.7 |
| 13 | 568.3 | 493.4 | 504.6 | 86.8 | 88.8 | 73.4 | 567.8 | 416.9 |
| 14 | 414.3 | 326.2 | 365.4 | 78.7 | 88.2 | 68.0 | 408.6 | 277.8 |
| 15 | | | | | | | | |
| C-16 | 634.4 | 565.3 | 287.3 | 89.1 | 45.3 | 21.8 | 527.9 | 115.1 |
| C-17 | 589.2 | 433.1 | 379.9 | 73.5 | 64.5 | 27.4 | 585.3 | 180.1 |
| 18 | 638.8 | 509.3 | 549.4 | 79.7 | 86.0 | 64.5 | 635.1 | 409.4 |
| 19 | 498.1 | 394.7 | 358.1 | 79.2 | 71.9 | 42.8 | 495.3 | 211.9 |
| 20 | 495.0 | 364.1 | 434.3 | 73.6 | 87.8 | 64.9 | 481.6 | 312.6 |
| 21 | 581.9 | 449.3 | 563.8 | 77.2 | 96.9 | 91.0 | 529.2 | 481.6 |
| 22 | 566.9 | 434.2 | 509.2 | 76.6 | 89.8 | 70.4 | 551.5 | 388.5 |
| 23 | 427.5 | 329.0 | 361.6 | 77.0 | 84.6 | 60.5 | 424.2 | 256.5 |

TABLE 10-continued

| EX. | $CDS_p$ | $CDS_{p-10}$ | $CDS_{m-10}$ | $C_p$ | $C_m$ | $C_l$ | $CDS_m$ | $CDS_l$ |
|---|---|---|---|---|---|---|---|---|
| 24 | 381.3 | 297.1 | 270.1 | 77.9 | 70.8 | 40.1 | 379.5 | 152.3 |
| C-25 | 427.3 | 295.5 | 287.5 | 69.1 | 67.3 | 27.8 | 427.2 | 118.8 |
| C-26 | 270.7 | 166.5 | 44.8 | 61.5 | 16.5 | −54.4 | 247.5 | −134.7 |
| 27 | 697.4 | 492.1 | 607.5 | 70.6 | 87.1 | 62.4 | 673.9 | 420.3 |
| 28 | 534.9 | 453.3 | 471.5 | 84.7 | 88.1 | 71.0 | 533.8 | 379.1 |
| 29 | 464.3 | 398.9 | 427.9 | 85.9 | 92.2 | 78.9 | 460.1 | 362.8 |
| 30 | 523.5 | 404.8 | 469.9 | 77.3 | 89.8 | 70.6 | 510.7 | 360.4 |
| 31 | | | | | | | | |
| 32 | | | | | | | | |
| 33 | | | | | | | | |
| C-34 | 539.0 | 398.5 | 432.6 | 73.9 | 80.3 | 51.3 | 536.6 | 275.3 |
| 35 | 540.6 | 434.4 | 490.2 | 80.4 | 90.7 | 73.6 | 530.3 | 390.5 |
| C-36 | 505.0 | 422.0 | 461.2 | 83.6 | 91.3 | 76.2 | 498.7 | 380.2 |
| 37 | 616.1 | 539.1 | 551.9 | 87.5 | 89.6 | 75.1 | 615.6 | 462.3 |
| C-38 | 460.7 | 382.5 | 398.1 | 83.0 | 86.4 | 67.1 | 459.8 | 308.7 |
| 39 | 611.7 | 548.2 | 549.9 | 89.6 | 89.9 | 77.1 | 611.7 | 471.4 |
| 40 | 688.9 | 568.8 | 563.2 | 82.6 | 81.7 | 59.5 | 688.9 | 410.2 |
| 41 | 649.5 | 498.6 | 479.6 | 76.8 | 73.9 | 43.4 | 648.9 | 281.8 |
| 42 | 547.8 | 512.7 | 495.3 | 93.6 | 90.4 | 81.2 | 546.1 | 443.6 |
| 43 | 651.8 | 550.9 | 608.8 | 84.6 | 93.4 | 81.0 | 639.4 | 518.0 |
| 44 | 500.8 | 464.5 | 490.8 | 92.8 | 98.0 | 93.9 | 492.8 | 462.6 |
| 45 | 635.9 | 539.6 | 597.8 | 84.9 | 94.0 | 82.4 | 622.7 | 513.2 |
| 46 | 725.8 | 615.7 | 682.3 | 84.8 | 94.0 | 82.4 | 710.6 | 585.6 |
| 47 | 755.3 | 671.5 | 691.6 | 88.9 | 91.6 | 79.3 | 753.9 | 597.7 |
| 48 | 494.0 | 452.8 | 456.2 | 91.7 | 92.3 | 82.3 | 494.0 | 408.4 |
| 49 | 515.4 | 395.8 | 461.9 | 76.8 | 89.6 | 70.1 | 502.3 | 352.1 |
| C-50 | 558.7 | 425.8 | 505.6 | 76.2 | 90.5 | 71.8 | 540.7 | 388.4 |
| 51 | 535.2 | 432.9 | 480.4 | 80.9 | 89.8 | 72.0 | 527.8 | 380.0 |
| 52 | 642.2 | 522.1 | 569.3 | 81.3 | 88.6 | 70.0 | 636.3 | 445.7 |
| 53 | 571.1 | 514.7 | 525.0 | 90.1 | 91.9 | 80.6 | 570.6 | 459.9 |
| 54 | 519.5 | 402.2 | 447.7 | 77.4 | 86.2 | 63.5 | 514.0 | 326.6 |
| 55 | 626.1 | 540.8 | 499.0 | 86.4 | 79.7 | 60.1 | 621.9 | 373.6 |
| 56 | 592.5 | 453.9 | 523.4 | 76.6 | 88.3 | 67.3 | 580.5 | 390.9 |
| 57 | 516.1 | 407.4 | 459.8 | 78.9 | 89.1 | 69.8 | 507.5 | 354.5 |
| C-58 | 426.5 | 382.3 | 404.4 | 89.6 | 94.8 | 85.6 | 422.7 | 362.0 |
| 59 | 601.4 | 460.0 | 555.4 | 76.5 | 92.4 | 76.4 | 575.2 | 439.5 |
| 60 | 628.5 | 507.6 | 597.4 | 80.8 | 95.0 | 84.4 | 599.2 | 505.8 |
| 61 | 520.3 | 453.1 | 506.2 | 87.1 | 97.3 | 91.6 | 500.6 | 458.6 |
| C-62 | 467.0 | 441.8 | 455.5 | 94.6 | 97.5 | 93.0 | 464.4 | 432.1 |
| 63 | 515.5 | 451.3 | 515.3 | 87.6 | 100.0 | 108.3 | 457.8 | 495.9 |
| 64 | 464.1 | 328.7 | 421.7 | 70.8 | 90.9 | 71.3 | 437.8 | 312.0 |
| C-65 | 502.2 | 436.2 | 486.6 | 86.9 | 96.9 | 90.4 | 484.7 | 438.1 |
| 66 | 592.5 | 521.8 | 570.1 | 88.1 | 96.2 | 88.6 | 579.0 | 512.7 |
| 67 | 480.6 | 466.9 | 461.3 | 97.1 | 96.0 | 92.0 | 480.1 | 441.5 |
| 68 | 470.3 | 349.6 | 408.4 | 74.3 | 86.9 | 63.4 | 460.5 | 291.9 |
| 69 | 524.9 | 470.9 | 504.3 | 89.7 | 96.1 | 88.5 | 517.0 | 457.5 |
| 70 | 691.6 | 565.9 | 596.6 | 81.8 | 86.3 | 66.1 | 689.4 | 455.9 |
| 71 | 737.1 | 544.1 | 695.3 | 73.8 | 94.3 | 81.7 | 682.0 | 557.3 |
| C-72 | 288.4 | 218.0 | 82.8 | 75.6 | 28.7 | — | 253.0 | — |

TABLE 11

| EX. | $A_m$ | $A_p$ | $A_l$ | $R_m$ | $R_p$ | $R_l$ |
|---|---|---|---|---|---|---|
| 1 | 2613 | 2814 | 3163 | 83.0 | 89.4 | 67.0 |
| 2 | 3636 | 3915 | 5653 | 89.6 | 96.4 | 92.8 |
| 3 | 4995 | 4716 | 7018 | 97.3 | 91.8 | 91.1 |
| 4 | 5117 | 4860 | 7389 | 98.3 | 93.4 | 94.7 |
| 5 | 4950 | 4913 | 6909 | 95.1 | 94.4 | 88.5 |
| 6 | 4884 | 5106 | 6910 | 92.8 | 97.0 | 87.6 |
| 7 | 4649 | 4435 | 6752 | 98.5 | 94.0 | 95.4 |
| 8 | 3573 | 3430 | 5256 | 98.5 | 94.5 | 96.6 |
| 9 | 4836 | 4693 | 7060 | 98.9 | 95.9 | 96.2 |
| 10 | 5351 | 5333 | 7842 | 98.4 | 98.1 | 96.1 |
| 11 | | | | | | |
| 12 | 5042 | 5032 | 7109 | 95.5 | 95.3 | 89.8 |
| 13 | 5487 | 5433 | 7807 | 96.6 | 95.6 | 91.6 |
| 14 | 4017 | 3850 | 5643 | 97.0 | 92.9 | 90.8 |
| 15 | | | | | | |
| C-16 | 4191 | 6114 | 5212 | 66.1 | 96.4 | 54.8 |
| C-17 | 5086 | 5372 | 6469 | 86.3 | 91.2 | 73.2 |
| 18 | 6138 | 5956 | 8562 | 96.1 | 93.2 | 89.4 |
| 19 | 4439 | 4636 | 5885 | 89.1 | 93.1 | 78.8 |

TABLE 11-continued

| EX. | $A_m$ | $A_p$ | $A_l$ | $R_m$ | $R_p$ | $R_l$ |
|---|---|---|---|---|---|---|
| 20 | 4798 | 4513 | 6692 | 96.9 | 91.2 | 90.1 |
| 21 | 5686 | 5377 | 8327 | 97.7 | 92.4 | 95.4 |
| 22 | 5525 | 5227 | 7797 | 97.5 | 92.2 | 91.7 |
| 23 | 4094 | 3947 | 5659 | 95.8 | 92.3 | 88.3 |
| 24 | 3388 | 3533 | 4461 | 88.8 | 92.6 | 78.0 |
| C-25 | 3793 | 3834 | 4837 | 88.8 | 89.7 | 75.5 |
| C-26 | 1635 | 2360 | 1432 | 60.4 | 87.2 | 35.3 |
| 27 | 6750 | 6290 | 9362 | 96.8 | 90.2 | 89.5 |
| 28 | 5162 | 5077 | 7306 | 96.5 | 94.9 | 91.0 |
| 29 | 4549 | 4425 | 6540 | 98.0 | 95.3 | 93.9 |
| 30 | 5101 | 4839 | 7201 | 97.4 | 92.4 | 91.7 |
| 31 | | | | | | |
| 32 | | | | | | |
| 33 | | | | | | |
| C-34 | 5080 | 4921 | 6879 | 94.3 | 91.3 | 85.1 |
| 35 | 5279 | 5052 | 7503 | 97.7 | 93.5 | 92.5 |
| C-36 | 4938 | 4773 | 7059 | 97.8 | 94.5 | 93.2 |
| 37 | 5966 | 5905 | 8517 | 96.8 | 95.8 | 92.2 |
| C-38 | 4420 | 4347 | 6203 | 95.9 | 94.3 | 89.8 |

TABLE 11-continued

| EX. | $A_m$ | $A_p$ | $A_l$ | $R_m$ | $R_p$ | $R_l$ |
|---|---|---|---|---|---|---|
| 39 | 5914 | 5905 | 8480 | 96.7 | 96.5 | 92.4 |
| 40 | 6460 | 6489 | 8919 | 93.8 | 94.2 | 86.3 |
| 41 | 5894 | 5992 | 7829 | 90.8 | 92.3 | 80.4 |
| 42 | 5266 | 5361 | 7620 | 96.1 | 97.9 | 92.7 |
| 43 | 6409 | 6181 | 9247 | 98.4 | 94.9 | 94.6 |
| 44 | 4977 | 4887 | 7369 | 99.4 | 97.6 | 98.1 |
| 45 | 6263 | 6038 | 9061 | 98.5 | 95.0 | 95.0 |
| 46 | 7148 | 6891 | 10341 | 98.5 | 94.9 | 95.0 |
| 47 | 7367 | 7274 | 10608 | 97.5 | 96.3 | 93.6 |
| 48 | 4819 | 4803 | 6985 | 97.6 | 97.2 | 94.3 |
| 49 | 5020 | 4755 | 7080 | 97.4 | 92.3 | 91.6 |
| C-50 | 5453 | 5144 | 7716 | 97.6 | 92.1 | 92.1 |
| 51 | 5212 | 5011 | 7384 | 97.4 | 93.6 | 92.0 |
| 52 | 6228 | 6022 | 8791 | 97.0 | 93.8 | 91.3 |
| 53 | 5572 | 5523 | 8046 | 97.6 | 96.7 | 93.9 |
| 54 | 5004 | 4804 | 6964 | 96.3 | 92.5 | 89.4 |
| 55 | 5747 | 5976 | 7946 | 91.8 | 95.5 | 84.6 |
| 56 | 5751 | 5463 | 8065 | 97.1 | 92.2 | 90.7 |
| 57 | 5018 | 4799 | 7076 | 97.2 | 93.0 | 91.4 |
| C-58 | 4210 | 4118 | 6135 | 98.7 | 96.5 | 95.9 |
| 59 | 5889 | 5542 | 8406 | 97.9 | 92.2 | 93.2 |
| 60 | 6184 | 5882 | 8967 | 98.4 | 93.6 | 95.1 |
| 61 | 5146 | 4979 | 7572 | 98.9 | 95.7 | 97.0 |
| C-62 | 4641 | 4586 | 6866 | 99.4 | 98.2 | 98.0 |
| 63 | 4973 | 4941 | 7514 | 96.5 | 95.9 | 97.2 |
| 64 | 4523 | 4190 | 6386 | 97.5 | 90.3 | 91.7 |
| C-65 | 4967 | 4802 | 7292 | 98.9 | 95.6 | 96.8 |
| 66 | 5863 | 5689 | 8585 | 99.0 | 96.0 | 96.6 |
| 67 | 4730 | 4760 | 6990 | 98.4 | 99.0 | 97.0 |
| 68 | 4546 | 4301 | 6322 | 96.7 | 91.4 | 89.6 |
| 69 | 5197 | 5069 | 7613 | 99.0 | 96.6 | 96.7 |
| 70 | 6640 | 6497 | 9297 | 96.0 | 93.9 | 89.6 |
| 71 | 7208 | 6728 | 10380 | 97.8 | 91.3 | 93.9 |
| C-72 | 1796 | 2649 | 1880 | 62.3 | 91.9 | 43.5 |

TABLE 12

| Comparison | Ex. | $C_m$ | $\Delta C_m$ | $C_p$ | $\Delta C_p$ | $C_l$ | $\Delta C_l$ |
|---|---|---|---|---|---|---|---|
| 1 | C-16 | 45.3 | | 89.1 | | 21.8 | |
| | 3 | 89.0 | 43.7 | 75.5 | −13.6 | 68.4 | 46.6 |
| | 7 | 95.3 | 50.0 | 81.9 | −7.2 | 85.2 | 63.4 |
| | 12 | 86.4 | 41.1 | 86.0 | −3.1 | 69.1 | 47.3 |
| 2 | C-17 | 64.5 | | 73.5 | | 27.4 | |
| | 13 | 88.8 | 24.3 | 86.8 | 13.3 | 73.4 | 46.0 |
| | 18 | 86.0 | 21.5 | 79.7 | 6.2 | 64.5 | 37.1 |
| | 40 | 81.7 | 17.3 | 82.6 | 9.1 | 59.5 | 32.1 |
| | 41 | 73.9 | 9.4 | 76.8 | 3.3 | 43.4 | 16.0 |
| | 42 | 90.4 | 25.9 | 93.6 | 20.1 | 81.2 | 53.8 |
| 3 | C-34 | 80.3 | | 73.9 | | 51.3 | |
| | 35 | 90.7 | 10.4 | 80.4 | 6.4 | 73.6 | 22.3 |
| | C-36 | 91.3 | | 83.6 | | 76.2 | |
| | 37 | 89.6 | −1.8 | 87.5 | 3.9 | 75.1 | −1.1 |
| | C-38 | 86.4 | | 83.0 | | 67.1 | |
| | 39 | 89.9 | 3.5 | 89.6 | 6.7 | 77.1 | 10.0 |
| 4 | C-16 | 45.3 | | 89.1 | | 21.8 | |
| | 19 | 71.9 | 26.6 | 79.2 | −9.9 | 42.8 | 21 |
| | 20 | 87.8 | 42.5 | 73.6 | −15.5 | 64.9 | 43.1 |
| | 21 | 96.9 | 51.6 | 77.2 | −11.9 | 91.0 | 69.2 |
| | 22 | 89.8 | 44.5 | 76.6 | −12.5 | 70.4 | 48.6 |
| 5 | C-26 | 16.5 | | 61.5 | | −54.40 | |
| | 24 | 70.8 | 54.3 | 77.9 | 16.4 | 40.1 | 94.5 |
| 6 | C-25 | 67.3 | | 69.1 | | 27.8 | |
| | 28 | 88.1 | 20.8 | 84.7 | 15.6 | 71.0 | 43.2 |
| | 29 | 92.2 | 24.9 | 85.9 | 16.8 | 78.9 | 51.1 |
| | 30 | 89.8 | 22.5 | 77.3 | 8.2 | 70.6 | 42.8 |
| 7 | C-38* | 86.4 | | 83.0 | | 67.1 | |
| | 44** | 98.0 | 11.6 | 92.8 | 9.7 | 93.9 | 26.8 |
| | 45** | 94.0 | 7.6 | 84.9 | 1.8 | 82.4 | 15.3 |
| 8 | C-58 | 94.8 | | 89.6 | | 85.6 | |
| | 51 | 89.8 | −5.0 | 80.9 | −8.7 | 72.0 | −13.6 |
| | 52 | 88.6 | −6.2 | 81.3 | −8.3 | 70.0 | −15.6 |
| | 53 | 91.9 | −2.9 | 90.1 | 0.5 | 80.6 | −5.0 |
| | 54 | 86.2 | −8.6 | 77.4 | −12.2 | 63.5 | −22.1 |

TABLE 12-continued

| Comparison | Ex. | $C_m$ | $\Delta C_m$ | $C_p$ | $\Delta C_p$ | $C_l$ | $\Delta C_l$ |
|---|---|---|---|---|---|---|---|
| | 59 | 92.4 | −2.4 | 76.5 | −13.1 | 76.4 | −9.2 |
| | 60 | 95.0 | 0.2 | 80.8 | −8.8 | 84.4 | −1.2 |
| | 61 | 97.3 | 2.5 | 87.1 | −2.5 | 91.6 | 6.0 |
| 9 | C-62 | 97.5 | | 94.6 | | 93.0 | |
| | 56 | 88.3 | −9.2 | 76.6 | −18.0 | 67.3 | −25.7 |
| | 57 | 89.1 | −8.4 | 78.9 | −15.6 | 69.8 | −23.2 |
| 10 | C-50 | 90.5 | | 76.2 | | 71.8 | |
| | 71 | 94.3 | 3.8 | 73.8 | −2.4 | 81.7 | 9.9 |

*Normalized to 20 gsy
**Normalized to 17.5 gsy

TABLE 13

| Comparison | Ex. | $A_m$ | % $\Delta A_m$ | $A_p$ | % $\Delta A_p$ | $A_l$ | % $\Delta A_l$ |
|---|---|---|---|---|---|---|---|
| 1 | C-16 | 4191 | | 6114 | | 5212 | |
| | 3 | 4995 | 19 | 4716 | −23 | 7018 | 35 |
| | 7 | 4649 | 11 | 4435 | −27 | 6752 | 30 |
| | 12 | 5042 | 20 | 5032 | −18 | 7109 | 36 |
| 2 | C-17 | 5086 | | 5372 | | 6469 | |
| | 13 | 5487 | 8 | 5433 | 1 | 7807 | 21 |
| | 18 | 6138 | 21 | 5956 | 11 | 8562 | 32 |
| | 40 | 6460 | 27 | 6489 | 21 | 8919 | 38 |
| | 41 | 5894 | 16 | 5992 | 12 | 7829 | 21 |
| | 42 | 5266 | 4 | 5361 | 0.00 | 7620 | 18 |
| 3 | C-34 | 5080 | | 4921 | | 6879 | |
| | 35 | 5279 | 4 | 5052 | 3 | 7503 | 9 |
| | C-36 | 4938 | | 4773 | | 7059 | |
| | 37 | 5966 | 21 | 5905 | 24 | 8517 | 21 |
| | C-38 | 4420 | | 4347 | | 6203 | |
| | 39 | 5914 | 34 | 5905 | 36 | 8480 | 37 |
| 4 | C-16 | 4191 | | 6114 | | 5212 | |
| | 19 | 4439 | 6 | 4636 | −24 | 5885 | 13 |
| | 20 | 4798 | 14 | 4513 | −26 | 6692 | 28 |
| | 21 | 5686 | 36 | 5377 | −12 | 8327 | 60 |
| | 22 | 5525 | 32 | 5227 | −15 | 7797 | 50 |
| 5 | C-26 | 1635 | | 2360 | | 1432 | |
| | 24 | 3388 | 107 | 3533 | 50 | 4461 | 212 |
| 6 | C-25 | 3793 | | 3834 | | 4837 | |
| | 28 | 5162 | 36 | 5077 | 32 | 7306 | 51 |
| | 29 | 4549 | 20 | 4425 | 15 | 6540 | 35 |
| | 30 | 5101 | 34 | 4839 | 26 | 7201 | 49 |
| 7 | C-38* | 4420 | | 4347 | | 6203 | |
| | 44** | 4977 | 13 | 4887 | 12 | 7369 | 19 |
| | 45** | 6263 | 42 | 6038 | 39 | 9061 | 46 |
| 8 | C-58 | 4210 | | 4118 | | 6135 | |
| | 51 | 5212 | 24 | 5011 | 22 | 7384 | 20 |
| | 52 | 6228 | 48 | 6022 | 46 | 8791 | 43 |
| | 53 | 5572 | 32 | 5523 | 34 | 8046 | 31 |
| | 54 | 5004 | 19 | 4804 | 17 | 6964 | 14 |
| | 59 | 5889 | 40 | 5542 | 35 | 8406 | 37 |
| | 60 | 6184 | 47 | 5882 | 43 | 8967 | 46 |
| | 61 | 5146 | 22 | 4979 | 21 | 7572 | 23 |
| 9 | C-62 | 4641 | | 4586 | | 6866 | |
| | 56 | 5751 | 24 | 5463 | 19 | 8065 | 17 |
| | 57 | 5018 | 8 | 4799 | 5 | 7076 | 3 |
| 10 | C-50 | 5453 | | 5144 | | 7716 | |
| | 71 | 7208 | 32 | 6728 | 31 | 10380 | 35 |
| 11 | C-65 | 4967 | | 4802 | | 7292 | |
| | 66 | 5863 | 18 | 5689 | 18 | 8585 | 18 |
| | 67 | 4730 | −5 | 4760 | −1 | 6990 | −4 |
| | 68 | 4546 | −8 | 4301 | −10 | 6322 | −13 |
| | 69 | 5197 | 5 | 5069 | 6 | 7613 | 4 |
| 12 | C-17 | 5086 | | 5372 | | 6469 | |
| | 70 | 6640 | 31 | 6497 | 21 | 9297 | 44 |
| 13 | Highest Control Example[1] | 5453 | | 6114 | | 7716 | |
| | 27 | 6750 | 24 | 6290 | 3 | 9362 | 21 |
| | 40 | 6460 | 18 | 6489 | 6 | 8919 | 16 |
| | 43 | 6409 | 18 | 6181 | 1 | 9247 | 20 |
| | 46 | 7148 | 31 | 6891 | 13 | 10341 | 34 |
| | 47 | 7367 | 35 | 7274 | 19 | 10608 | 37 |

TABLE 13-continued

| Comparison | Ex. | $A_m$ | % $\Delta A_m$ | $A_p$ | % $\Delta A_p$ | $A_l$ | % $\Delta A_l$ |
|---|---|---|---|---|---|---|---|
| | 70 | 6640 | 22 | 6497 | 6 | 9297 | 20 |
| | 71 | 7208 | 32 | 6728 | 10 | 10380 | 35 |

*Normalized to 20 gsy

**Normalized to 17.5 gsy

[1]Values for Highest Control Example $A_m$, $A_p$ and $A_l$ are taken from control Examples 16, 17 25, 26, 34, 36, 38, 50, 58, 62 and 65.

$A_m$ and $A_l$ are taken from control Example 50 and $A_p$ is taken from control Example 16.

TABLE 14

| Comparison | Ex. | $R_p$ | $\Delta R_p$ | $R_m$ | $\Delta R_m$ | $R_l$ | $\Delta R_l$ |
|---|---|---|---|---|---|---|---|
| 1 | C-16 | 96.4 | | 68.1 | | 54.8 | |
| | 3 | 91.8 | −4.6 | 97.3 | 31.2 | 91.1 | 36.3 |
| | 7 | 94.0 | −2.4 | 98.5 | 32.4 | 95.4 | 40.6 |
| | 12 | 95.3 | −1.1 | 95.5 | 29.4 | 89.8 | 35.0 |
| 2 | C-17 | 91.2 | | 86.3 | | 73.2 | |
| | 13 | 95.6 | 4.4 | 96.6 | 10.3 | 91.6 | 18.4 |
| | 18 | 93.2 | 2.0 | 96.1 | 9.8 | 89.4 | 16.2 |
| | 40 | 94.2 | 3.0 | 93.8 | 7.5 | 86.3 | 13.1 |
| | 41 | 92.3 | 1.1 | 90.8 | 4.5 | 80.4 | 7.2 |
| | 42 | 97.9 | 6.7 | 96.1 | 9.8 | 92.7 | 19.5 |
| 3 | C-34 | 91.3 | | 94.3 | | 85.1 | |
| | 35 | 93.5 | 2.2 | 97.7 | 3.4 | 92.5 | 7.4 |
| | C-36 | 94.5 | | 97.8 | | 93.2 | |
| | 37 | 95.8 | 1.3 | 96.8 | −1.0 | 92.2 | −1.0 |
| | C-35 | 94.3 | | 95.9 | | 89.8 | |
| | 39 | 96.5 | 2.2 | 96.7 | 0.8 | 92.4 | 2.6 |
| 4 | C-16 | 96.4 | | 68.1 | | 54.8 | |
| | 19 | 93.1 | −3.3 | 89.1 | 23.0 | 78.8 | 24.0 |
| | 20 | 91.2 | −5.2 | 96.9 | 30.8 | 90.1 | 35.4 |

TABLE 14-continued

| Comparison | Ex. | $R_p$ | $\Delta R_p$ | $R_m$ | $\Delta R_m$ | $R_l$ | $\Delta R_l$ |
|---|---|---|---|---|---|---|---|
| | 21 | 92.4 | −4.0 | 97.7 | 31.6 | 95.4 | 40.6 |
| | 22 | 92.2 | −4.2 | 97.5 | 31.4 | 91.7 | 36.9 |
| 5 | C-26 | 87.2 | | 60.4 | | 35.3 | |
| | 24 | 92.6 | 5.4 | 88.8 | 26.4 | 78 | 42.7 |
| 6 | C-25 | 89.7 | | 88.8 | | 75.5 | |
| | 28 | 94.9 | 5.2 | 96.5 | 7.7 | 91.0 | 15.6 |
| | 29 | 95.3 | 5.6 | 98.0 | 9.2 | 93.9 | 18.4 |
| | 30 | 92.4 | 2.7 | 97.4 | 8.6 | 91.7 | 16.2 |
| 7 | C-38* | 94.3 | | 95.9 | | 89.8 | |
| | 44** | 97.6 | 3.3 | 99.4 | 3.5 | 98.1 | 8.3 |
| | 45** | 95.0 | 0.7 | 98.5 | 2.6 | 95.0 | 5.2 |
| 8 | C-58 | 96.5 | | 98.7 | | 95.9 | |
| | 51 | 93.6 | −2.9 | 97.4 | −1.3 | 92.0 | −3.9 |
| | 52 | 93.8 | −2.8 | 97.0 | −1.7 | 91.3 | −4.6 |
| | 53 | 96.7 | 0.2 | 97.6 | −1.1 | 93.9 | −2.0 |
| | 54 | 92.5 | −4.0 | 96.3 | −2.4 | 89.4 | −6.5 |
| | 59 | 92.2 | −4.4 | 97.9 | −0.8 | 93.2 | −2.7 |
| | 60 | 93.6 | −2.9 | 98.4 | −0.3 | 95.1 | −0.8 |
| | 61 | 95.7 | −0.8 | 98.9 | 0.2 | 97.0 | 1.1 |
| 9 | C-62 | 98.2 | | 99.4 | | 98.0 | |
| | 56 | 92.2 | −6.0 | 97.1 | −2.3 | 90.7 | −7.3 |
| | 57 | 93.0 | −5.2 | 97.2 | −2.1 | 91.4 | −6.6 |
| 10 | C-50 | 92.1 | | 97.6 | | 92.1 | |
| | 71 | 91.3 | −0.8 | 97.8 | 0.2 | 93.9 | 1.8 |

*Normalized to 20 gsy

**Normalized to 17.5 gsy

TABLE 15

RHEOLOGICAL DATA OF POLYMERS RUN AT 200° C.[1]

| POLYMERS | FREQUENCY (radians/sec) | ELASTIC MODULUS (DYNES/SQ. CM) ELASTIC MODULUS | RATIO PA/PP[2] | COMPLEX VISCOSITY (DYNES/SQ. CM) COMPLEX VISCOSITY | RATIO PA/PP | DSC MP (° C.) |
|---|---|---|---|---|---|---|
| ELVAX ®750 | 100 | 202900 | 0.572 | 307.9 | 0.659 | 97.3 |
| ELVAX ®3180 | 100 | 84300 | 0.238 | 167.7 | 0.359 | 63 |
| NUCREL ®925 | 100 | 68980 | 0.195 | 145.5 | 0.312 | 92.4 |
| KRATON ®1750 | 100 | 793200 | 2.238 | 1178.0 | 2.520 | NONE |
| ELVALOY ®AM | 100 | 141200 | 0.398 | 231.3 | 0.496 | 71.5 |
| ELVALOY ®HP661 | 100 | 129000 | 0.364 | 205.0 | 0.439 | 62 |
| ELVALOY ®HP662 | 100 | 147600 | 0.416 | 241.1 | 0.517 | 60 |
| BYNEL ®2002 | 100 | 147600 | 0.416 | 241.1 | 0.517 | 90 |
| BYNEL ®2022 | 100 | 55240 | 0.156 | 115.5 | 0.248 | 90.4 |
| SURLYN ®RX9-1 | 100 | 79200 | 0.223 | 147.5 | 0.316 | 72 |
| PE 6835A | 100 | 110000 | 0.310 | 312.1 | 0.669 | 131.3 |
| PE XU58200.03 | 100 | 48180 | 0.136 | 198.2 | 0.425 | 109.2 |
| PE XU58200.02 | 100 | 48300 | 0.136 | 175.8 | 0.377 | 66 |
| PROFAX 165 | 100 | 354500 | 1.000 | 466.6 | 1.000 | 163 |

[1]The scan was conducted at 10° C./min in contrast to 20° C./min as set forth in the procedure for determining Differential Scanning Calorimetry Melting Point (DSC MP).

[2]PA = Polymer Additive, and PP = Polypropylene

We claim:

1. A fiber comprising a polymer blend of polypropylene and polymeric bond curve enhancing agent, said fiber comprising a skin-core structure comprising a skin and a core, and said polypropylene and said polymeric bond curve enhancing agent are present in both said skin and said core, wherein said skin-core fiber when processed into a thermally bonded nonwoven material obtains at least one of:

(a) flattening of a bond curve of cross-directional strength vs. temperature as compared to a nonwoven material produced under same conditions from fibers produced under same conditions except for absence of the polymeric bond curve enhancing agent;

(b) raising of at least some points of cross-directional strength of a bond curve of cross-directional strength vs. temperature as compared to a nonwoven material produced under same conditions from fibers produced under same conditions except for absence of the polymeric bond curve enhancing agent;

(c) an increase in area over a defined temperature range under a bond curve of cross-directional strength vs. temperature as compared to a nonwoven material produced under same conditions from fibers produced under same conditions except for absence of the polymeric bond curve enhancing agent;

(d) a $\%\Delta A_1$ which is greater than that of a nonwoven material produced under same conditions from fibers produced under same conditions except for absence of the polymeric bond curve enhancing agent;

(e) a $\%\Delta A_1$ and a $\%\Delta A_m$ which is greater than that of a nonwoven material produced under same conditions from fibers produced under same conditions except for absence of the polymeric bond curve enhancing agent; and (f) a $\%\Delta A_1$, a $\%\Delta A_m$ and a $\%\Delta A_p$ which is greater than that of a nonwoven material produced under same conditions from fibers produced under same conditions except for absence of the polymeric bond curve enhancing agent.

2. The fiber according to claim 1, wherein said skin-core fiber when processed into a thermally bonded nonwoven material obtains flattening of a bond curve of cross-directional strength vs. temperature as compared to a nonwoven material produced under same conditions from fibers produced under same conditions except for absence of the polymeric bond curve enhancing agent.

3. The fiber according to claim 1, wherein said skin-core fiber when processed into a thermally bonded nonwoven material obtains raising of at least some points of cross-directional strength of a bond curve of cross-directional strength vs. temperature as compared to a nonwoven material produced under same conditions from fibers produced under same conditions except for absence of the polymeric bond curve enhancing agent.

4. The fiber according to claim 3, wherein said raising of at least some points of cross-directional strength includes raising of peak cross-directional strength.

5. The fiber according to claim 3, wherein said raising of at least some points of cross-directional strength includes raising at least some points at temperatures lower than peak cross-directional strength.

6. The fiber according to claim 1, wherein said skin-core fiber when processed into a thermally bonded nonwoven material obtains raising of at least some points of cross-directional strength and shifting to lower temperatures of a bond curve of cross-directional strength vs. temperature as compared to a nonwoven material produced under same conditions from fibers produced under same conditions except for absence of the polymeric bond curve enhancing agent.

7. The fiber according to claim 6, wherein said raising of at least some points of cross-directional strength includes raising of peak cross-directional strength.

8. The fiber according to claim 6, wherein said raising of at least some points of cross-directional strength includes raising at least some points at temperatures lower than peak cross-directional strength.

9. The fiber according to claim 1, wherein said skin-core fiber when processed into a thermally bonded nonwoven material obtains raising of at least some points of cross-directional strength, and shifting to lower temperatures of a bond curve of cross-directional strength vs. temperature as compared to a nonwoven material produced under same conditions from fibers produced under same conditions except for absence of the polymeric bond curve enhancing agent.

10. The fiber according to claim 9, wherein said raising of at least some points of cross-directional strength includes raising of peak cross-directional strength.

11. The fiber according to claim 9, wherein said raising of at least some points of cross-directional strength includes raising at least some points at temperatures lower than peak cross-directional strength.

12. The fiber according to claim 1, wherein said skin-core fiber when processed into a thermally bonded nonwoven material obtains an increase in area over a defined temperature range under a bond curve of cross-directional strength vs. temperature as compared to a nonwoven material produced under same conditions from fibers produced under same conditions except for absence of the polymeric bond curve enhancing agent.

13. The fiber according to claim 12, wherein said increase in area is provided by the bond curve being flatter and having the same or substantially the same peak cross-directional strength as compared to a nonwoven material produced under same conditions from fibers produced under same conditions-except for absence of the polymeric bond curve enhancing agent.

14. The fiber according to claim 12, wherein said increase in area is provided by the bond curve being of the same or substantially the same shape and having higher cross-directional strengths over at least some points on the bond curve over the defined temperature range as compared to a nonwoven material produced under same conditions from fibers produced under same conditions except for absence of the polymeric bond curve enhancing agent.

15. The fiber according to claim 14, wherein said at least some points include a higher peak cross-directional strength.

16. The fiber according to claim 12, wherein said increase in area is provided by the bond curve being shifted to lower temperatures with the area under the bond curve in the defined temperature range being increased as compared to a nonwoven material produced under same conditions from fibers produced under same conditions except for absence of the polymeric bond curve enhancing agent.

17. The fiber according to claim 16, wherein the polymer blend includes copolymer containing propylene and ethylene units.

18. The fiber according to claim 16, wherein the polymer blend includes copolymer containing propylene units and up to about 20 weight percent of ethylene units.

19. The fiber according to claim 16, wherein the polymer blend includes copolymer containing propylene units and up to about 10 weight percent of ethylene units.

20. A nonwoven material comprising fibers according to claim 12, bonded together.

21. The fiber according to claim 12, wherein said increase in area is provided by the bond curve being flatter and having the same peak cross-directional strength as compared to a nonwoven material produced under same conditions from fibers produced under same conditions except for absence of the polymeric bond curve enhancing agent.

22. The fiber according to claim 12, wherein said increase in area is provided by the bond curve being flatter and having a lower peak cross-directional strength as compared to a nonwoven material produced under same conditions from fibers produced under same conditions except for absence of the polymeric bond curve enhancing agent.

23. The fiber according to claim 12, wherein said increase in area is provided by the bond curve being flatter and having cross-directional strength points at temperatures lower than peak cross-directional strength raised as compared to a nonwoven material produced under same conditions from fibers produced under same conditions except for absence of the polymeric bond curve enhancing agent.

24. The fiber according to claim 12, wherein said increase in area is provided by the bond curve being flatter and being shifted to lower temperatures as compared to a nonwoven material produced under same conditions from fibers produced under same conditions except for absence of the polymeric bond curve enhancing agent.

25. The fiber according to claim 12, wherein said increase in area is provided by the bond curve being flatter, being shifted to lower temperatures and having cross-directional strength points at temperatures lower than peak cross-directional strength raised as compared to a nonwoven material produced under same conditions from fibers produced under same conditions except for absence of the polymeric bond curve enhancing agent.

26. The fiber according to claim 1, wherein said polymeric bond curve enhancing agent has (a) a DSC melting point of below about 230° C., and (b) at least one of an elastic modulus and a complex viscosity below that of the polypropylene in the polymer blend.

27. The fiber according to claim 26, wherein said polymeric bond curve enhancing agent has a DSC melting point of below about 200° C.

28. The fiber according to claim 26, wherein said polymeric bond curve enhancing agent has a DSC melting point below that of the polypropylene in the polymer blend.

29. The fiber according to claim 26, wherein said polymeric bond curve enhancing agent has a DSC melting point of about 15 to 100° C. below that of the polypropylene in the polymer blend.

30. The fiber according to claim 28, wherein both of said elastic modulus and said complex viscosity are below that of the polypropylene in the polymer blend.

31. The fiber according to claim 30, wherein said polymeric bond curve enhancing agent provides an increase in area over a defined temperature range under a bond curve of cross-directional strength vs. temperature as compared to a nonwoven material produced under same conditions from fibers produced under same conditions except for absence of the polymeric bond curve enhancing agent.

32. The fiber according to claim 31, wherein said increase in area is provided by the bond curve being flatter and having the same or substantially the same peak cross-directional strength as compared to a nonwoven material produced under same conditions from fibers produced under same conditions except for absence of the polymeric bond curve enhancing agent.

33. The fiber according to claim 31, wherein said increase in area is provided by the bond curve being of the same or substantially the same shape and having higher cross-directional strengths over at least some points on the bond curve over the defined temperature range as compared to a nonwoven material produced under same conditions from fibers produced under same conditions except for absence of the polymeric bond curve enhancing agent.

34. The fiber according to claim 33, wherein said at least some points include a higher peak cross-directional strength.

35. The fiber according to claim 31, wherein said increase in area is provided by the bond curve being shifted to lower temperatures with the area under the bond curve in the defined temperature range being increased as compared to a nonwoven material produced under same conditions from fibers produced under same conditions except for absence of the polymeric bond curve enhancing agent.

36. The fiber according to claim 31, wherein said increase in area is provided by the bond curve being flatter, and having the same peak cross-directional strength as compared to a nonwoven material produced under same conditions from fibers produced under same conditions except for absence of the polymeric bond curve enhancing agent.

37. The fiber according to claim 31, wherein said increase in area is provided by the bond curve being flatter and having a lower peak cross-directional strength as compared to a nonwoven material produced under same conditions from fibers produced under same conditions except for absence of the polymeric bond curve enhancing agent.

38. The fiber according to claim 31, wherein said increase in area is provided by the bond curve being flatter and having cross-directional strength points at temperatures lower than peak cross-directional strength raised as compared to a nonwoven material produced under same conditions from fibers produced under same conditions except for absence of the polymeric bond curve enhancing agent.

39. The fiber according to claim 31, wherein said increase in area is provided by the bond curve being flatter and being shifted to lower temperatures as compared to a nonwoven material produced under same conditions from fibers produced under same conditions except for absence of the polymeric bond curve enhancing agent.

40. The fiber according to claim 31, wherein said increase in area is provided by the bond curve being flatter, being shifted to lower temperatures and having cross-directional strength points at temperatures lower than peak cross-directional strength raised as compared to a nonwoven material produced under same conditions from fibers produced under same condition except for absence of the polymeric bond curve enhancing agent.

41. A nonwoven material comprising fibers according to claim 30 bonded together.

42. The fiber according to claim 28, wherein said polymeric bond curve enhancing agent provides an increase in area over a defined temperature range under a bond curve of cross-directional strength vs. temperature as compared to a nonwoven material produced under same conditions from fibers produced under same conditions except for absence of the polymeric bond curve enhancing agent.

43. The fiber according to claim 42, wherein said increase in area is provided by the bond curve being flatter and having the same or substantially the same peak cross-directional strength as compared to a nonwoven material produced under same conditions from fibers produced under same conditions except for absence of the polymeric bond curve enhancing agent.

44. The fiber according to claim 42, wherein said increase in area is provided by the bond curve being of the same or substantially the same shape and having higher cross-directional curve over the defined temperature range as compared to a nonwoven material produced under same conditions from fibers produced under same conditions except for absence of the polymeric bond curve enhancing agent.

45. The fiber according to claim 44, wherein said at least some point include a higher peak cross-directional strength.

46. The fiber according to claim 42, wherein said increase in area is provided by the bond curve being shifted to lower temperature with the area under the bond curve in the defined temperature range being increased as compared to a nonwoven material produced under same conditions from fibers produced under same conditions except for absence of the polymeric bond curve enhancing agent.

47. A nonwoven material comprising fibers according to claim 42 bonded together.

48. The fiber according to claim 42, wherein said increase in area is provided by the bond curve being flatter and having the same peak cross-directional strength as compared to a nonwoven material produced under same conditions from fibers produced under same conditions except for absence of the polymeric bond curve enhancing agent.

49. The fiber according to claim 42, wherein said increase in area is provided by the bond curve being flatter and having a lower peak cross-directional strength as compared to a nonwoven material produced under same conditions from fibers produced under same conditions except for absence of the polymeric bond curve enhancing agent.

50. The fiber according to claim 42, wherein said increase in area is provided by the bond curve being flatter and having cross-directional strength points at temperatures lower than peak cross-directional strength raised as compared to a nonwoven material produced under same conditions from fibers produced under same conditions except for absence of the polymeric bond curve enhancing agent.

51. The fiber according to claim 42, wherein said increase in area is provided by the bond curve being flatter and being shifted to lower temperatures as compared to a nonwoven material produced under same conditions from fibers produced under same conditions except for absence of the polymeric bond curve enhancing agent.

52. The fiber according to claim 42, wherein said increase in area is provided by the bond curve being flatter, being shifted to lower temperatures and having cross-directional strength points at temperatures lower than peak cross-directional strength raised as compared to a nonwoven material produced under same conditions from fibers produced under same conditions except for absence of the polymeric bond curve enhancing agent.

53. A nonwoven material comprising fibers according to claim 28 bonded together.

54. The fiber according to claim 1, wherein the polymeric bond curve enhancing agent comprises at least one polymer selected from the group consisting of alkene vinyl carboxylate polymers, polyethylenes, alkene acrylic acids or esters, alkene co-acrylates, acid modified alkene acrylates, alkene acrylate acrylic acid polymers, and polyamides.

55. The fiber according to claim 54, wherein the polymeric bond curve enhancing agent comprises at least one polymer selected from the group consisting of ethylene vinyl acetate polymers, polyethylenes, ethylene methacrylic acids, ethylene N-butyl acrylate glycidyl methacrylate, alkene co-acrylate co-carbon monoxide polymers, acid modified ethylene acrylates, ethylene acrylate methacrylic acid terpolymers, and nylon 6.

56. The fiber according to claim 55, wherein the ethylene vinyl acetate polymers comprise at least one of ethylene vinyl acetate copolymer and ethylene vinyl acetate terpolymer; the alkene co-acrylate co-carbon monoxide polymers comprise ethylene N-butyl acrylate carbon oxides; and the acid modified ethylene acrylates comprise at least one of ethylene isobutyl acrylate-methyl acrylic acid and ethylene N-butyl acrylic methylacrylic acid.

57. The fiber according to claim 1, wherein said fiber has a $\%\Delta A_1$ which is greater than that of a nonwoven material produced under same conditions from fibers produced under same conditions except for absence of the polymeric bond curve enhancing agent.

58. The fiber according to claim 57, wherein said $\%\Delta A_1$ is increased by a member selected from the group consisting of at least about 3% at least about 15%, at least about 20%, at least about 30%, at least about 40% at least about 50% and at least about 60%.

59. The fiber according to claim 1, wherein said fiber has a $\%\Delta A_1$ and a $\%\Delta A_m$ which is greater than that of a nonwoven material produced under same conditions from fibers produced under same conditions except for absence of the polymeric bond curve enhancing agent.

60. The fiber according to claim 1, wherein said fiber has a $\%\Delta A_1$, a $\%\Delta A_m$ and a $\%\Delta A_p$ which is greater than that of a nonwoven material produced under same conditions from fibers produced under same conditions except for absence of the polymeric bond curve enhancing agent.

61. The fiber according to claim 1, wherein said polymeric bond curve enhancing agent comprises a plurality of polymeric bond curve enhancing agents.

62. The fiber according to claim 61, wherein said plurality of bond curve enhancing agents comprise at least one ethylene vinyl acetate polymer and at least one polyamide.

63. The fiber according to claim 61, wherein said plurality of bond curve enhancing agents comprise at least one ethylene vinyl acetate polymer and at least one polyethylene.

64. The fiber according to claim 1, wherein said polymer blend further comprises an additional polymer.

65. The fiber according to claim 1, wherein said fiber comprises a hydrophobic or a hydrophilic finish.

66. The fiber according to claim 1, wherein said fiber comprises a circular, diamond, delta, concave delta, trilobal, oval, or "X"-shaped cross-sectional configuration.

67. The fiber according to claim 66, wherein said cross-sectional configuration comprises a concave delta cross-sectional configuration.

68. The fiber according to claim 1, wherein said fiber comprises a denier of less than about 5.

69. The fiber according to claim 68, wherein said fiber comprises a denier of between about 0.5 and 3.

70. The fiber according to claim 1, wherein said fiber is a monocomponent fiber.

71. The fiber according to claim 1, wherein said fiber comprises a staple fiber.

72. The fiber according to claim 1, wherein said fiber is a bicomponent fiber.

73. A nonwoven material comprising fibers according to claim 1, bonded together.

74. The nonwoven material according to claim 73 comprising a basis weight of less than about 20 g/yd$^2$.

75. The nonwoven material according to claim 74 comprising a basis weight of less than about 18 g/yd$^2$.

76. The nonwoven material according to claim 75 comprising a basis weight of less than about 17 g/yd$^2$.

77. The nonwoven material according to claim 76 comprising a basis weight of less than about 15 g/yd$^2$.

78. The nonwoven material according to claim 77 comprising a basis weight of less than about 14 g/yd$^2$.

79. The nonwoven material according to claim 73 comprising a basis weight of about 14 to 20 g/yd$^2$.

80. A hygienic product comprising a diaper comprising an outer layer, an inner nonwoven fabric layer, and an intermediate absorbent layer, wherein at least one of the outer layer and the inner nonwoven fabric layer comprise the nonwoven of claim 73.

81. The fiber according to claim 1, wherein the fiber comprises at least one hollow portion.

82. A fiber comprising a polymer blend of polypropylene and ethylene vinyl acetate polymer, said fiber comprising a skin-core structure comprising a skin and a core, and said polypropylene and said ethylene vinyl acetate polymer are present in both said skin and said core.

83. The fiber according to claim 82, wherein said polypropylene comprises a dominant phase of said skin-core structure, and said ethylene vinyl acetate polymer comprises fibrils dispersed throughout said skin-core structure.

84. A nonwoven material comprising fibers according to claim 83 bonded together. under same conditions except for absence of the polymeric bond curve enhancing agent.

85. The fiber according to claim 82, wherein said skin core structure comprises a surface zone, an inner zone and a gradient therebetween; said surface zone comprising, a high concentration of oxidative chain scission degraded polypropylene as compared to said inner zone, and said gradient comprising a decreasing weight average molecular weight towards the external surface.

86. The fiber according to claim 82, wherein said skin-core structure comprises an inner core of said polymer blend, and a surface zone of said polymer blend surrounding said inner core, said surface zone comprising said polypropylene as oxidative chain scission degraded polypropylene, so that said inner core and said surface zone define a skin-core structure of the polymer blend.

87. The fiber according to claim 86, wherein said oxidative chain scission degraded polypropylene is substantially limited to said surface zone, wherein said inner core and said surface zone comprise adjacent discrete portions of said skin-core structure.

88. The fiber according to claim 82, wherein said skin-core structure includes an inner core and a surface zone showing a ruthenium staining enrichment of at least about 0.2 $\mu$m surrounding said inner core, said inner core comprising said polymer blend and said surface zone comprising said polymer blend as oxidative chain scission degraded polymeric material.

89. The fiber according to claim 88, wherein said skin-core structure shows a ruthenium staining enrichment of at least about 0.5 $\mu$m surrounding said inner core.

90. The fiber according to claim 89, wherein said skin-core structure shows a ruthenium staining enrichment of at least about 1 $\mu$m surrounding said inner core.

91. The fiber according to claim 88, wherein said oxidative chain scission degraded polymeric material is substantially limited to said surface zone, wherein said inner core and said surface zone comprise adjacent discrete portions of said skin-core structure.

92. The fiber according to claim 88, comprising a gradient of oxidative chain scission degraded polymer material between said inner core and said surface zoned.

93. The fiber according to claim 82, wherein said skin-core structure comprises an inner core of said polymer blend, a surface zone surrounding said inner core, said surface zone comprising said polymer blend as oxidative chain scission degraded polymeric material, so that said inner core and said surface zone define a skin-core structure, and said inner core has a melt flow rate substantially equal to an average melt flow rate of said fiber.

94. The fiber according to claim 82, wherein the skin-core structure comprises an inner core of polymer blend having a melt flow rate, and said fiber has an average melt flow rate about 20 to 300% higher than the melt flow rate of said inner core.

95. A nonwoven material comprising fibers according to claim 94 bonded together.

96. A nonwoven material comprising fibers according to claim 82 bonded together.

97. A hygienic product comprising a diaper comprising an outer layer, an inner nonwoven fabric layer, and an intermediate absorbent layer, wherein at least one of the outer layer and the inn nonwoven fabric layer comprise the nonwoven of claim 96.

98. A fiber comprising a polymer blend of polypropylene and polymeric bond curve enhancing agent, said fiber comprising a skin-core structure comprising a skin and a core, and said polypropylene and said polymeric bond curve enhancing agent are present in both said skin and said core, said skin-core fiber being prepared by extruding a polymer blend comprising said polypropylene and said polymeric bond curve enhancing agent as a hot extrudate, the polymeric bond curve enhancing agent being present in an amount less than 20% by weight of the polymer blend.

99. The fiber according to claim 98, wherein the polymeric bond curve enhancing agent is present in an amount less than about 10% by weight of the polymer blend.

100. The fiber according to claim 99, wherein the polymeric bond curve enhancing agent is present in an amount less than about 10% by weight of the polymer blend.

101. The fiber according to claim 98, wherein the polymeric bond curve enhancing agent is present in an amount of about 0.5 to 7% by weight of the polymer blend.

102. The fiber according to claim 101, wherein polymeric bond curve enhancing agent is present in an amount of about 1 to 5% by weight of the polymer blend.

103. The fiber according to claim 98, wherein the polymeric bond curve enhancing agent is present in an amount of about 1.5 to 4% by weight of the polymer blend.

* * * * *